US007220537B2

(12) United States Patent
Kondo et al.

(10) Patent No.: US 7,220,537 B2
(45) Date of Patent: May 22, 2007

(54) SILVER HALIDE EMULSION SILVER HALIDE PHOTOGRAPHIC SENSITIVE MATERIAL AND METHOD OF IMAGE FORMATION

(75) Inventors: Toshiya Kondo, Hino (JP); Shuji Murakami, Matsuda-machi (JP); Koichiro Kuroda, Hino (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 0 days.

(21) Appl. No.: 10/543,440

(22) PCT Filed: Jan. 31, 2003

(86) PCT No.: PCT/JP03/00986

§ 371 (c)(1),
(2), (4) Date: Jul. 25, 2005

(87) PCT Pub. No.: WO2004/068237

PCT Pub. Date: Aug. 12, 2004

(65) Prior Publication Data

US 2006/0121397 A1 Jun. 8, 2006

(51) Int. Cl.
*G03C 1/06* (2006.01)
*G03C 1/005* (2006.01)
*G03C 1/494* (2006.01)

(52) U.S. Cl. ..... 430/599; 430/600; 430/603; 430/567; 430/604; 430/605; 430/611; 430/607

(58) Field of Classification Search ..... 430/599, 430/600, 603, 567, 604, 605, 611, 607
See application file for complete search history.

(56) References Cited

U.S. PATENT DOCUMENTS

| | | | | |
|---|---|---|---|---|
| 1,574,944 | A | 3/1926 | Sheppard | |
| 1,602,592 | A | 10/1926 | Sheppard | |
| 1,623,499 | A | 4/1927 | Sheppard et al. | |
| 2,278,947 | A | 4/1942 | Riester | |
| 2,410,689 | A | 11/1946 | Sheppard | |
| 2,728,668 | A | 12/1955 | Mochel | |
| 2,824,001 | A | 2/1958 | Allen et al. | |
| 3,297,447 | A | 1/1967 | McVeigh | |
| 3,297,466 | A | 1/1967 | Herman et al. | |
| 3,320,069 | A | 5/1967 | Illingsworth | |
| 3,408,196 | A | 10/1968 | McVeigh | |
| 3,408,197 | A | 10/1968 | McVeigh | |
| 3,420,670 | A | 1/1969 | Milton | |
| 3,442,653 | A | 5/1969 | Dunn | |
| 3,501,313 | A | 3/1970 | Willems | |
| 3,591,385 | A | 7/1971 | Evans | |
| 3,656,955 | A | 4/1972 | Ushimaru et al. | |
| 4,183,746 | A | 1/1980 | Pearce et al. | |
| 4,225,666 | A | 9/1980 | Locker et al. | |
| 5,240,827 | A | 8/1993 | Lewis | |
| 5,627,020 | A | 5/1997 | Hahm et al. | |
| 5,853,951 | A | 12/1998 | Yasuda et al. | |
| 6,107,018 | A | 8/2000 | Mydlarz et al. | |
| 6,780,579 | B2 * | 8/2004 | Sasaki et al. | 430/603 |
| 2002/0051949 | A1 | 5/2002 | Kuroda | |
| 2002/0102505 | A1 | 8/2002 | Nakahira et al. | |
| 2004/0146816 | A1 | 7/2004 | Kondo et al. | |

FOREIGN PATENT DOCUMENTS

| | | | |
|---|---|---|---|
| EP | 1 174 760 | A2 | 1/2002 |
| EP | 1220023 | A2 | 7/2002 |
| JP | 05-066513 | A | 3/1993 |
| JP | 05-313293 | A | 11/1993 |
| JP | 09-005922 | A | 1/1997 |
| JP | 09-005924 | A | 1/1997 |
| JP | 2000-131788 | A | 5/2000 |
| JP | 2001-188311 | A | 7/2001 |

* cited by examiner

*Primary Examiner*—Geraldina Visconti
(74) *Attorney, Agent, or Firm*—Frishauf, Holtz, Goodman & Chick, P.C.

(57) ABSTRACT

This invention provides a silver halide emulsion, a silver halide photographic material and an image forming method, which is excellent in high sensitivity, good gradation, coating composition store stability and latent image store stability regardless exposing method, particularly excellent latent image store stability at high intensity and shot period exposure of digital exposure, and by which a high quality print is obtained. The silver halide emulsion contains silver halide grains having silver chloride content of at least 90 mol %, silver iodide content of 0-2.0 mol %, and silver bromide content of 0.02-5.0 mol %, and containing at least two kinds of Group 8 metal compounds containing at least one iridium compound inside of the silver halide grains, in which the silver halide grains are subjected to selenium sensitization in presence of a compound represented by formula (S)

Formula (S)

13 Claims, No Drawings

SILVER HALIDE EMULSION SILVER HALIDE PHOTOGRAPHIC SENSITIVE MATERIAL AND METHOD OF IMAGE FORMATION

This application is the United States national phase application of International Application PCT/JP2003/000986 filed Jan. 31, 2003.

TECHNICAL FIELD OF THE INVENTION

Recent rapid directivity to digitization has led to increased opportunities of subjecting silver halide photographic materials (briefly referred as photosensitive materials) to digital exposure. Along with such a trend, photographic color paper as a photographic material for color prints is desired with respect to suitability for exposure at a relatively high intensity for an extremely short time at the level of milli-seconds to nano-seconds and aptitude for scanning exposure.

BACKGROUND OF THE INVENTION

The recent rapid directivity to digitization has led to increased opportunities of subjecting silver halide photographic materials to digital exposure. Along with such a trend, photographic color paper as a photographic material for color prints is desired with respect to suitability for exposure at a relatively high intensity for an extremely short time at the level of milli-seconds to nano-seconds and aptitude for scanning exposure.

There have been employed silver chloride emulsions or high chloride silver halide emulsions in color paper to achieve rapid processability. Further, it is commonly known that doping iridium compounds is effective to improve reciprocity law failure characteristics as a matter of properties of silver halide emulsions. There are disclosed high chloride silver halide emulsion grains having a high bromide region in the vicinity of the corners of the grains, as described in JP-A No. 64-26837 (hereinafter, the term JP-A refers to Japanese Patent Application Publication); high chloride silver halide emulsion grains in which a bromide-localized region is selectively doped with an iridium compound, thereby leading to superior latent image stability and reciprocity law failure characteristics, as described in JP-A No. 1-105940. There is also disclosed a method of forming a bromide-localized region by using silver bromide fine-grains doped with an iridium compound, as described in U.S. Pat. No. 5,627,020. However, neither of the foregoing methods was sufficient for improving latent image stability in the initial stage after exposure.

In digital exposure systems of the recent subject, it was proved that sufficient practical qualities were not achieved by only known techniques for improving latent image stability, in exposure suitability at a high intensity for an extremely short time. Techniques adaptable to such a digital exposure system include, for examples, chemical sensitization and spectral sensitization suitable for formation of a bromide-localized phase, as described in U.S. Pat. No. 5,601,513; and the use of a silver iodochloride emulsion, as described in European Patent Nos. 750,222 and 772,079.

However, it was proved in studies by the inventors of this application that the foregoing techniques for improving aptitude for digital exposure was not only insufficient for improving latent image stability but also resulted in marked deteriorated pressure resistance and pre-exposure storage stability of photographic materials. It is desired to immediately solve this matter.

JP-A No. 2001-188311 discloses a method for improving reciprocity law failure and coating composition stability, in which silver halide grains contain a bromide-rich or iodide-rich phase in the vicinity of the grain surface and introduction of such a rich phase is separated into two occasions, before and after addition of mercapto compounds. However, it was proved that using only this method was insufficient for improving storage stability of silver halide emulsions.

JP-A Nos. 6-19024 and 6-19026 disclose that adding non-labile di-chalcogen compounds before or during formation of silver halide grains, or during spectral/chemical sensitization of a silver halide emulsion improves fresh fog or aging fog. Further, JP-A No. 6-19037 discloses adding such compounds in the form of a solid particle dispersion and JP-A No. 6-35147 discloses that a silver chloride emulsion containing a diaminodisulfide compound and a sulfonate compound at a weight ratio of 1:1 to 1:20 improves storage stability and performance variation caused by temperature fluctuation at the time of exposure on color photographic materials.

JP-A No. 6-202265 discloses that adding a specific disulfide compound and a specific sulfinate or seleninate compound before or during spectral/chemical sensitization results in reduced fogging and enhanced sensitivity. There is also disclosed a photographic element comprising a silver chloride emulsion including a water-soluble disulfide compound, leading to reduced fogging, reduced variation in fog density and sensitivity after pre-exposure storage and reduced variation in sensitivity due to temperature fluctuation at the time of exposure, as described in JP-A No. 7-72580.

However, neither of the foregoing methods was sufficient in description and effectiveness with respect to latent image stability, storage stability and pressure resistance, specifically, latent image stability, storage stability and pressure resistance of emulsions exposed at a high intensity.

Though JP-A No. 6-148783, 6-175263 and so on discloses a photographic material containing a crown ether compound, there is scarce disclosure on detail of chemical sensitization, or spectral sensitization and therefore there is no teaching as for application to selenium sensitization.

A photographic element containing silver chloride grains having selenium compound at the surface of the grains (for example, Patent Document 1 and 2), it is not clear there is an improvement of photographic characteristics other than sensitivity. Particularly there is no disclosure on halide content or dopant which are necessary for improvement of characteristics such as gradation, latent image and so on. Therefore it is difficult to provide a practical silver halide photographic light sensitive material satisfying various characteristics demanded recently. There is a disclosure concerning silver halide photographic light sensitive materials in which selenium sensitization or tellurium sensitization is applied to silver chloride or silver chlorobromide grains having high chloride content (for example, Patent Documents 3, 4 and 5). However improvement effects on characteristics such as latent image stability or coating composition storage stability is not clear, and further the improvement of sensitivity and gradation recently demanded for silver halide photographic light sensitive materials is not satisfactory.

(Patent Document 1)
JP-A No. 5-66513
(Patent Document 2)
U.S. Pat. No. 5,240,827
(Patent Document 3)
JP-A No. 5-313293

(Patent Document 4)
JP-A No. 9-5922
(Patent Document 5)
JP-A No. 9-5924

DESCRIPTION OF THE INVENTION

The above-mentioned object was attained by the following.

(1). A silver halide emulsion containing silver halide grains having silver chloride content of at least 90 mol %, silver iodide content of 0-2.0 mol %, and silver bromide content of 0.02-5.0 mol %, and containing at least two kinds of Group 8 metal compounds containing at least one iridium compound inside of the silver halide grains, wherein the silver halide grains are subjected to selenium sensitization in presence of a compound represented by formula (S).

Formula (S)

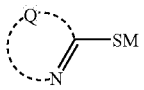

wherein Q is an atomic group necessary to form a 5- or 6-membered nitrogen-containing ring; $M^1$ is a hydrogen atom, an alkali metal or a cation group.

(2). The silver halide emulsion containing silver halide grains having silver chloride content of at least 90 mol %, silver iodide content of 0-2.0 mol %, and silver bromide content of 0.02-5.0 mol %, and containing at least two kinds of Group 8 metal compounds containing at least one iridium compound inside of the silver halide grains, wherein the silver halide grains contains at least one compound represented by formula (1) to (3), and the silver halide grains are subjected to selenium sensitization, $$R—SO_2S\text{-}M \quad \text{Formula (1)}$$

$$R_1—SO_2S—R_2 \quad \text{Formula (2)}$$

$$R_3—SO_2S\text{-}L_m\text{-}SSO_2—R_4 \quad \text{Formula (3)}$$

wherein R, $R_1$, $R_2$, $R_3$, and $R_4$ are each an aliphatic group, an aromatic group or a heterocyclic group; M is a cation; L is a divalent linkage group; and m is 0 or 1.

(3). The silver halide emulsion containing silver halide grains having silver chloride content of at least 90 mol %, silver iodide content of 0-2.0 mol %, and silver bromide content of 0.02-5.0 mol %, and containing at least two kinds of Group 8 metal compounds containing at least one iridium compound inside of the silver halide grains, wherein the silver halide grains contains a compound represented by formula (4), and the silver halide grains are subjected to selenium sensitization, $$R_1—(S)_m—R_2 \quad \text{Formula (4)}$$

wherein $R_1$ and $R_2$ are each an aliphatic group, an aromatic group or a heterocyclic group, or an atomic group forming a ring by bonding. $R_1$ and $R_2$ may be same or different. $R_1$ and $R_2$ combine with each other to form a ring when they are aliphatic groups; m1 is an integer of 2 to 6.

(4). The silver halide emulsion containing silver halide grains having silver chloride content of at least 90 mol %, silver iodide content of 0-2.0 mol %, and silver bromide content of 0.02-5.0 mol %, and containing at least two kinds of Group 8 metal compounds containing at least one iridium compound inside of the silver halide grains, wherein the silver halide grains contain a crown ether compound condensed by at least one aromatic ring, and the silver halide grains are subjected to selenium sensitization, (5). The silver halide emulsion described in one of (1) to (4), wherein at least one of the iridium compound is an iridium complex containing at least one aquo or organic ligand.

(6). The silver halide emulsion described in one of (1) to (5), wherein the silver halide grains contains silver bromide-localized phase at least one portion of outermost shell.

(7). The silver halide emulsion described in one of (1) to (6), wherein the silver halide grains contains silver iodide-localized phase inside of the silver halide grains.

(8). The silver halide emulsion described in one of (1) to (7), wherein the silver halide grains contains the compound represented by formula (S) inside of the silver halide grains.

(9). The silver halide emulsion described in one of (1) or (8), wherein the compound represented by formula (S) is a compound represented by formula (S-2), Formula (S-2)

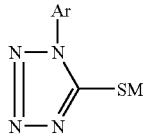

wherein Ar is a group represent by the following formula:

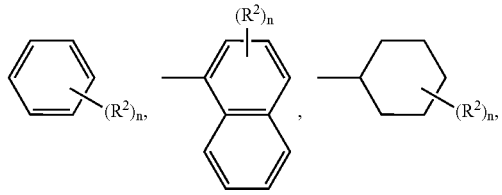

wherein $R^2$ is an alkyl group, an alkoxy group, a carboxy group or its salt, a sulfo group or its salt, a hydroxy group, an amino group, an acylamino group, a carbamoyl group or a sulfonamido group; n is an integer of 0 to 2; $M^1$ is the same as defined in the formula (S).

(10). A silver halide photographic light sensitive material having at least one of an image forming layer provided on a support, wherein at least one of the image forming layer comprises silver halide emulsion described at least one of (1) to (9).

(11). An image forming method comprising color developing after scanning exposing a silver halide photographic light sensitive material of (10).

MOST PREFERRED EMBODIMENT OF THE INVENTION

In one feature of the silver halide emulsion of the invention, cubic silver halide grains account for at least 50% by number of whole silver halide grains, preferably at least 90% and more preferably at least 97% and particularly preferably at least 97% by number.

In the silver halide emulsion relating to this invention, silver halide grains have an iodide content of from 0 to 2 mol % or more, and preferably have an average iodide content of from 0.02 to 0.5 mol %.

The silver halide grains relating to this invention preferably have at least one iodide-localized silver halide phase in the interior of the grains. In the invention, the interior of the grains refers to a silver halide phase, except for the grain surface. The iodide-localized silver halide phase (hereinafter, also denoted as iodide-localized phase) is a silver halide phase having at least two times the average iodide content of the grains, preferably at least three times the average iodide content, and more preferably at least 5 times the average iodide content.

The iodide-localized phase is located in a portion external to 60% (preferably 70%, and more preferably 80%) of the grain volume within the grain.

In one preferred embodiment, the iodide-localized phase exists in the form of a layer in the interior of the grain (which is hereinafter also called iodide-localized layer) and the iodide-localized layer preferably composed of at least two layers, in which the main layer is introduced according to the conditions described above and at least one layer (hereinafter, called a sub-layer) having an iodide content less than the maximum iodide content is introduced closer to the grain surface than the main layer. Iodide contents of the main layer and sub-layer can be chosen in accordance with the objective. Preferably, the main layer has an iodide content as high as possible and the sub-layer has an iodide content lower than the main layer from the viewpoint of latent image stability.

In another preferred embodiment, the iodide-localized phase, which exists in the vicinity of corners or edges of the grain can be used in combination with the foregoing iodide-localized phase.

There can be used various iodine compounds to allow silver iodide to be contained in silver halide grains. Examples thereof include the use of an aqueous iodide salt solution, such as an aqueous potassium iodide solution, the use of a polyiodide compound, as described in S. Nakahara "Mukikagobutsu•Sakutai Jiten" (Dictionary of Inorganic Compound and Complex, page 944, published by Kodansha) and the use of fine iodide-containing silver halide grains or iodide ion-releasing agents, as disclosed in JP-A No. 2-68538. The use of potassium iodide or a polyiodide of $I_4$ or higher is preferred, and the use of a polyiodide of $I_4$ or higher is more preferred in terms of rapid processability and process stability. The iodide content of the iodide-localized phase can be controlled by arbitrarily adjusting a concentration or a quantity of an iodide containing solution.

Silver halide grains included in a silver halide emulsion relating to this invention usually contain 0.02 to 5.0 mol % bromide, preferably 0.03 to 3.0 mol % bromide, and more preferably 0.05 to 2.0 mol % bromide.

In the silver halide grains, the bromide containing phase preferably accounts for 50 to 100%, and more preferably 70 to 100% of the grain volume.

A silver halide emulsion comprising silver halide grains having a high bromide portion within the grain is also preferred in this invention. The high bromide portion may be formed by an epitaxial junction or by forming a core/shell structure. Alternatively, there may exist regions partially differing in bromide composition without forming a complete layer. The bromide composition may be continuously varied or discontinuously varied, and silver halide grains having a bromide-localized phase in the vicinity of corners of the grain are preferred.

The expression bromide-localized phase herein means a silver halide phase having a relatively high bromide content. Thus, the bromide-localized phase has a bromide content of at least two times the average bromide content of the grains, preferably at least three times and more preferably at least 5 times the average bromide content.

The bromide-localized phase preferably contains a Group 8 metal compound, as described later. The Group 8 metal compound is preferably an iridium complex compound.

Silver halide grains relating to this invention each occludes at least two kinds of compounds each containing a metal in Group 8 of the periodical table of elements, which include at least one iridium compound. It is preferred to contain at least one Group 8 metal compound and at least one iridium compound inside of the grain. The iridium compound is preferably an iridium coordination complex containing at least one water (or aqua) ligand and/or an organic ligand, as described below.

It is more preferred that silver halide grains contain at least three kinds, further preferably at least four kinds, and particularly preferably at least five kinds of Group 8 metal compounds including at least two iridium compounds inside of the silver halide grain.

The silver halide emulsion grains relating to this invention preferably occlude at least one Group 8 metal cyano complex, besides the foregoing iridium compound.

The Group 8 metal compounds usable in this invention is preferably a compound containing a metal selected from iron iridium, rhodium, osmium, ruthenium, cobalt and platinum, which are chosen from metal atoms, metal ions, their complexes or salts (complex salts), and compounds including the foregoing, and preferably from metal complexes.

Of metal complexes, six-coordinate complex, five-coordinate complex, four-coordinate complex and two-coordinate complex are preferred and six-coordinate complex and four-coordinate complex are more preferred.

Any ligand is usable and examples of a ligand include carbonyl ligand, fulminate ligand, thiocyanate ligand, nitrosyl ligand, thionitrosyl ligand, cyano ligand, water (or aquo-) ligand, halogen ligand, ligands of ammonia, a hydroxide, nitrous acid, sulfurous acid and a peroxide and organic ligands. Of these, it is preferred to contain at least one ligand selected from nitrocyl ligand, thionitrocyl ligand, cyano ligand, water ligand, halogen ligand and an organic ligand.

In this invention, the organic ligand refers to a compound containing at least one of H—C, C—C and C—N—H bonds and capable of being coordinated with a metal ion. Preferred organic ligands usable in this invention include a compound selected from pyridine, pyrazine, pyrimidine, pyrane, pyridazine, imidazole, thiazole, isothiazole, triazole, pyrazole, furan, furazane, oxazole, isooxazole, thiophene, phenthroline, bipyridine and ethylenediamine, their ions and compounds substituted with the foregoing compounds.

Preferred in this invention is occlusion of at least a compound represented by the following formula (A):

$$R_n[MX_mXY_{6-m}] \qquad \text{formula (A)}$$

wherein M is a metal selected from Group 8 elements of the periodical table (which is preferably iron, cobalt, ruthenium, iridium, rhodium, osmium or platinum, and more preferably iron, ruthenium, iridium, rhodium, or osmium); R is an alkali metal, which is preferably cesium, sodium or potassium; "m" is an integer of 0 to 6, and "n" is an integer of 0 to 4; X and Y are each a ligand, including carbonyl ligand, fulminate ligand, thiocyanate ligand, nitrosyl ligand, thionitrosyl ligand, cyano ligand, aqua ligand, halogen ligand, ligands of ammonia, a hydroxide, nitrous acid, sulfurous acid and a peroxide and organic ligands.

Specific examples of the Group 8 metal compound and Group 8 metal complex are shown below but are by no means limited to these. Any counter cation is usable, including potassium ion, calcium ion, sodium ion ammonium ion. Counter anions for the metal complex include nitrate ion, halide ion and perchlorate ion.

A-1: $K_2[IrCl_6]$
A-2: $K_3[IrCl_6]$
A-3: $K_2[Ir(CN)_6]$
A-4: $K_3[Ir(CN)_6]$
A-5: $K_2[Ir(NO)Cl_5]$
A-6: $K_3[Ir(NO)Cl_5]$
A-7: $K_2[IrBr_6]$
A-8: $K_3[IrBr_6]$
A-9: $Na_2[IrBr_6]$
A-10: $Na_3[IrBr_6]$
A-11: $K_2[IrBr_4Cl_2]$
A-12: $K_3[IrBr_4Cl_2]$
A-13: $K_2[IrBr_3Cl_3]$
A-14: $K_3[IrBr_3Cl_3]$
A-15: $K_2[IRBr_5Cl]$
A-16: $K_3[IrBr_5Cl]$
A-17: $K_2[IrBr_5I]$
A-18: $K_3[IrBr_5I]$
A-19: $K[IrBr_5(H_2O)]$
A-20: $K[IrBr_5(H_2O)_2]$
A-21: $K_2[IrBr_5(H_2O)]$
A-22: $K_3[IrBr_5(H_2O)]$
A-23: $K_4[IrBr_5(H_2O)]$
A-24: $K[IrCl_5(H_2O)_2]$
A-25: $K_2[IrCl_5(H_2O)]$
A-26: $K_2[IrCl_4(H_2O)]$
A-27: $K_3[IrCl_5(H_2O)]$
A-28: $K_4[IrCl_5(H_2O)]$
A-29: $K_4[IrCl_6]$
A-30: $K_2[Ir(CN)_5(H_2O)]$
A-31: $K_3[Ir(CN)_5(H_2O)]$
A-32: $K_4[Ir(thiazole)Cl_5]$
A-33: $K_4[Ir(imidazole)Cl_5]$
B-1: $K_2[RuCl_6]$
B-2: $K_2[PtCl_6]$
B-3: $K_2[Pt(SCN)_4]$
B-4: $K_2[NiCl_4]$
B-5: $K_2[PdCl_6]$
B-6: $K_3[RhCl_6]$
B-7: $K_2[OsCl_6]$
B-8: $K_2[ReCl_6]$
B-9: $K_3[RhBr_6]$
B-10: $K_3[Mo(OCN)_6]$
B-11: $K_3[Re(CNO)_6]$
B-12: $K_4[Ru(CNO)_6]$
B-13: $K_4[Fe(CNO)_6]$
B-14: $K_2[Pt(CNO)_4]$
B-15: $K_3[Co(NH_3)_6]$
B-16: $K_5[CO_2(CNO)_{11}]$
B-17: $K_3[Re(CNO)_6]$
B-18: $K_4$ $[Os(CNO)_6]$
B-19: $Cs_2[Os(NO)Cl_5]$
B-20: $K_2[Ru(NO)Cl_5]$
B-21: $K_2[Ru(CO)Cl_5]$
B-22: $Cs_2[Os(CO)Cl_5]$
B-23: $K_2[Fe(NO)Cl_5]$
B-24: $K_2[Ru(NO)Br_5]$
B-25: $K_2[Ru(NO)I_5]$
B-26: $K_2[Re(NO)Br_5]$
B-27: $K_2[Re(NO)Cl_5]$
B-28: $K_2[Ru(NS)Cl_5]$
B-29: $K_2[Os(NS)Br_5]$
B-30: $K_2[Ru(NS)Br_5]$
B-31: $K_2[Ru(NS)(SCN)_5]$
B-32: $K_4[Fe(CN)_6]$
B-33: $K_3[Fe(CN)_6]$
B-34: $K_4[Ru(CN)_6]$
B-35: $K_2[RuBr(CN)_5]$
B-36: $K_4[Os(CN)_6]$
B-37: $K_2[Os(NS)(CN)_5]$
B-38: $K_4[Re(CN)_6]$
B-39: $K_2[ReCl(CN)_5]$ In addition to the foregoing, metal compounds described in JP-A No. 5-341426 are also preferably used.

The following iridium compounds may be employed preferably.

C-1: $[Ir(bipy)Cl_4]^-$
C-2: $[Ir(bipy)_3]^{2+}$
C-3: $[Ir(py)_6]^{2+}$
C-4: $[Ir(phen)_3]^{2+}$
C-5: $[IrCl_2(bipy)_2]^0$
C-6: $[Ir(thia)_6]^{2+}$
C-7: $[Ir(phen)\ (bipy)_3]^{2+}$
C-8: $[Ir(im)_6]^{2+}$
C-9: $[Ir(NCS)\ (bipy)_2]^0$
C-10: $[Ir(CN)_2(bipy)_2]^0$
C-11: $[IrCl_2(bipy)_3]^0$
C-12: $[IrCl_2(bipy)_2]^0$
C-13: $[Ir(phen)(bipy)_2]^{2+}$
C-14: $Ir(NCS)_2(bipy)_2^0$
C-15: $[Ir(NCS)_2(bipy)_2]^0$
C-16: $[Ir(bipy)(H_2O)(bipy')]^{2+}$
C-17: $[Ir(bipy)_2(OH)(bipy')]^+$
C-18: $[Ir(bipy)Cl_4]^{2-}$
C-19: $[Ir(bipy)_3]^{3+}$
C-20: $[Ir(py)_6]^{3+}$
C-21: $[Ir(phen)_3]^{3+}$
C-22: $[IrCl_2(bipy)_2]^+$
C-23: $[Ir(thia)_6]^{3+}$
C-24: $[Ir(phen)(bipy)_3]^{3+}$
C-25: $[Ir(im)_6]^{3+}$
C-26: $[Ir(NCS)_2(bipy)_2]^+$
C-27: $[Ir(CN)_2(bipy)_2]^+$
C-28: $[IrCl_2(bipy)_3]^+$
C-29: $[IrCl_2(bipy)_2]^+$
C-30: $[Ir(phen)(bipy)_2]^{3+}$
C-31: $[Ir(NCS)_2(bipy)_2]^+$
C-32: $[Ir(NCS)_2(bipy)_2]^+$
C-33: $[Ir(bipy)_2(H_2O)\ (bipy')]^{3+}$
C-34: $[Ir(bipy)_2(OH)\ (bipy')]^{2+}$ Further bipyridine complexes described in JP-A No. 5-341426 are preferably used.

To allow the foregoing Group 8 metal compounds to be included, doping may be conducted during physical ripening of silver halide grains or in the course of forming silver halide grains (in general, during addition of water-soluble silver salt and alkali halide). Alternatively, forming silver halide grains is interrupted and doping is carried out, then, the grain formation is continued. Doping can also be conducted by performing nucleation, physical ripening or grain formation in the presence of a Group 8 metal compound.

The Group 8 metal compound is used in an amount of $1\times10^{-9}$ to $1\times10^{-2}$ mol, preferably $1\times10^{-9}$ to $1\times10^{-3}$ mol, and more preferably $2\times10^{-9}$ to $1\times10^{-4}$ mol per mol of silver halide.

To allow the foregoing Group 8 metal compounds to be included, doping may be conducted during physical ripening of silver halide grains or in the course of forming silver halide grains (in general, during addition of water-soluble silver salt and alkali halide). Alternatively, forming silver halide grains is interrupted and doping is carried out, then, the grain formation is continued. Doping can also be conducted by performing nucleation, physical ripening or grain formation in the presence of a Group 8 metal compound.

A method of preparing a silver halide emulsion, in which fine silver halide grains including a Group 8 metal compound are added during grain formation can be referred to a method described in JP-A Nos. 11-212201 and 2000-89403.

Silver halide grain emulsions relating are preferably sensitized with selenium sensitizers.

Labile selenium compounds capable of forming silver selenide upon reaction with aqueous silver nitrate are used as a selenium sensitizer. Examples thereof are described in U.S. Pat. Nos. 1,574,944, 1,602,592 and 1,623,499; JP-A Nos. 60-150046, 4-25832, 4-109240 and 4-147250.

Examples of useful selenium sensitizers include colloidal selenium, isoselenocyanates (e.g., allyl isoselenocyanate), selenoureas (e.g., N,N-dimethylselenourea, N,N,N'-triethylselenourea, N,N,N',N'-tetramethylselenourea, N,N,N'-trimethyl-N'-heptafluoropropylselenourea, N,N'-dimethyl-N,N'-bis(carboxymethyl)selenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid, methyl-3-selenobutylate), selenophosphates (e.g., tri-p-triselenophosphate, pentafluorophenyl-diphenylselenophosphate), and selenides (e.g., dimethylselenide, tributylphosphine selenide, triphenylphosphine selenide, tri-p-tolylphosphine selenide, pentafluorophenyl-diphenylphosphine selenide, trifurylphosphine selenide, tripyridylphosphine selenide). Of these, selenium sensitizers, selenoureas, selenoamides and selenides are preferred.

Specific examples of technique for using selenium sensitizers are described in U.S. Pat. Nos. 1,574,944, 1,602,592, 1,623,499, 3,297,466, 3,297,447, 3,320,069, 3,408,196, 3,408,197, 3,442,653, 3,420,670, and 3,591,385; French Patent Nos. 2,693,038 and 2,093,209; JP-B Nos. 52-34491, 52-34492, 53-295 and 57-22090; JP-A Nos. 59-180536, 59-185330, 59-181337, 59-187338, 59-192241, 60-150046, 60-151637, 61-246738, 3-4221, 3-24537, 3-111838, 3-116132, 3-148648, 3-237450, 4-16838, 4-25832, 4-32831, 4-33043, 4-96059, 4-109240, 4-140738, 4-140739, 4-147250, 4-184331, 4-190225, 4-191729, 4-195035, 5-11385, 5-40324, 5-24332, 5-24333, 5-303157, 5-306268, 6-306269, 6-27573, 6-75328, 6-175259, 6-208184, 6-208186, 6-317867, 7-92599, 7-98483, 7-104415, 7-140579, 7-301879, 7-301880, 8-114882, 9-19760, 9-138475, 9-166941, 9-138375, 9-189979, 10-10666 and 2001-343721; British Patent Nos. 255,846 and 861,984; and H. E. Spencer, Journal of Photographic Science, 31, 158-169 (1983).

A selenium sensitizer is added preferably in an amount of $1\times10^{-9}$ to $1\times10^{-5}$ mol per mol of silver halide, and more preferably $1\times10^{-8}$ to $1\times10^{-2}$ mol.

Selenium sensitizers are added to a silver halide emulsion in such a manner that additives are usually incorporated to photographic emulsion. For example, a water-soluble compound is dissolved in water and a water-insoluble or sparingly water-soluble compound is dissolved in a water-miscible solvent exhibiting no adverse effect on photographic characteristics, such as alcohols, glycols, ketones, esters, and amides, and they are added in the form of solution.

Sulfur sensitizers may be used in combination with selenium sensitizers. Specific examples of preferred sulfur sensitizers include thiourea derivatives such as 1,3-diphenylthiourea, triethylthiourea and 1-ethyl-3-(2-thiazolyl)thiourea; rhodanine derivatives, dithiocarbamic acids, polysulfide organic compounds, thiosulfates, and simple substance of sulfur. Of simple substance of sulfur, rhombic α-sulfur is preferred. There are also usable sulfur sensitizers described in U.S. Pat. Nos. 1,574,944, 2,410,689, 2,278,947, 2,728,668, 3,501,313, and 3,656,955; West German Patent No. 1,422,869; JP-A Nos. 56-24937, 55-45016 and 1-227140.

There may be simultaneously used noble metal salts such as gold, platinum, palladium and iridium described in Research. Disclosure (hereinafter, also denoted simply as RD) 307105 vol. 307. Of these, the use of a gold sensitizer is specifically preferred. Examples of useful gold sensitizers include chloroauric acid, gold thiosulfate, gold thiocyanic acid and organic gold compounds described in U.S. Pat. Nos. 2,597,856 and 5,049,485; JP-B No. 44-15748 and JP-A Nos. 1-147537 and 4-70650. When performing sensitization by using a gold complex, ligands for gold, such as a thiosulfate, thiocyanate, and thioether are preferably used as an auxiliary agent and the use of a thiocyanate is specifically preferred.

The addition amount of a sulfur sensitizer or a gold sensitizer, depending on the kind of a silver halide grain emulsion, the kind of a used compound and ripening conditions, is preferably $1\times10^{-9}$ to $1\times10^{-5}$ mol per mol of silver halide, and more preferably $1\times10^{-8}$ to $1\times10^{-4}$ mol.

Each of sensitizes described above may be added in accordance with properties of a sensitizer, for example, by solution in water or organic solvents such as methanol, by a mixture with a gelatin solution or by a method described in JP-A No. 4-140739, i.e., addition in the form of emulsified dispersion of a solution mixed with a polymer soluble in an organic solvent.

Reduction sensitizers may be further used and reducing compounds described in RD vol. 307, 307105 and JP-A No. 7-78685 are usable.

Specific examples thereof include aminoiminomethanesulfinic acid (thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g.; ascorbic acid), sodium sulfite, aldehyde compounds and hydrogen gas. Further, reduction sensitization may be conducted at a relatively high pH or in an atmosphere of excessive silver ions, as described in Japanese Patent Application Nos. 8-277938, 8-251486 and 8-182035.

The silver halide emulsion as claimed in claim 1 is characterized by that the silver halide grains are sensitized by at least one selenium compound represented by formula (S).

Compound represented by formula (S) is described.

In the formula (S), examples of the 5-membered ring containing Q include an imidazole ring, tetrazole ring, thiazole ring, oxazole ring, selenazole ring, benzimiazole ring, naphthoimidazole ring, benzothiazole ring, naphthothiazole ring, benzoselenazole ring, naphthoselenazole ring, and benzoxazole ring. Examples of the 6-membered ring containing Q include a pyridine ring, pyrimidine ring and quinoline ring. The 5-membered or 6-membered heterocyclic ring may be substituted.

Alkali metal atom represented by M include, for example, sodium atom and potassium atom.

The compound represented by the foregoing formula (S) is preferably mercapto compounds represented by the following formula (S-1), (S-2), (S-3) or (S-4). S-2 is described previously.

formula (S-1)

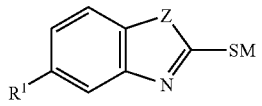

wherein $R^1$ is a hydrogen atom, an alkyl group, an alkoxy group, an aryl group, a halogen atom, a carboxyl group or its salt, a sulfo group or its salt or an amino group; Z is —NH—, —O— or —S—; and M is the same as defined in the foregoing formula (S);

In the foregoing formulas (S-1) and (S-2), the alkyl group represented by $R^1$ and $R^2$ includes, for example, methyl, ethyl and butyl; the alkoxy group includes methoxy and ethoxy, salts of the carboxy or sulfo group includes sodium and ammonium salts.

In formula (S-1), the aryl group represented by $R^1$ includes, for example, phenyl and naphthyl, and the halogen atom includes, for example, chlorine atom and bromine atom.

In formula (S-2), the acylamino group represented by $R^2$ includes, for example, methylcarbonylamino and benzoylamino; the carbamoyl group includes, for example, ethylcarbamoyl and phenylcarbamoyl; and the sulfonamido group includes, for example, methylsulfonamido and phenylsulfonamido. The foregoing alkyl, alkoxy, aryl, amino, acylamino, carbamoyl and sulfonamido groups may be substituted with substituents.

Each group of alkyl, alkoxy, aryl, amino, acylamino, carbamoyl and sulfonamide may have a substituent.

formula (S-3)

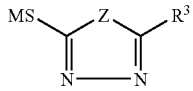

wherein Z is —$NR^3$—, an oxygen atom or a sulfur atom, in which $R^3$ is a hydrogen atom, alkyl group, aryl group, alkenyl group, cycloalkyl group, —$SR^{31}$, —$NR^{32}(R^{33})$—, —$NHCOR^{34}$, —$NHSO_2R^{35}$ or a heterocyclic group, in which $R^{31}$ is a hydrogen atom, alkyl group, alkenyl group, cycloalkyl group, aryl group —$COR^{34}$, or —$SO_2R^{35}$, $R^{32}$ and $R^{33}$ are each a hydrogen atom, alkyl group or aryl group, $R^{34}$ and $R^{35}$ are each an alkyl group or aryl group; M is the same as defined in formula (S).

In the foregoing formula (S-3), the alkyl group represented by $R^3$, $R^{31}$, $R^{32}$, $R^{33}$, $R^{34}$ and $R^{35}$ includes, for example, methyl, benzyl, ethyl and propyl; and the aryl group includes, for example, phenyl and naphthyl.

The alkenyl group represented by $R^3$ and $R^{31}$ includes, for example, propenyl; the cycloalkyl group includes, for example, cyclohexyl. The heterocyclic group represented by $R^3$ includes, for example, furyl and pyridinyl.

The foregoing alkyl or aryl group represented by $R^3$, $R^{31}$, $R^{32}$, $R^{33}$, $R^{34}$ and $R^{35}$, the alkenyl or cycloalkyl group represented by $R^3$ and $R^{31}$ and the heterocyclic group represented by $R^3$ each may be substituted with substituents.

formula (S-4)

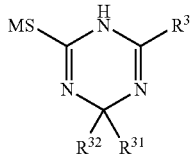

wherein $R^3$ and $M^1$ are each the same as defined in the foregoing formula (S-3); $R^{31}$ and $R^{32}$ are each the same as defined in the foregoing formula (S-3).

Specific examples of the compound represented by formula (S) are shown below but are by no means limited to these.

S-1-1

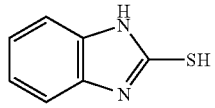

S-1-2

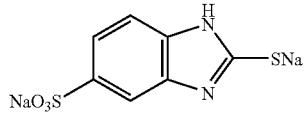

S-1-3

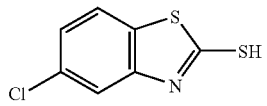

-continued
S-1-4
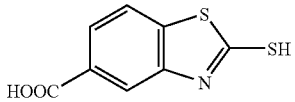
S-1-5
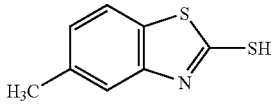
S-1-6
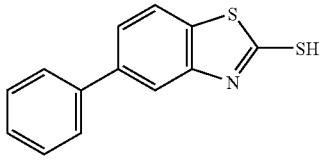
S-1-7
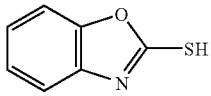
S-1-8
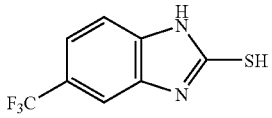
S-2-1
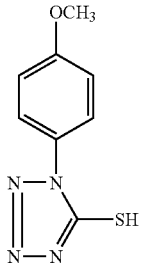
S-2-2
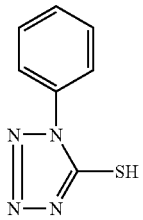
S-2-3
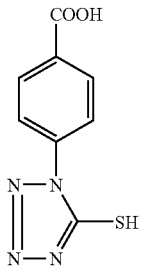

-continued
S-2-4
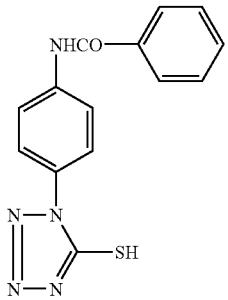
S-2-5
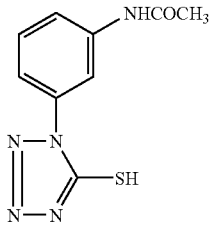
S-2-6
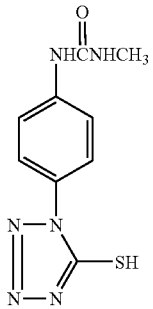
S-2-7
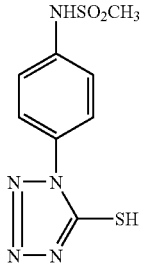
S-2-8
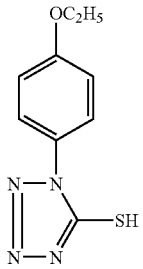
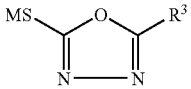
| Compound | $R^3$ | M |
|---|---|---|
| S-3-1 | $—C_2H_5$ | —H |
| S-3-2 | $—CH_2—CH=CH_2$ | —H |

-continued
| | | |
|---|---|---|
| S-3-3 | —CH═CH—$CH_2$—$CH_3$ | —H |
| S-3-4 | —$C_7H_{15}$ | —H |
| S-3-5 | —$C_9H_{19}$ | —Na |
| S-3-6 | 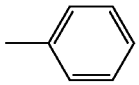 | —H |
| S-3-7 | —$C_4H_9$(t) | —H |
| S-3-8 | 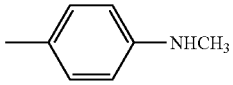 | —H |
| S-3-9 | 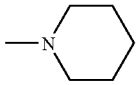 | —H |
| S-3-10 | 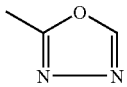 | —H |
| S-3-11 | 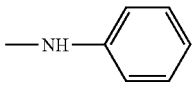 | —H |
| S-3-12 | 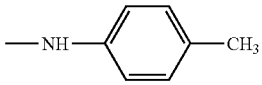 | —H |
| S-3-13 | —$NHCOCH_3$ | —H |
| S-3-14 | 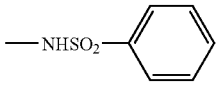 | —H |
| S-3-15 | —$N(CH_3)_2$ | —H |
| S-3-16 | 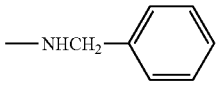 | —H |
| S-3-17 | 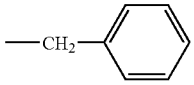 | —H |
| S-3-18 | —S—$CH_3$ | —H |
| S-3-19 | 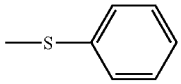 | —H |
| S-3-20 | —SH | —H |
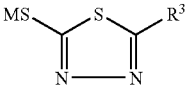
| Compound | $R^3$ | M |
|---|---|---|
| S-3-21 | —H | —H |
| S-3-22 | —$C_2H_5$ | —H |
| S-3-23 | —$C_4H_9$(t) | —H |
| S-3-24 | —$C_6H_{13}$ | —H |
| S-3-25 | 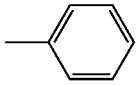 | —H |
| S-3-26 | 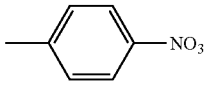 | —H |
| S-3-27 | 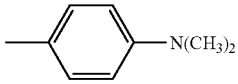 | —H |

-continued
| | | |
|---|---|---|
| S-3-28 | 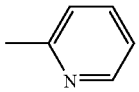 | —H |
| S-3-29 | 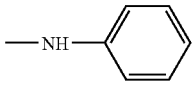 | —H |
| S-3-30 | —NH—$N(CH_3)_2$ | —H |
| S-3-31 | —$CH_2CH$=$CH_2$ | —H |
| S-3-32 | —SH | —H |
| S-3-33 | —$NHCOC_2H_5$ | —H |
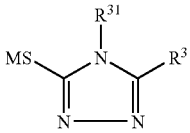
| Compound | $R^3$ | $R^{31}$ | M |
|---|---|---|---|
| S-3-34 | —$C_2H_5$ | —H | —H |
| S-3-35 | —$CH_3$ | —$CH_3$ | —H |
| S-3-36 | —$CH_3$ | 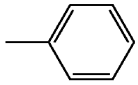 | —H |
| S-3-37 | —$NHCOCH_3$ | —$CH_3$ | —H |
| S-3-38 | 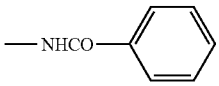 | 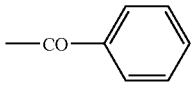 | —H |
| S-3-39 | —$NHCOCH_3$ | —$COCH_3$ | —H |
| S-3-40 | —$NHCOCH_3$ | 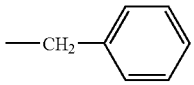 | —H |
| S-3-41 | —$NHCOC_2H_5$ | 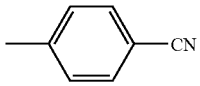 | Na |
| S-3-42 | 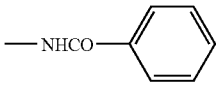 | 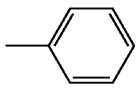 | H |
| S-3-43 | —$NHSO_2CH_3$ | —H | H |
| S-3-44 | 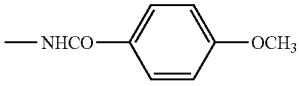 | —$CH_3$ | Na |
| S-3-45 | 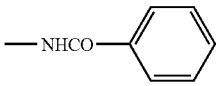 | —$CH_2CH$=$CH_2$ | H |
| S-3-46 | 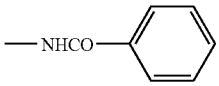 | 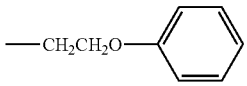 | —H |

-continued

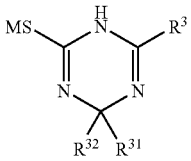

| | $R^3$ | $R^{31}$ | $R^{32}$ | M |
|---|---|---|---|---|
| S-4-1 | $—C_2H_5$ | $—CH_3$ | $—CH_3$ | —H |
| S-4-2 | 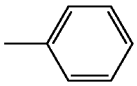 | $—CH_3$ | $—CH_3$ | —H |
| S-4-3 | $—NH_2$ | —H | 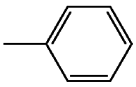 | —H |
| S-4-4 | 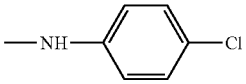 | —H | $—C_4H_9$ | —H |
| S-4-5 | $—NHCOCH_3$ | $—CH_3$ | $—CH_3$ | —H |
| S-4-6 | 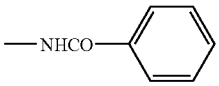 | $—CH_3$ | $—CH_3$ | —H |
| S-4-7 | 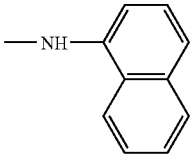 | $—CH_3$ | $—C_3H_7(i)$ | —H |
| S-4-8 | 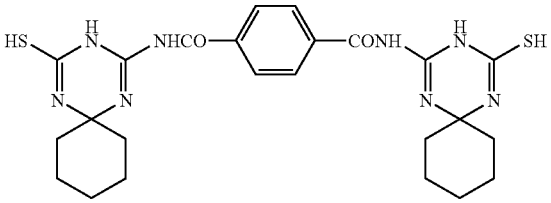 | | | |

The compounds represented by formula (S) include compounds described, for example, in JP-B No. 40-28496, JP-A 50-89034; J. Chem. Soc. 49, 1748 (1927), ibid 4237 (1952); J. Org. Chem. 39, 2469 (1965); U.S. Pat. No. 2,824,001; J. Chem. Soc. 1723 (1951); JP-A No. 56-111846; U.S. Pat. Nos. 1,275,701, 3,266,897, 2,403,927, and can be synthesized in accordance with the synthesis described in the foregoing literature.

To allow the compound represented by formula (S), which is hereinafter also denoted simply as a compound (S), to be included in a silver halide emulsion layer relating to this invention, the compound (S) is incorporated through solution in water or water-miscible organic solvents (e.g., methanol, ethanol). The compound (S) may be used alone or in combination with another compound represented by formula (S), or a stabilizer or antifoggant other than the compounds represented by formula (S).

The compound (S) are each added preferably in an amount of $1\times10^{-8}$ to 1 mol/mol·AgX, and more preferably $1\times10^{-7}$ to $1\times10^{-1}$ mol/mol·AgX.

Addition of the compounds represented by formulas (1) through (4) and the compound (S) to a silver halide emulsion can be conducted by applying methods which have been used in the art to incorporate additives to photographic emulsions. For example, a water-soluble compound is dissolved in water to form an aqueous solution at an optimum concentration, and a water-insoluble or sparingly water-soluble compounds are incorporated through solution in water-miscible organic solvents which have no adverse effect on photographic characteristics, e.g., alcohols, glycols, ketones, esters and amides.

So long as selenium sensitization is performed in the presence of the compound represented by formula (S), the time of adding these compounds is not specifically limited and preferably at any time between before starting the addition of chemical sensitizers and completion of chemical sensitization. It is more preferred that at least one of the compounds represented by formula (S) is allowed to be present in a silver halide emulsion before addition of a selenium sensitizer. When a noble metal sensitizer such as gold or a sulfur sensitizer is used together with selenium sensitizer, it is more preferred that the compound is allowed to be present before adding the chemical sensitizers.

At least one compound represented by the following formula (1) to (4) is contained in the silver halide grain of the silver halide emulsion according to the present invention as claimed in claim 2

$$R—SO_2S\text{-}M \qquad \text{formula (1)}$$

$$R_1—SO_2S—R_2 \qquad \text{formula (2)}$$

$$R_3—SO_2S\text{-}L_m\text{-}SSO_2—R_4 \qquad \text{formula (3)}$$

wherein R, $R_1$, $R_2$, $R_3$, and $R_4$ are each an aliphatic group, an aromatic group or a heterocyclic group; M is a cation; L is a divalent linkage group; and m is 0 or 1.

In formulas (1) to (3), aliphatic groups represented by R, and $R_1$ through $R_4$ are each a saturated or unsaturated, straight chain, branched or cyclic aliphatic hydrocarbon group, and preferably an alkyl group having 1 to 22 carbon atoms, or an alkenyl or alkynyl group having 2 to 22 carbon atoms.

Specific examples of the alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl; examples of the alkenyl group include allyl and butenyl; and examples of the alkynyl group include propargyl.

Aromatic groups represented by R, and $R_1$ through $R_4$ include monocyclic and condensed ring aromatic groups. Preferred aromatic groups are those having 6 to 20 carbon atoms, such as phenyl and naphthyl.

Heterocyclic groups represented by R, and $R_1$ through $R_4$ include monocyclic and condensed ring ones, which are groups derived from 3- to 10-membered heterocycles containing at least one atom selected from nitrogen atom, oxygen atom, sulfur atom, selenium atom tellurium atom and at least one carbon atom. Examples thereof include a pyrrolidine ring group, piperidine ring group, pyridine ring group, tetrahydrofuran ring group, thiophene ring group, oxazole ring group, thiazole ring group, imidazole ring group, benzothiazole ring group, benzoxazole ring group, benzimidazole ring group, selenazole ring group, benzoselenazole ring group, tetrazole ring group, triazole ring group, benzotriazole ring group, oxadiazole ring group and thiadiazole ring group.

The foregoing aliphatic group, aromatic group and heterocyclic group represented by R, and $R_1$ through $R_4$ may further be substituted. Specific examples of substituents include an alkyl group (e.g., methyl, ethyl, hexyl), alkoxy group (e.g., methoxy, ethoxy, octyloxy), aryl group (e.g., phenyl, naphthyl, tolyl), hydroxy group, halogen atom (e.g., fluorine atom, chlorine atom, bromine atom, iodine atom), aryloxy group (e.g., phenoxy), alkylthio group (e.g., methylthio, butylthio), arylthio group (e.g., phenylthio), acyl group (e.g., acetyl, propionyl, butylyl, valeryl), sulfonyl group (methylsulfinyl, phenylsulffonyl), acylamino group (e.g., acetylamino, benzoylamino), sulfonylamino group (e.g., methanesulfonylamino, benzenesulfonylamino), acyloxy group (e.g., acetoxy group, benzoxy group), carboxyl group, cyano group, sulfo group, amino group, —$SO_2SM$, and aliphatic, aromatic and heterocyclic groups represented by the foregoing R, and $R_1$ through $R_4$.

Divalent linkage group represented by L is an atom selected from carbon atom, nitrogen atom, sulfur atom and oxygen atom or an atomic group containing at least one atom selected from the foregoing atoms. Specific examples thereof include an alkylene group, alkenylene group, alkynylene group, arylene group, —O—, —S—, —NH—, —CO—, —$SO_2$— and their combinations.

The divalent linkage group represented by L is preferably a divalent aliphatic or aromatic group, such as —$(CH_2)_n$— (in which n is 1-12), —$CH_2$—CH═CH—$CH_2$—, —$CH_2$—C≡C—$CH_2$—, xylene group, phenylene group, naphthylene group, and

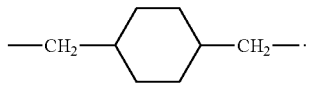

The divalent linkage group represented by L may be substituted by the substituent described above.

M is a cation, and preferably a metal ion, ammonium ion or an organic cation. Examples of a metal ion include lithium ion, sodium ion and potassium ion. Examples of an organic ion include an alkylammonium ion (e.g., tetramethylammonium, tetrabutylammonium), phosphonium ion (e.g., tetraphenylphosphonium) and guanidyl group.

The compound represented by the foregoing formula (1) to (3) may be included in a polymer, as a component element of the polymer. Thus, in cases where the compound represented by formula (1) to (3) is included in a polymer, repeating units forming the polymer are, for examples, as follows.

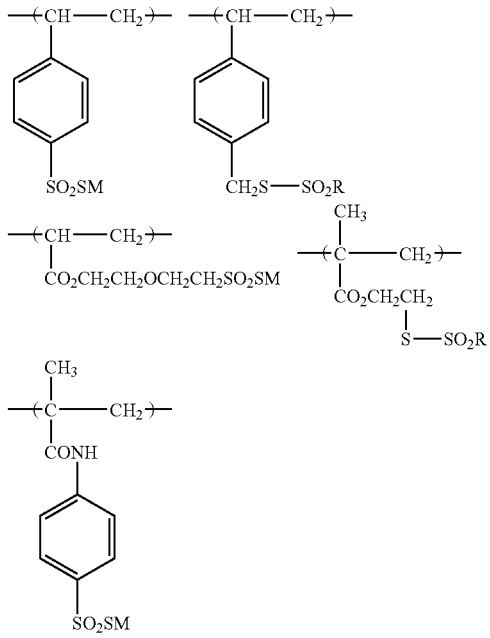

A polymer containing the foregoing repeating unit may be a homopolymer or may form its copolymer with other polymer(s).

Specific examples of the compound represented by formula (1) to (3) and specific examples of a polymer containing a compound represented by formula (1) to (3) as a component element of the polymer are shown below but are by no means limited to these.

(1-1) $CH_3SO_2SNa$
(1-2) $C_2H_5SO_2SNa$
(1-3) $C_2H_5SO_2SK$
(1-4) $C_4H_9SO_2SLi$
(1-5) $C_6H_{13}SO_2SNa$
(1-6) $C_8H_{17}SO_2SNa$
(1-7) $CH_3(CH_2)_3-CH(C_2H_5)CH_2SO_2S\cdot NH_4$
(1-8) $C_{10}H_{21}SO_2SNa$
(1-9) $C_{12}H_{25}SO_2SNa$
(1-10) $C_{16}H_{33}SO_2SNa$
(1-11) $(CH_3)_2CH-SO_2SK$
(1-12) $(t)C_4H_9SO_2SNa$
(1-13) $CH_3OCH_2CH_2SO_2S\cdot Na$
(1-14) 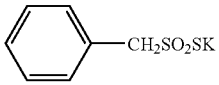
(1-15) $CH_2{=}CHCH_2SO_2SNa$
(1-16) 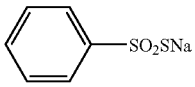
(1-17) 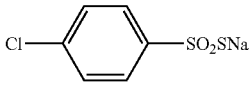
(1-18) 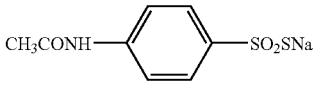
(1-19) 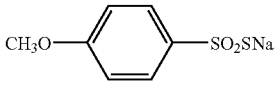
(1-20) 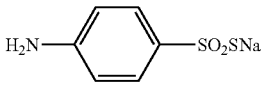
(1-21) 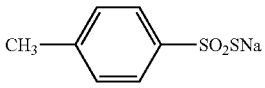
(1-22) 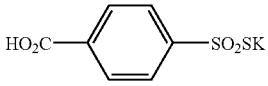
(1-23) 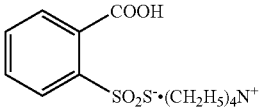
-continued
(1-24) 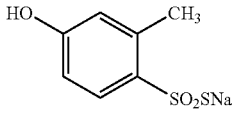
(1-25) 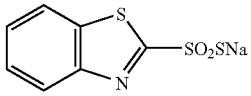
(1-26) 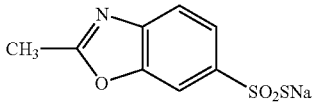
(1-27) 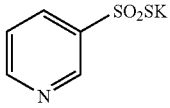
(1-28) 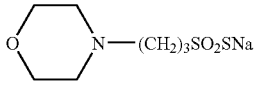
(1-29) $KSSO_2(CH_2)_3SO_2SK$
(1-30) $NaSSO_2(CH_2)_4SO_2SNa$
(1-31) $NaSSO_2(CH_2)_4S(CH_2)_4SO_2SNa$
(1-32) 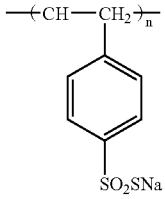
(1-33) 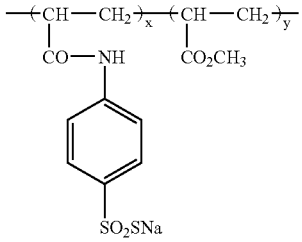
x:y = 1:1 (molar ratio)
(1-34) 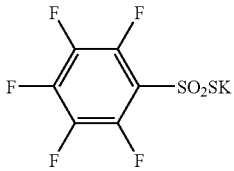
(1-35) 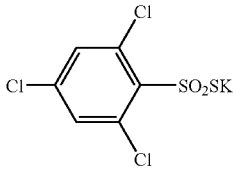
(2-1) $C_2H_5SO_2S-CH_3$
(2-2) $C_8H_{17}SO_2SCH_2CH_3$ -continued
(2-3)
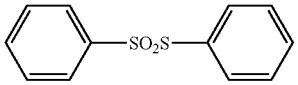
(2-4)
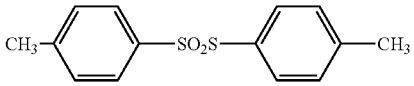
(2-5)
$C_2H_5SO_2SCH_2CH_2CN$
(2-6)
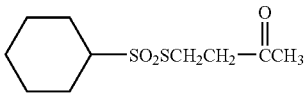
(2-7)
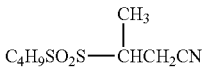
(2-8)
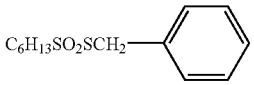
(2-9)
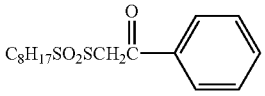
(2-10)
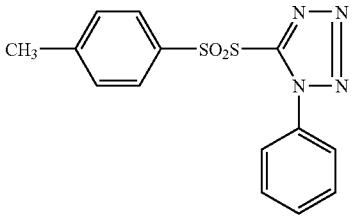
(2-11)
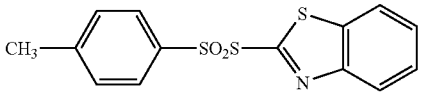
(2-12)
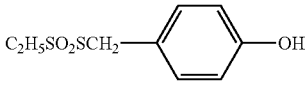
(2-13)
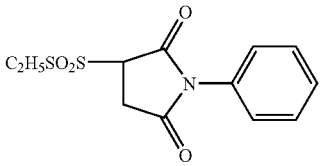
(2-14)
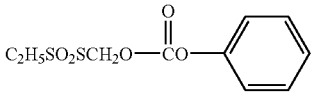
(2-15)
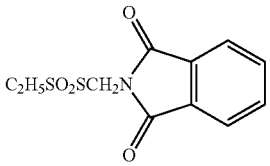
(2-16)
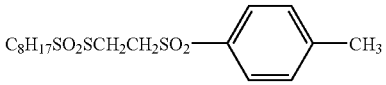
-continued
(2-17)
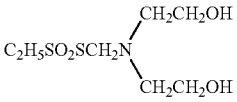
(2-18)
$C_2H_5SO_2SCH_2CH_2CH_2CH_2OH$
(2-19)
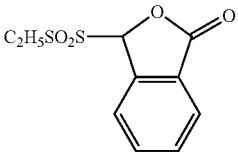
(2-20)
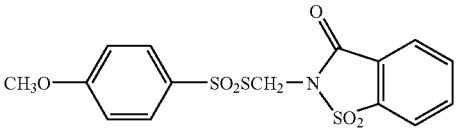
(2-21)
$CH_3SSO_2(CH_2)_4SO_2SCH_3$
(2-22)
$CH_3SSO_2(CH_2)_8SO_2SCH_3$
(2-23)
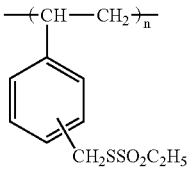
(2-24)
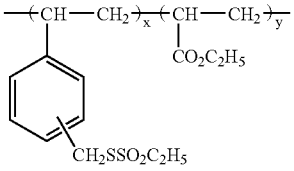
x:y = 2:1 (molar ratio)
(2-25)
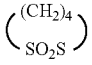
(3-1)
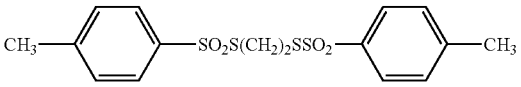
(3-2)
$C_2H_5SO_2SCH_2CH_2SO_2CH_2CH_2SSO_2C_2H_5$
(3-3)
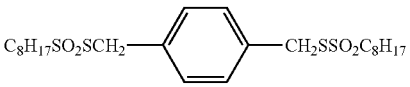
(3-4)
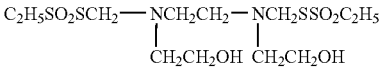
(3-5)
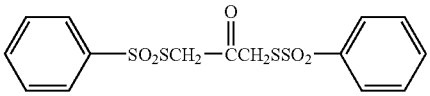
(3-6)
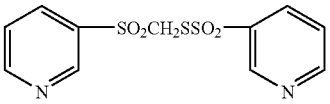
(3-7)
$C_2H_5SO_2SSSO_2C_2H_5$ -continued (3-8)

$(n)C_3H_7SO_2SSSO_2C_3H_7(n)$ (3-9)

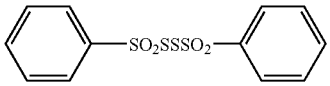

The silver halide emulsion according to the present invention is characterized in that the silver halide grains contain at least one compound represented by formula (4).

$$R_1—(S)_m—R_2 \qquad \text{Formula (4)}$$

wherein $R_1$ and $R_2$ are each an aliphatic group, an aromatic group or a heterocyclic group, or an atomic group forming a ring by bonding. $R_1$ and $R_2$ may be same or different. $R_1$ and $R_2$ combine with each other to form a ring when they are aliphatic groups; m1 is an integer of 2 to 6.

In formula (4), aliphatic groups represented by $R_{11}$ and $R_{12}$ include straight chain or branched alkyl, alkenyl or alkynyl group having 1 to 30 carbon atoms (preferably 1 to 20 carbon atoms) and a cycloalkyl group. Specific examples thereof include methyl, ethyl, propyl, butyl, hexyl, decyl, dodecyl, isopropyl, t-butyl, 2-ethylhexyl, allyl, 2-butenyl, 7-octenyl, propargyl, 2-butynyl, cyclopropyl, cyclopentyl, cyclohexyl and cyclododecyl. Aromatic groups represented by $R_{11}$ and $R_{12}$ include ones having 6 to 20 carbon atoms, such as phenyl, naphthyl and anthranyl. Heterocyclic groups represented by $R_{11}$ and $R_{12}$ may be a monocyclic one or a condensed ring one, including, for example, 5- or 6-membered heterocyclic group containing at least one of O, S and N atoms and amineoxide group within the ring.

Specific examples of the heterocyclic group include groups derived from pyrrolidine, piperidine, tetrahydrofuran, tetrahydropyrane, oxirane, morpholine, thiomorpholine, thiopyrane, tetrahydrothiopyrane, pyrrole, pyridine, furan, thiophene, imidazole, pyrazole, oxazole, thiazole, isooxazole, isothiazole, triazole, tetrazole, thiadiazole, oxadiazole and their benzenelogs. Rings formed by $R_{11}$ and $R_{12}$ include 4- to 7-membered rings and 5- to 7-membered rings are preferred.

$R_{11}$ and $R_{12}$ are preferably a heterocyclic group or aromatic group, and more preferably a heterocyclic group. The foregoing aliphatic, aromatic and heterocyclic groups represented by $R_{11}$ and $R_{12}$ may be substituted by a substituent. Specific examples of such a substituent include a halogen atom (e.g., chlorine atom, bromine atom), alkyl group (e.g., methyl, ethyl, propyl, hydroxyethyl, methoxymethyl, trifluoromethyl, t-butyl), cycloalkyl group, (e.g., cyclopentyl, cyclohexyl9, aralkyl group (e.g., benzyl, 2-phenethyl), aryl group (e.g., phenyl, naphthyl, p-tolyl, p-chlorophenyl), alkoxy group (e.g., methoxy, ethoxy, isopropoxy, butoxy), aryloxy group (e.g., phenoxy, 4-methoxyphenoxy), cyano group, acylamino group (e.g., acetylamino, propionylamino), alkylthio group (e.g., methylthio, ethylthio, butylthio), arylthio group (e.g., phenylthio, p-methylphenylthio), sulfonylamino group (e.g., methanesulfonylamino, benzenesulfonylamino), ureido group (e.g., 3-methylureido, 3,3-dimethylureido, 1,3-dimethylureido), sulfamoylamino (e.g., dimethylsulfamoylamino, diethylsulfamoylamino), carbamoyl group (e.g., methylcarbamoyl, ethylcarbamoyl, dimethylcarbamoyl), sulfamoyl group (e.g., ethylsulfamoyl, dimethylsulfamoyl), alkoxycarbonyl group (e.g., methoxycarbonyl, ethoxycarbonyl), aryloxycarbonyl group (e.g., phenoxycarbonyl, p-chlorophenoxycarbonyl), sulfonyl group (e.g., methanesulfonyl, butanesulfonyl, phenylsulfonyl), acyl group (e.g., acetyl, propanoyl, butyloyl), amino group (e.g., methylamino, etylamino, dimethylamino), hydroxy group, nitro group, nitroso group, amineoxide group (e.g., pyridine•oxide), imido group (e.g., phthalimido), and disulfide group (e.g., benzenesulfide, benzthiazolyl-2-disulfide).

Specific examples of the compound represented by formula (4) are shown below but are not limited to these.

4-0

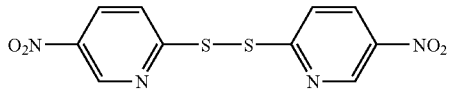

4-1

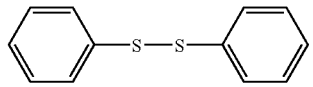

4-2

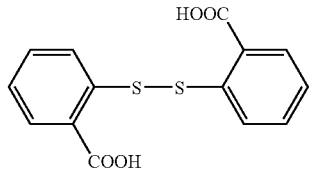

4-3

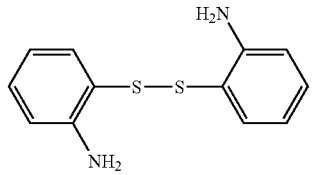

4-4

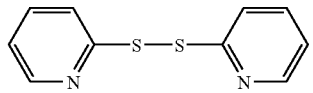

4-5

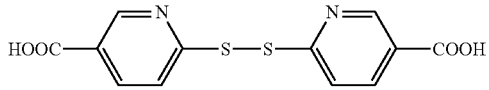

4-6

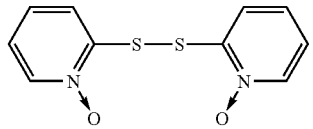

4-7

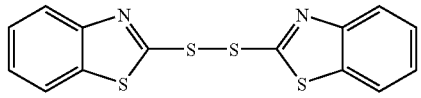

4-8

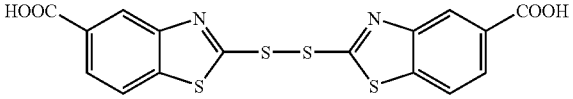

4-9

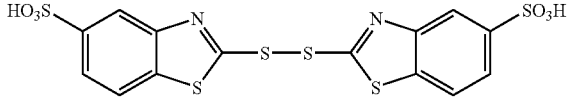

-continued
4-10
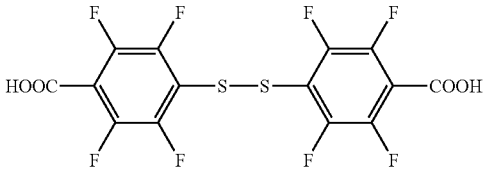
4-11
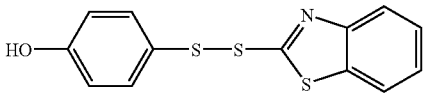
4-12
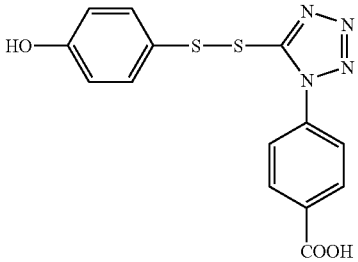
4-13
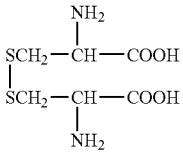
4-14
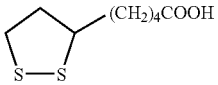
4-15
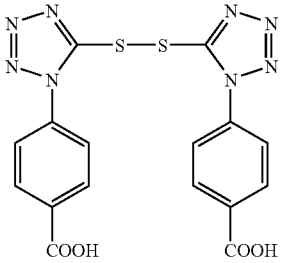
4-16
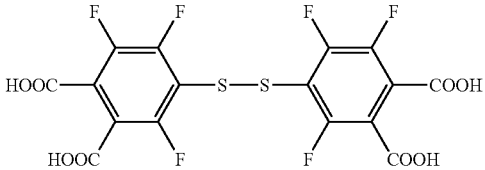
4-17
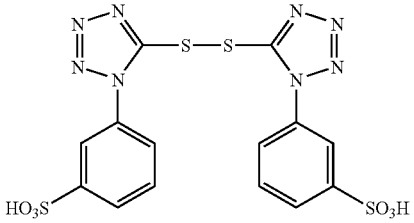
-continued
4-18
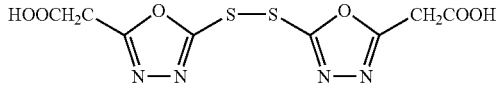
4-19
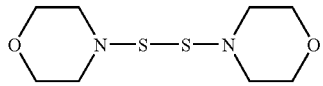
4-20
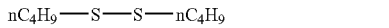
4-21
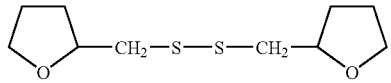
4-22
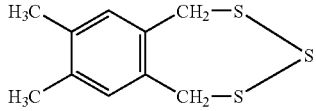
4-23
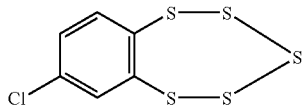
4-24
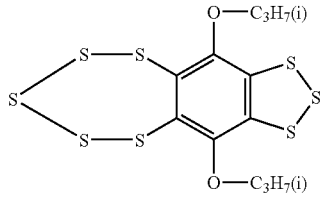
4-25
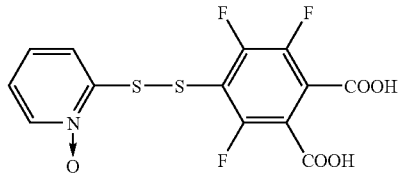
4-26
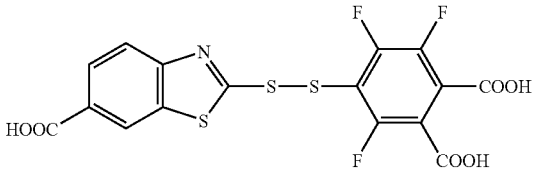
4-27
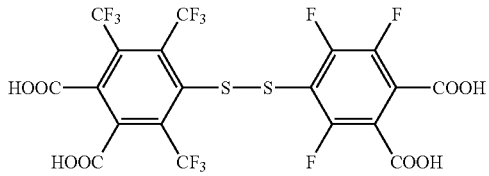

-continued 4-28

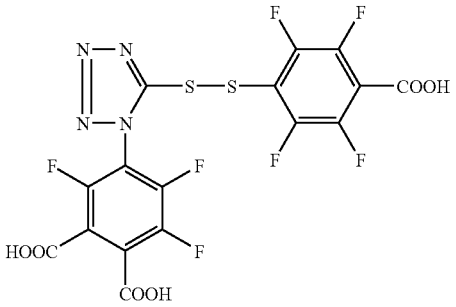

4-29

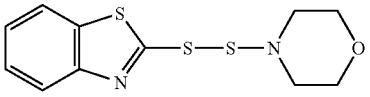

4-30

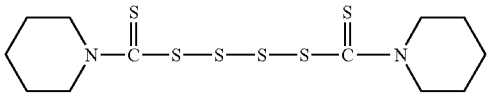

Disulfide compounds described in JP-A No. 2002-148750 may be preferably employed in addition to the compounds described above.

Preferable amount of the compounds represented by the formulas (1) to (4) to be added is $1\times10^{-8}$-$1\times10^{-1}$ mol/mol AgX, more preferably $1\times10^{-7}$-$1\times10^{-2}$ mol/mol AgX.

Addition of the compounds represented by formulas (1) through (4) and the compound (S) to a silver halide emulsion can be conducted by applying methods which have been used in the art to incorporate additives to photographic emulsions. For example, a water-soluble compounds is dissolved in water to form an aqueous solution at an optimum concentration, and a water-insoluble or sparingly water-soluble compounds are incorporated through solution in water-miscible organic solvents which have no adverse effect on photographic characteristics, e.g., alcohols, glycols, ketones, esters and amides.

There is no restriction in adding timing of the compounds represented by the foregoing formulas (1) to (4), however it is preferred to add at any timing from starting addition of a chemical sensitizer to completion of chemical sensitization. One of the preferable embodiment is (a) before addition of the chemical sensitizer and the other is (be) after completing 50% of chemical sensitization and more preferably before completing 70% of chemical sensitization, and further preferably 90% of chemical sensitization total chemical sensitization, and before completing chemical sensitization, and it is particularly preferable to conduct by employing (a) and (b) mentioned above in combination.

The silver halide emulsion as claimed in claim 4 is characterized in that it contains at least one crown ether compound condensed by at least one aromatic ring.

The crown ether compound employed in this invention a crown ether condensed by at least one substituted or non-substituted aromatic ring. Typical one of such the compounds is crown ether which is synthesized in 1967 by C. J. Pedersen. Many compounds have been synthesized because they show unique property as reported by him. Such the compounds are described in detail in C. J. Pedersen, "Journal of American Chemical Society" vol. 86 (2495), 7017-7036 (1967); G. W. Gokel, S. H. Korzeniowski, "Macrocyclic Polyether Synthesis", Springer-Verlag, (1982); Oda, Shono, and Tabuse, "Crown Ether no Kagaku (Chemistry of Crown Ether)", Kagaku Dojin (1978); Tabuse et al., "Host-Guest", Kyoritsu Shuppan (1979); and Sasaki and Koga, "Yuuki Gousei Kagaku (Organic synthesizing Chemistry)", vol. 45(6), 571-582. The 15-18 member crown ether compounds are preferably used in the invention.

Specific examples of the crown compound employed in this invention are shown below but are by no means limited to these.

S-1

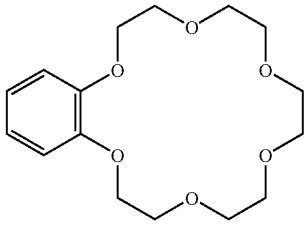

S-2

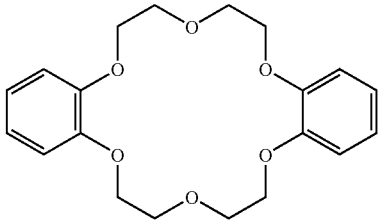

S-3

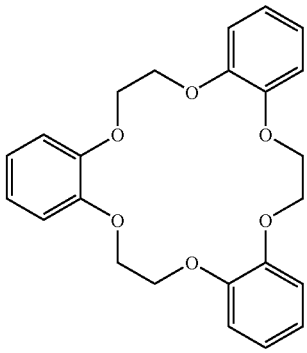

S-4

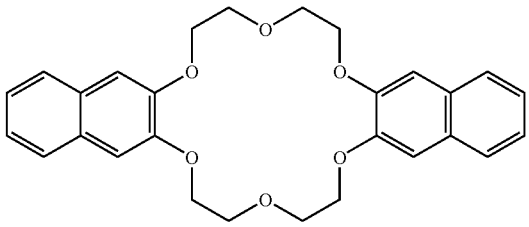

S-5

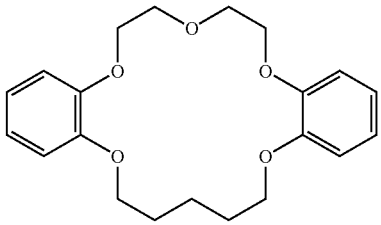

-continued
S-6
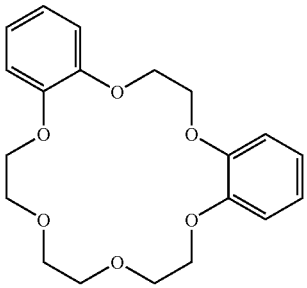
S-7
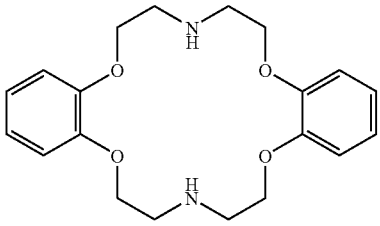
S-8
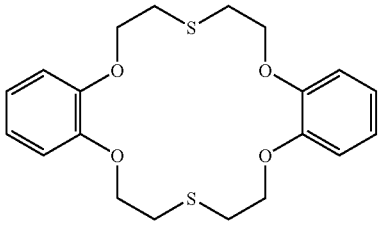
S-9
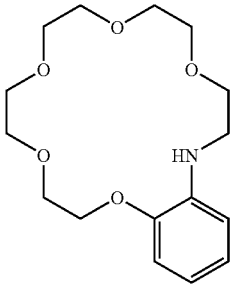
S-10
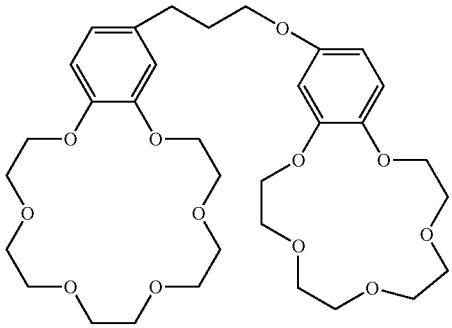
S-11
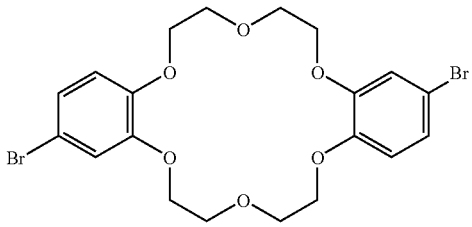
-continued
S-12
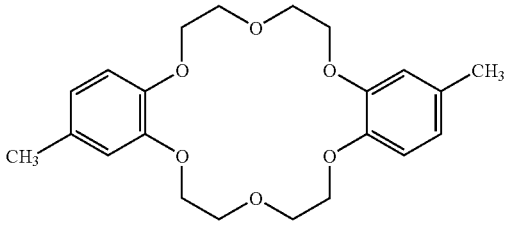
S-13
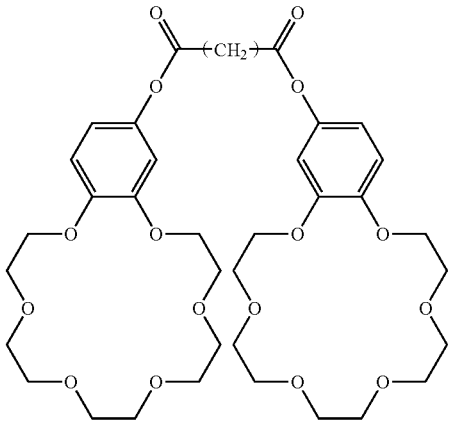
S-14
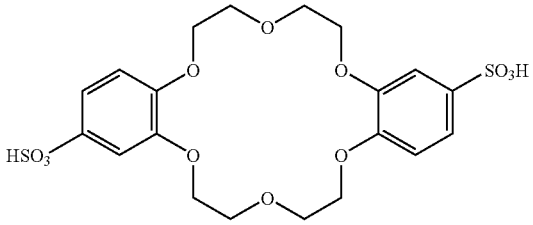
S-15
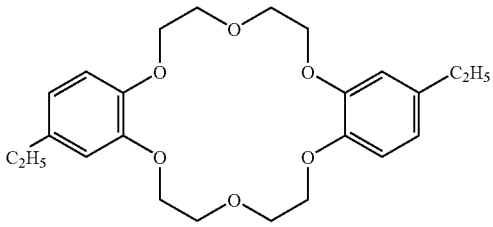
S-16
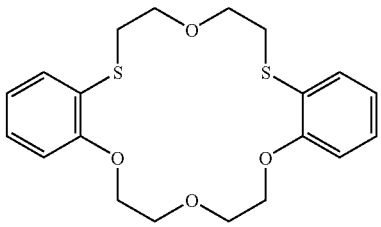

-continued

S-17

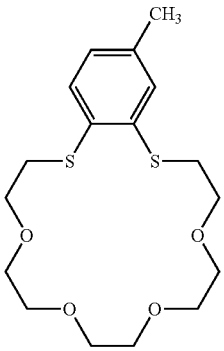

S-18

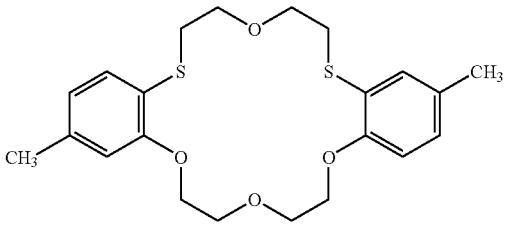

S-19

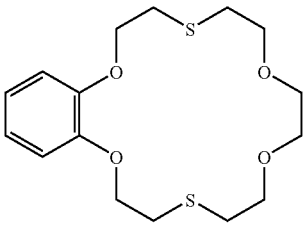

S-20

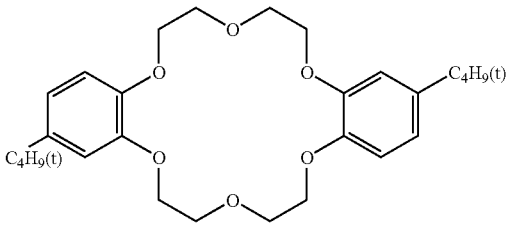

S-21

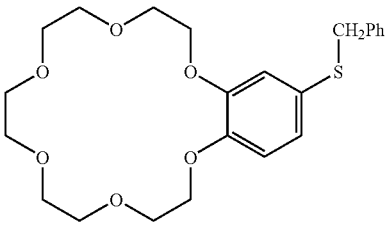

S-22

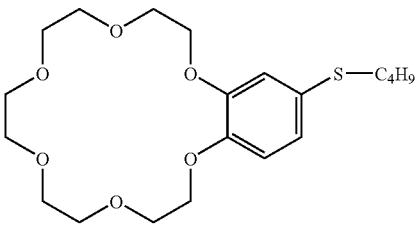

-continued

S-23

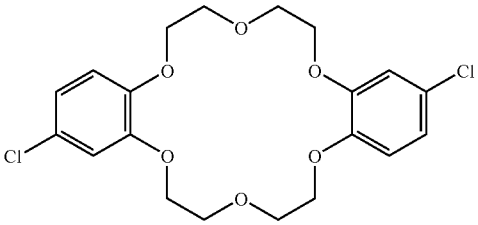

S-24

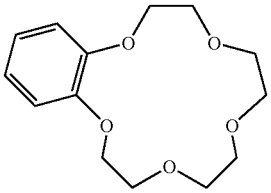

S-25

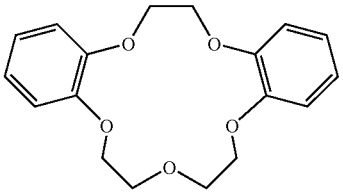

S-26

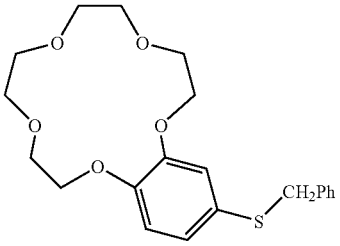

S-27

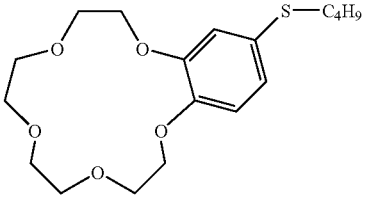

To allow the crown ether compound to be included in a silver halide emulsion layer relating to this invention, the crown ether compound is incorporated through solution in water or water-miscible organic solvents, e.g., methanol, ethanol or fluorinated alcohol. The crown ether compound may be added at any time before the coating of the emulsion, and preferably is added before completion of chemical sensitization.

The crown ether compound is employed as a hyper sensitization with red sensitizing agent, and may be added before the addition of red sensitizing agent or simultaneously, or they may be added as mixture thereof. The crown ether compound of this invention is added preferably in an amount of $1\times10^{-6}$ to $1\times10^{-1}$ mol/mol·AgX, and more preferably $5\times10^{-6}$ to $1\times10^{-2}$ mol/mol·AgX.

The silver halide emulsion according to this invention preferably contains a compound represented by formulas (S) inside of the silver halide grain, and the compound is preferably represented by formulas (S-2).

Inside of the silver halide grain means a silver halide phase excluding the surface of the silver halide grain.

The amount of compound represented by formulas (S) of this invention inside of the silver halide grain is preferably $1\times10^{-8}$ to $1\times10^{-1}$ mol/mol·AgX, and more preferably $1\times10^{-7}$ to $1\times10^{-2}$ mol/mol·AgX.

There may be any number of regions differing in concentration of compound (S) in the interior of the grains and the concentration is not specifically limited so long as intended grains are formed. It is preferred that at least two silver halide phases differing in concentration of compound (S) are in the interior of the grains, and it is more preferred that a silver halide phase having a less concentration of compound (S) than a silver halide phase having a maximum concentration of compound (S) is external to the silver halide phase having a maximum concentration of compound (S). In one preferred embodiment of this invention, for example, the outermost region (shell portion) within the grain has a concentration of compound (S) less than the internal region (core portion). The shell portion refers to the final region in the course of grain formation through grain growth and the outermost region of the grain including the grain surface.

The average concentration of compound (S) in the shell portion is preferably less than $1.5\times10^{-4}$ mol per mol of silver halide. The concentration of compound (S) may be 0 and is preferably 0.1 to $1\times10^{-4}$ mol, and more preferably 0.1 to $0.5\times10^{-4}$ mol per mol of silver halide.

The concentration of compound (S) in the core portion is not specifically limited insofar as it is less than the shell portion, and preferably 0.5 to $3\times10^{-4}$ mol per mol of silver halide.

There may be included plural compounds (S) in combination and plural silver halide phases, or the core portion and the shell portion are different in the kind or combination thereof. The compound (S) may be allowed to be present in a grain forming system using any method and preferably to be contained in a halide solution.

In the silver halide grains relating to this invention, the volume of a shell portion is preferably not more than 50%, and more preferably not more than 30% of the grain volume. In one preferred embodiment, the shell portion accounts for not more than 10% of the grain volume and is located in a sub-surface region near the grain surface.

It is preferred that the silver halide emulsion of this invention includes a gelatin which contains substantially no calcium ion. The gelatin which contains substantially no calcium ion is one having a calcium content of 100 ppm or less, preferably 50 ppm or less, and more preferably 30 ppm or less. A gelatin which contains substantially no calcium ion can be obtained by a cationic deionization process with ion-exchange resins.

A gelatin which contains substantially no calcium ion is preferably used in at least one of the processes of silver halide grain formation, desalting, dispersion, and chemical sensitization and/or spectral sensitization, and more preferably prior to chemical sensitization and/or spectral sensitization. A gelatin which contains substantially no calcium ion preferably accounts for at least 10% by weight of the whole dispersing medium of a prepared silver halide emulsion, more preferably at least 30%, and still more preferably at least 50%.

A chemically modified gelatin of which amino group is substituted is preferably used in the preparation of a silver halide emulsion of this invention to perform the formation and/or desalting of silver halide grains. Examples of such a chemically modified gelatin include modified gelatins described in JP-A Nos. 5-72658, 9-197595 and 9-251193 in which an amino group of gelatin has been substituted. The use of a chemically modified gelatin in the process of grain formation and/or desalting is preferably in an amount of at least 10% by weight of the whole dispersing medium, more preferably at least 30%, and still more preferably at least 50%. The substitution ratio of an amino group is preferably at least 30%, more preferably at least 50%, and still more preferably at least 80%.

Preferably, a silver halide emulsion is desalted after completion of grain formation. Desalting is conducted in such a manner, for example, as described in RD 17643, sect. II.

Specifically, to remove unwanted soluble salts from a precipitation product or a physically ripened emulsion, a noodle washing method may be used, or inorganic salts, anionic surfactants or anionic polymers [e.g., poly(styrene sulfonic acid)] are also usable, but a flocculation method using gelatin derivatives or chemically modified gelatin (e.g., acylated gelatin and carbamoylated gelatin) and a ultrafiltration method employing membrane separation are preferred.

The ultrafiltration method employing membrane separation is referred to "Kagaku Kogaku Binran (Handbook of Chemical Engineering)" 5th ed., page 924-954; RD vol. 102, 10208 and vol. 131, 13122; JP-B Nos. 59-43727 and 62-27008; JP-A Nos. 62-113137, 57-209823, 59-43727, 61-219948, 62-23035, 63-40137, 63-40039, 3-140946, 2-172816, 2-172817 and 4-22942. Ultrafiltration is conducted preferably employing an apparatus or a method described in JP-A Nos. 11-339923 and 11-231448.

Dispersing medium used in the preparation of silver halide emulsions is a compound exhibiting a protective colloid property for silver halide grains. Preferably, the dispersing medium is allowed to exist in the nucleation and growth stages of silver halide grain formation. Preferred dispersing mediums usable in this invention include gelatin and hydrophilic colloids. Preferred examples of gelatin usable in this invention include an alkali process or acid process gelatin having a molecular weight of ca. 100,000, an oxidized gelatin, and enzymatic process gelatin described in Bull. Soc. Sci. Photo. Japan No. 16, page 30 (1966). A gelatin an average molecular weight of 10,000 to 50,000 is preferably used in the nucleation stage of silver halide grains. To reduce the average molecular weight, gelatin is degraded by using a gelatin degradation enzyme or hydrogen peroxide. The use of a gelatin having a relatively low methionine content in the nucleation stage is preferred specifically in the preparation of tabular silver halide grains. The methionine content is preferably not more than 50 μmol per unit weight (g) of dispersing medium, and more preferably not more than 20 μmol. The methionine content can be reduced by subjecting gelatin to an oxidation treatment by using hydrogen peroxide and the like.

Examples of a hydrophilic colloid include gelatin derivatives, a graft polymer of gelatin with other polymers, proteins such as albumin or casein; cellulose derivatives such as hydroxyethyl cellulose, carboxymethyl cellulose, cellulose sulfuric acid esters; saccharide derivatives such as sodium alginate and starch derivatives and synthetic hydrophilic polymeric materials of homopolymers such as polyvinyl alcohol and its partial acetal, poly-N-vinylpyrrolidone, polyacrylic acid, polymethacrylic acid, polyacrylamide, polyvinylimidazole, and polyvinylpyrazole and their copolymers. Examples of usable gelatin usable include an alkali process gelatin, acid process gelatin, an oxidized gelatin, and enzymatic process gelatin described in Bull. Soc. Sci. Photo.

Japan No. 16, page 30 (1966). There are also usable hydrolytic products and enzymatic degradation products of gelatin.

Silver halide grains relating to the invention may be of any form so long as having a high chloride composition. One of preferred grain forms is a cubic grain having a (100) crystal surface. Octahedral, tetradecahedral or dodecahedral grains, which can be prepared according to methods described in U.S. Pat. Nos. 4,183,756 and 4,225,666, JP-A No. 55-26589 and JP-B No. 55-42737 (hereinafter, the term, JP-B refers to published Japanese Patent), and J. Photogr. Sci. 21, 39 (1973) are also usable. Silver halide twinned crystal grains may be used. Silver halide grains having a single form are preferred and it is specifically preferred that at least two kinds of monodisperse grain emulsions be included in the same layer.

The silver halide grains according to the present invention preferably consist of single-shaped grains, however two or more kinds of monodispersed silver halide emulsion may be incorporated in a layer.

Silver halide grains used in the invention are not limited with respect to grain size but the grain size is preferably 0.1 to 5.0 μm, and more preferably 0.2 to 3.0 μm in terms of rapid processability and sensitivity. In the case of cubic grains, the grain size is preferably 0.1 to 1.2 μm, and more preferably 0.15 to 1.0 μm.

Silver halide grains used in the invention are not limited with respect to grain size but the grain size is preferably 0.1 to 5.0 μm, and more preferably 0.2 to 3.0 μm in terms of rapid processability and sensitivity. In the case of cubic grains, the grain size is preferably 0.1 to 1.2 μm, and more preferably 0.15 to 1.0 μm. With regard to the grain size distribution is preferred monodisperse silver halide grains having a coefficient of variation of not more than 0.22, and more preferably not more than 0.15. The coefficient of variation is referred to as a coefficient representing a width of the grain size distribution and defined according to the following equation:

$$\text{Coefficient of variation}=S/R$$

where S is a standard deviation of grain size distribution and R is a mean grain size. Herein, the grain size is a diameter in the case of spherical grain, and in the case of being cubic, or shape other than spherical form, the grain size is a diameter of a circle having an area equivalent to the grain projected area.

There can be employed a variety of apparatuses and methods for preparing silver halide emulsions, which are generally known in the art.

The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521.

There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains. The apparatus described in JP-A 56-501776 in which the reaction mother liquid is take out from the reaction vessel and concentrated by an ultrafiltration so that the silver halide grains is grown while the distance between the grains is held at a constant are also usable.

Solvents for silver halide such as thioethers are optionally employed if necessary. A compound containing a mercapto group, nitrogen containing heterocyclic compound or a compound such as a sensitizing dye can also be added at the time of forming silver halide grains or after completion thereof.

In the silver halide emulsion of the invention, sensitization with a gold compound and sensitization with a chalcogen sensitizer can be employed in combination.

The chalcogen sensitizer include a sulfur sensitizer, selenium sensitizer and tellurium sensitizer and of these is preferred the sulfur sensitizer. Exemplary examples of sulfur sensitizers include thiosulfates, triethylthiourea, allylthiocarbamide, thiourea, allylisothiocyanate, cystine, p-toluenethiosulfonate, rhodanine, and inorganic sulfur single substance.

The amount of the sulfur sensitizer to be added to a silver halide emulsion layer, depending of the kind of a silver halide emulsion and expected effects, is preferably $5\times10^{-10}$ to $5\times10^{-5}$, and more preferably $5\times10^{-8}$ to $3\times10^{-5}$ mole per mole of silver halide.

The amount of the gold compound to be added, depending of the kind of a silver halide emulsion, the kind of the compound and ripening conditions, is preferably $5\times10^{-10}$ to $5\times10^{-5}$, and more preferably $5\times10^{-8}$ to $3\times10^{-5}$ mole per mole of silver halide. Silver halide emulsions used in the invention may be chemically sensitized by reduction sensitization.

The gold sensitizer such as chloroauric acid or gold sulfide is added in the form of a complex. Compounds, such as dimethylrhodanine, thiocyanic acid, mercaptotetrazole and mercaptotriazole are used as a ligand. The amount of the gold compound to be added, depending of the kind of a silver halide emulsion, the kind of the compound and ripening conditions, is preferably $1\times10^{-8}$ to $1\times10^{-4}$, and more preferably $1\times10^{-8}$ to $1\times10^{-5}$ mole per mole of silver halide.

Silver halide emulsions used in the invention may be chemically sensitized by reduction sensitization.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column. Concrete examples of the preferable compounds include compounds of IIa-1-IIa-8, IIb-1-IIb-7 described at page 8 of the above mentioned JP-A, and 1-(3-methoxyphenyl)-5-mercaptotetrazole, 1-(4-ethoxyphenyl)-5-mercaptotetrazole.

These compounds are added in the step of preparing a silver halide emulsion, the chemical sensitization step or during the course of from completion of chemical sensitization to preparation of a coating composition. In cases when chemical sensitization is undergone in the presence of these compounds, the amount thereof is preferably $1\times10^{-8}$ to $5\times10^{-4}$ mole per mole of silver halide. In cases when added after chemical sensitization, the amount thereof is preferably $1\times10^{-6}$ to $1\times10^{-2}$, and more preferably $1\times10^{-5}$ to $5\times10^{-3}$ mol per mole of silver halide. In cases when added at the stage of preparing a coating composition, the amount is preferably $1\times10^{-6}$ to $1\times10^{-1}$, and more preferably $1\times10^{-5}$ to $1\times10^{-2}$ mole per mol of silver halide. In case where added to a layer other than a silver halide emulsion layer, the amount is preferably $1\times10^{-9}$ to $1\times10^{-3}$ mole/$m^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 30, AI-1 to 11, and JP-A No. 6-3770; infra-red absorbing dyes described in JP-A No. 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of 0.7 to 3.0 and more preferably 0.8 to 3.0.

Fluorescent brightening agents are also incorporated into the photographic material to improve whiteness. Examples of preferred compounds include those represented by formula II described in JP-A No. 2-232652.

In cases when a silver halide photographic light sensitive material according to the invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infrared ray with a semiconductor laser, infrared-sensitive sensitizing dyes are employed. Compounds IRS-1 to 11 described in JP-A 4-285950 at pages 6-8 are preferably employed as a blue-sensitive sensitizing dye. Supersensitizers SS-1 to SS-9 described in JP-A 4-285950 at pages 8-9 and compounds S-1 to S-17 described in JP-A 5-66515 at pages 5-17 are preferably included, in combination with these blue-sensitive, green-sensitive and red-sensitive sensitizing dyes.

The sensitizing dye is added at any time during the course of silver halide grain formation to completion of chemical sensitization.

Sensitizing dye is incorporated through solution in water-miscible organic solvents such as methanol, ethanol, fluorinated alcohol, acetone and dimethylformamide or water, or in the form of solid particle dispersion.

As couplers used in silver halide photographic materials relating to the invention is usable any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by general formulas (C-I) and (C-II) described in JP-A 4-114154 at page 5, left lower column. Exemplary compounds described therein (page 5, right lower column to page 6, left lower column) are CC-1 to CC-9.

Examples of preferred magenta couplers include those which are represented by general formulas (M-I) and (M-II) described in JP-A No. 4-114154 at page 4, right upper column. Exemplary compounds described therein (page 4, left lower column to page 5, right upper column) are MC-1 to MC-11. Of these magenta couplers are preferred couplers represented by formula (M-I) described in the foregoing document, page 4, right upper column; and couplers in which $R_M$ in formula (M-I) is a tertiary alkyl group are specifically preferred. Further, couplers MC-8 to MC-11 are superior in color reproduction of blue to violet and red, and in representation of details. Examples of the foregoing coupler represented by formula (M-1) include exemplary compounds 1 through 64, described in JP-A No. 63-253943, page 5-9; compounds M-1 through M-29 described in JP-A No. 2-100048, page 5-6; compound (1) through (36) described in JP-A No. 7-175186, page 5-12; compound M-1 through M-33 described in JP-A No. 7-219170, page 14-22; compound M-1 through M-16 described in JP-A No. 8-304972, page 5-9; compound M-1 through M-26 described in JP-A No. 10-207024, page 5-10; compound M-1 through M-36 described in JP-A No. 10-207025, page 5-22; compound M-1 through M-24 described in U.S. Pat. No. 5,576,150, page 3-6; compound M-1 through M-48 described in U.S. Pat. No. 5,609,996, page 3-9; compound M-1 through M-23 described in U.S. Pat. No. 5,667,952, page 3-5; and compound M-1 through M-26 described in U.S. Pat. No. 5,698,386, page 3-6.

Examples of preferred yellow couplers include those which are represented by general formula (Y-I) described in JP-A No. 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A No. 6-67388. Specifically preferred examples thereof include YC-8 and YC-9 described in JP-A No. 4-114154 at page 4, left lower column and Nos. (1) to (47) described in JP-A No. 6-67388 at pages 13-14. Still more preferred examples include compounds represented by formula [Y-1] described in JP-A No. 4-81847 at page 1 and pages 11-17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant.

As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination.

Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used. The dispersion is conventionally added to a coating composition containing a silver halide emulsion. The elapsed time from dispersion until addition to the coating composition and the time from addition to the coating composition until coating are preferably short. They are respectively preferably within 10 hours, more preferably within 3 hours and still more preferably within 20 minutes.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I' described in JP-A No. 1-196049 and compounds represented by Formula II described in JP-A No. 5-11417.

A compound (d-11) described in JP-A No. 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pp. 13 through 14 and compound 1 described on page 17.

In the photographic material according to the present invention, it is preferable that static fogging is prevented and light-durability of the dye image is improved by adding a UV absorber. The preferable UV absorbent is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials.

A vinylsulfone type hardening agent or a chlorotriazine type hardening agent is employed as a hardener of the binder, and compounds described in JP-A 61-249054 and 61-245153 are preferably employed. An antiseptic or anti-mold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in this invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer.

As the water-proof resin are preferably employed polyethylene, ethylene terephthalate and a copolymer thereof.

Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide.

The amount of the white pigment to be added to the water-proof resin layer on the support surface is preferably not less than 13% by weight, and more preferably not less than 15% by weight to improve sharpness. The dispersion degree of a white pigment in the water-proof resin layer of paper support can be measured in accordance with the procedure described in JP-a 2-28640. In this case, the dispersion degree, which is represented by a coefficient of variation, is preferably not more than 020, and more preferably not more than 0.15.

The dispersion degree of a white pigment in the water-proof resin layer of paper support can be measured in accordance with the procedure described in JP-A 2-28640. In this case, the dispersion degree, which is represented by a coefficient of variation, is preferably not more than 020, and more preferably not more than 0.15.

Supports having a center face roughness (SRa) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness.

The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention.

In coating of the photographic material, a thickening agent may be employed to enhance coatability of a coating composition. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

It is preferable to apply the present invention to a photographic material wherein a developing agent is not incorporated in the photographic material. Examples of such a photographic material include-color paper, color reversal paper, positive image forming photographic material, photographic material used for display, and photographic material used for color proof. Application to photographic material having a reflective support is specifically preferred.

Commonly known aromatic primary amine developing agents may be employed in the invention. Examples thereof include:

CD-1) N,N-diethyl-p-phenylendiamine,
CD-2) 2-amino-5-diethylaminotoluene,
CD-3) 2-amino-5-(N-ethyl-N-laurylamino) toluene,
CD-4) 4-(N-ethyl-N-(β-hydroxyethyl)amino)-aniline,
CD-5) 2-methyl-4-(N-ethyl-N-(β-hydroxyethyl)amino) aniline,
CD-6) 4-amino-3-methyl-N-ethyl-N-(β-methanesulfoneamido-ethyl)aniline,
CD-7) 4-amino-3-β-methanesulfoneamidoethyl-N,N-diethyl-aniline
CD-8) N,N-dimethyl-p-phenylenediamine,
CD-9) 4-amino-3-methyl-N-ethyl-N-metoxyethylaniline,
CD-10) 4-amino-3-methyl-N-ethyl-N-(β-ethoxyethyl) aniline,
CD-11) 4-amino-3-methyl-N-ethyl-N-(γ-hydroxypropyl)-aniline.

The pH of a color developing solution is optional, but preferably 9.5 to 13.0, and more preferably 9.8 to 12.0 in terms of rapid access.

The higher color development temperature enables more rapid access, but the temperature is preferably 35 to 70° C., and more preferably 37 to 60° C. in terms of stability of processing solutions.

The color developing time is conventionally 3 min. 30 sec. but the developing time in the invention is preferably not longer than 40 sec., and more preferably not longer than 25 sec.

In addition to the developing agents described above, the developing solution is added with commonly known developer component compounds, including an alkaline agent having pH-buffering action, a development inhibiting agent such as chloride ion or benzotriazole, a preservative, and a chelating agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing.

As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

The present invention will be further described based on examples but are by no means limited to these examples.

EXAMPLE 1

Silver halide emulsions were prepared according to the procedure described below.

Preparation of Silver Halide Emulsion (R-1)

To 1 liter of an aqueous 2% solution of deionized ossein gelatin (containing 10 ppm calcium), maintained at 40° C. were solutions (A1) and (B1) for 30 min. while controlling the pAg and pH at 7.3 and 3.0, respectively. Subsequently, solutions (A2) and (B2) were added for 90 min with controlling the pAg and pH at 8.0 and 5.5, respectively. Then, solutions (A3) and (B3) were added over 15 min. with controlling the pAg and pH at 8.0 and 5.5, respectively. The pAg was controlled in accordance with the method described in JP-A No. 59-45437 and the pH was controlled using aqueous sulfuric acid or sodium hydroxide solution.

| | |
|---|---|
| Solution (A1) | |
| Sodium chloride | 3.42 g |
| Potassium bromide | 0.03 g |
| Water to make | 200 ml |
| Solution (A2) | |
| Sodium chloride | 71.9 g |
| $K_2IrCl_6$ | $3.0 \times 10^{-8}$ mol/mol AgX |
| $K_2IrBr_6$ | $1.0 \times 10^{-8}$ mol/mol AgX |
| $K_4Fe(CN)_6$ | $2.0 \times 10^{-5}$ mol/mol AgX |
| Potassium bromide | 0.7 g |
| Water to make | 420 ml |
| Solution (A3) | |
| Sodium chloride | 30.8 g |
| Potassium bromide | 0.3 g |
| Water to make | 180 ml |
| Solution (B1) | |
| Silver nitrate | 10 g |
| Water to make | 200 ml |
| Solution (B2) | |
| Silver nitrate | 210 g |
| Water to make | 420 ml |

-continued

| Solution (B3) | |
|---|---|
| Silver nitrate | 90 g |
| Water to make | 180 ml |

After completing addition, an aqueous 5% solution containing 30 g of chemically-modified gelatin (modification rate of 95%), in which an amino group of gelatin was phenylcarbamoylated, was added to perform desalting in accordance with the method described in JP-A No. 5-72658, and an aqueous gelatin solution was further added thereto to obtain silver halide emulsion (R-1) comprising monodisperse cubic grains having an average grain size (cubic equivalent edge length) of 0.40 μm, a coefficient of variation of grain size of 0.07, a chloride content of 99.5 mol % and a bromide content of 0.5 mol %.

In the silver halide emulsion (R-1), the grain growth portion formed by solutions (A1) and (B1) is designated "seed portion", the growth portion formed by solutions (A2) and (B2) is designated "core portion" and the growth portion formed by solutions (A3) and (B3) is designated "shell portion". The seed portion, core portion and shell portion accounted for 3.3%. 66.7% and 30.0% by volume, respectively.

In the silver halide emulsion (R-1), the grain growth portion formed by solutions (A1) and (B1) is designated "seed portion", the growth portion formed by solutions (A2) and (B2) is designated "core portion" and the growth portion formed by solutions (A3) and (B3) is designated "shell portion". The seed portion, core portion and shell portion accounted for 3.3%. 66.7% and 30.0% by volume, respectively.

Preparation of Silver Halide Emulsion (R-2)

Silver halide emulsion (R-2) was prepared similarly to the foregoing silver halide emulsion (R-1), except that an iridium compound of solution (A2) was varied as below.

| | |
|---|---|
| $K_2IrCl_6$ | $1.5 \times 10^{-8}$ mol/mol AgX |
| $K_2IrCl_6$ ($H_2O$) | $2.0 \times 10^{-7}$ mol/mol AgX |
| $K_2IrCl_6$ (thiazole) | $5.0 \times 10^{-9}$ mol/mol AgX |

Preparation of Silver Halide Emulsion (R-3)

Silver halide emulsion (R-3) was prepared similarly to the foregoing silver halide emulsion (R-2), except that compound (S-1-4) was added to solutions (A1), (A2) and (A3) in an amount of $2.1\times10^{-6}$ mol/mol·AgX, $5.3\times10^{-5}$ mol/mol·AgX and $9.0\times10^{-6}$ mol/mol·AgX, respectively, based on final grains.

Preparation of Silver Halide Emulsion (R-4)

Silver halide emulsion (R-4) was prepared similarly to the foregoing silver halide emulsion (R-2), except that compound (S-2-4) was added to solutions (A1), (A2) and (A3) in an amount of $2.1\times10^{-6}$ mol/mol·AgX, $5.3\times10^{-5}$ mol/mol·AgX and $9.0\times10^{-6}$ mol/mol·AgX, respectively, based on final grains.

Preparation of Silver Halide Emulsion (R-4)

Silver halide emulsion (R-4) was prepared similarly to the foregoing silver halide emulsion (R-2), except that compound (S-2-4) was added to solutions (A1), (A2) and (A3) in an amount of $2.1\times10^{-6}$ mol/mol·AgX, $5.3\times10^{-5}$ mol/mol·AgX and $9.0\times10^{-6}$ mol/mol·AgX, respectively, based on final grains.

Preparation of Silver Halide Emulsion (R-5)

Silver halide emulsion (R-5) was prepared similarly to the foregoing silver halide emulsion (R-4), except that after forming silver halide grains by adding solutions (A1) to (A3) and solutions (B1) to (B3), an aqueous 5% solution containing 30 g of chemically-modified gelatin (modification rate of 95%), in which an amino group of gelatin was phenylcarbamoylated, was added to perform desalting in accordance with the method described in JP-A No. 5-72658 and 0.0018 mol of fine silver bromide grains (grain size of 0.02 μm) was added to form bromide-localized phases in the vicinity of the corners of the grains. The thus prepared silver halide emulsion (R-5) was comprised of monodisperse cubic grains having an average grain size (cubic equivalent edge length) of 0.40 μm, a coefficient of variation of grain size of 0.07, a chloride content of 99.4 mol % and a bromide content of 0.6 mol %.

Preparation of Silver Halide Emulsion (R-6)

Silver halide emulsion (R-6) was prepared similarly to the foregoing silver halide emulsion (R-5), except that a ruthenium compound described below was added to solution (A2); when addition of solutions (A3) and (B3) reached 65% of the total, the addition of silver nitrate and halide solutions was interrupted and 7.2 ml of aqueous 0.5 M potassium iodide solution was added; then, the addition of silver nitrate and halide solutions was restarted. The thus prepared silver halide emulsion (R-6) was comprised of monodisperse cubic grains having an average grain size (cubic equivalent edge length) of 0.40 μm, a coefficient of variation of grain size of 0.07, a chloride content of 99.0 mol %, a bromide content of 0.8 mol % and a iodide content of 0.2 mol %.

| | |
|---|---|
| $K_2[Ru(NO)Cl_5]$ | $9.0 \times 10^{-9}$ mol/mol AgX |

Preparation of Red-Sensitive Silver Halide Emulsion (R-1a)

To the foregoing silver halide emulsion (R-1), sensitizing dyes (RS-1) and (RS-2) were added at 60° C., a pH of 5.0 and a pAg of 7.1 and subsequently, sodium thiosulfate and chloroauric acid were added to perform spectral sensitization and chemical sensitization. Following the addition of chemical sensitizers and when optimally ripened, compound (S-2-5) was added to stop ripening. There was thus obtained red-sensitive silver halide emulsion (R-1a).

| | |
|---|---|
| 1. Sodium thiosulfate | $1.2 \times 10^{-5}$ mol/mol AgX |
| 2. Chloroauric acid | $1.5 \times 10^{-5}$ mol/mol AgX |
| 3. Compound S-2-5 | $1.2 \times 10^{-4}$ mol/mol AgX |
| 4. Sensitizing dye RS-1 | $1.0 \times 10^{-4}$ mol/mol AgX |
| 5. Sensitizing dye RS-2 | $1.0 \times 10^{-4}$ mol/mol AgX |

Preparation of Red-Sensitive Silver Halide Emulsion (R-1b)

Red-sensitive silver halide emulsion (R-1b) was prepared similarly to the foregoing red-sensitive silver halide emulsion (R-1a), except that the amount of sodium thiosulfate added was changed to $9.0\times10^{-6}$ mol/mol·AgX and after the addition of sodium thiosulfate, $3.0\times10^{-6}$ mol/mol·AgX of triphenylphosphine selenide was added and then, chloroauric acid was further added thereto.

Preparation of Red-Sensitive Silver Halide Emulsion (R-1c)

Red-sensitive silver halide emulsion (R-1c) was prepared similarly to the red-sensitive silver halide emulsion (R-1a), except that the amount of sodium thiosulfate added was changed to $9.0\times10^{-6}$ mol/mol·AgX and after the addition of sodium thiosulfate, $3.0\times10^{-6}$ mol/mol·AgX of trifurylphosphine selenide was added and then, chloroauric acid was further added thereto.

Preparation of Red-Sensitive Silver Halide Emulsion (R-1d)

Red-sensitive silver halide emulsion (R-1d) was prepared similarly to the foregoing red-sensitive silver halide emulsion (R-1c), except that crown ether compound (S-2) according to this invention was added in an amount of $2.0\times10^{-3}$ mol/mol·AgX before the addition of sensitizing dyes (RS-1) and (RS-2).

Preparation of Red-Sensitive Silver Halide Emulsion (R-1e)

Red-sensitive silver halide emulsion (R-1d) was prepared similarly to the foregoing red-sensitive silver halide emulsion (R-1c), except that crown ether compound (S-4) according to this invention was added in an amount of $2.0\times10^{-3}$ mol/mol·AgX before the addition of sensitizing dyes (RS-1) and (RS-2).

Preparation of Red-Sensitive Silver Halide Emulsions (R-2a), (R-3a), (R-4a), (R-5a) and (R-6a)

Red-sensitive silver halide emulsions (R-2a), (R-3a), (R-4a), (R-5a) and (R-6a) were each prepared similarly to the foregoing red-sensitive silver halide emulsion (R-1d), except that silver halide emulsion (R-2), (R-3), (R-4), (R-5), (R-6) were employed respectively in place of silver halide emulsion (R-1).

Preparation of Red-Sensitive Silver Halide Emulsions (R-2b), (R-3b), (R-4b), (R-5b) and (R-6b)

Red-sensitive silver halide emulsions (R-2b), (R-3b), (R-4b), (R-5b) and (R-6b) were each prepared similarly to the foregoing red-sensitive silver halide emulsion (R-1e), except that silver halide emulsion (R-2), (R-3), (R-4), (R-5), (R-6) were employed respectively in place of silver halide emulsion (R-1).

Preparation of Red-Sensitive Silver Halide Emulsion (R-6c)

Red-sensitive silver halide emulsion (R-6c) was prepared similarly to the foregoing red-sensitive silver halide emulsion (R-6a), except that crown ether compound (S-2) was added after the addition of exemplified compound (S-2-5).

Preparation of Red-Sensitive Silver Halide Emulsion (R-6d)

Red-sensitive silver halide emulsion (R-6d) was prepared similarly to the foregoing red-sensitive silver halide emulsion (R-1a), except that silver halide emulsion (R-6) was employed respectively in place of silver halide emulsion (R-1), the amount of sodium thiosulfate added was changed to $9.0\times10^{-6}$ mol/mol·AgX and after the addition of sodium thiosulfate, $3.0\times10^{-6}$ mol/mol·AgX of triphenylphosphine selenide was added and then, chloroauric acid was further added thereto, and crown ether compound (S-4) according to this invention was added in an amount of $2.0\times10^{-3}$ mol/mol·AgX before the addition of sensitizing dyes (RS-1) and (RS-2).

Preparation of Silver Halide Emulsion (B-6)

Monodisperse silver halide cubic grain emulsions (B-6) having an average grain size (equivalent cubic edge length) of 0.65 μm, coefficient of variation in grain size distribution of 0.08, silver chloride content of 99.2 mol %, silver bromide content of 0.6 mol %, and silver iodide content of 0.2 mol % was prepared similarly to the foregoing silver halide emulsions (R-6), provided that the addition time of solution (A1), (B1), (A2), (B2), (A3) and (B3) was optimally varied.

Preparation of Blue-Sensitive Emulsion (B-6a)

To the foregoing silver halide emulsion (B-6), sensitizing dyes (BS-1) and (BS-2) were added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, compounds (S-2-5), (S-2-2), and (S-2-3) were successively added to stop ripening. Blue-sensitive silver halide emulsion (B-6a) was thus obtained.

| | |
|---|---|
| 1: sodium thiosulfate | $5.0\times10^{-6}$ mol/mol AgX |
| 2: chloroauric acid | $1.5\times10^{-5}$ mol/mol AgX |
| 3: compound(S-2-5) | $3.0\times10^{-4}$ mol/mol AgX |
| 4: compound(S-2-2) | $3.0\times10^{-4}$ mol/mol AgX |
| 5: compound(S-2-3) | $3.0\times10^{-4}$ mol/mol AgX |
| 6: sensitizing dye (BS-1) | $4.0\times10^{-4}$ mol/mol AgX |
| 7: sensitizing dye (BS-2) | $1.0\times10^{-4}$ mol/mol AgX |

Preparation of Silver Halide Emulsion (G-6)

Monodisperse silver halide cubic grain emulsions (G-6) having an average grain size (equivalent cubic edge length) of 0.50 μm, coefficient of variation in grain size distribution of 0.08, silver chloride content of 99.2 mol %, silver bromide content of 0.6 mol %, and silver iodide content of 0.2 mol % was prepared similarly to the foregoing silver halide emulsions (R-6), provided that the addition time of solution (A1), (B1), (A2), (B2), (A3) and (B3) was optimally varied.

Preparation of Green-Sensitive Emulsion (G-6a)

To the foregoing silver halide emulsion (G-6), sensitizing dye (GS-1) was added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, compounds (S-2-5) was successively added to stop ripening. Green-sensitive silver halide emulsion (G-6a) was thus obtained.

| | |
|---|---|
| 1: sensitizing dye (GS-1) | $4.0\times10^{-4}$ mol/mol AgX |
| 2: sodium thiosulfate | $4.5\times10^{-6}$ mol/mol AgX |
| 3: chloroauric acid | $1.5\times10^{-5}$ mol/mol AgX |
| 4: compound (S-2-5) | $1.5\times10^{-4}$ mol/mol AgX |

BS-1

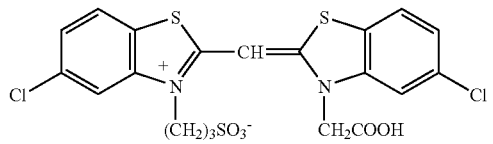

BS-2

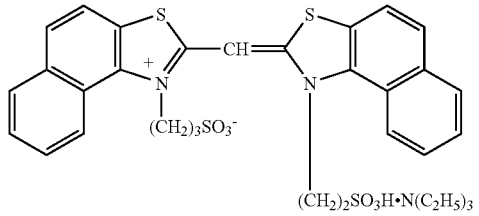

-continued

GS-1

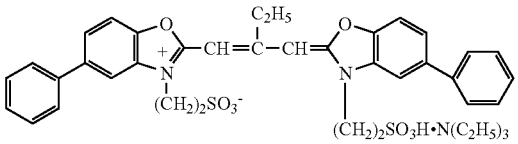

RS-1

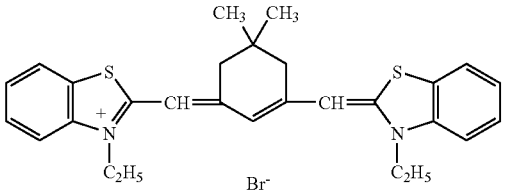

RS-2

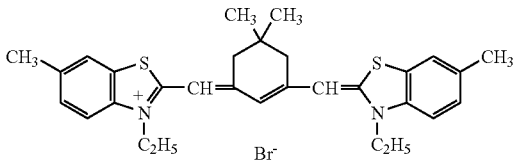

Preparation of Silver Halide Color Photographic Material

Preparation of Sample 1001

There was prepared a paper support laminated, on the light-sensitive layer coating side of paper having a weight of 180 g/m$^2$, with high density polyethylene, provided that the light-sensitive layer side was laminated with polyethylene melt containing surface-treated anatase type titanium oxide in an amount of 15% by weight. This reflection support was subjected to corona discharge and provided with a gelatin sublayer, and further thereon, the following component layers, as shown below were provided to prepare a silver halide color photographic material Sample 1001.

Coating compositions were prepared according to the following procedure.

First Layer Coating Composition

To 3.34 g of yellow coupler (Y-1), 10.02 of yellow coupler (Y-2) and 1.67 g of yellow coupler (Y-3), 1,67 g of dye image stabilizer (ST-1), 1,67 g of dye image stabilizer (ST-2), 3.34 g of dye image stabilizer (ST-5), 0.167 g of anti-staining agent (HQ-1), 2.67 g of image stabilizer A, 1.34 g of image stabilizer B, 5.0 g of high boiling organic solvent (DBP) and 1.67 g of high boiling solvent (DNP) was added 60 ml of ethyl acetate. Using an ultrasonic homogenizer, the resulting solution was dispersed in 320 ml of an aqueous 7% gelatin solution containing 5 ml of an aqueous 10% surfactant (SU-1) solution to obtain 500 ml of a yellow coupler emulsified dispersion. The obtained dispersion was mixed with the blue-sensitive silver halide emulsion (B-6a) to prepare a 1st layer coating composition.

Second to 7th Layer Coating Composition

Coating compositions for the 2nd layer to 7th layer were each prepared similarly to the 1st layer coating composition, and the respective coating compositions were coated so as to have a coating amount as shown below.

Hardeners (H-1) and (H-2) were incorporated into the 2nd, 4th and 7th layers. There were also incorporated surfactants, (SU-2) and (SU-3) as a coating aid to adjust surface tension. Further to each layer was a fungicide (F-1) so as to have a total amount of 0.04/m$^2$. The amount of silver halide contained in the respective layers was represented by equivalent converted to silver.

Additives used in sample 101 are as follows:

| Layer | Constitution | Amount (g/m$^2$) |
|---|---|---|
| 7th Layer (Protective layer) | Gelatin | 0.70 |
| | DIDP | 0.002 |
| | DBP | 0.002 |
| | Silicon dioxide | 0.003 |
| 6th Layer (UV absorbing layer) | Gelatin | 0.40 |
| | AI-1 | 0.01 |
| | UV absorbent (UV-1) | 0.07 |
| | UV absorbent (UV-2) | 0.12 |
| | Anti-staining agent (HQ-5) | 0.05 |
| 5th Layer (Red-sensitive layer) | Gelatin | 1.00 |
| | Red-sensitive emulsion (R-1a) | 0.17 |
| | Cyan coupler (C-1) | 0.22 |
| | Cyan coupler (C-2) | 0.06 |
| | Dye image stabilizer (ST-1) | 0.06 |
| | Anti-staining agent (HQ-1) | 0.003 |
| | DBP | 0.10 |
| | DOP | 0.20 |
| 4th Layer (UV absorbing layer) | Gelatin | 0.94 |
| | AI-1 | 0.02 |
| | UV absorbent (UV-1) | 0.17 |
| | UV absorbent (UV-2) | 0.27 |
| | Anti-staining agent (HQ-5) | 0.06 |
| 3rd Layer (Green-sensitive layer) | Gelatin | 1.30 |
| | AI-2 | 0.01 |
| | Green-sensitive Emulsion (G-1a) | 0.12 |
| | Magenta coupler (M-1) | 0.05 |
| | Magenta coupler (M-2) | 0.15 |
| | Dye image stabilizer (ST-3) | 0.10 |
| | Dye image stabilizer (ST-4) | 0.02 |
| | DIDP | 0.10 |
| | DBP | 0.10 |
| 2nd layer (Interlayer) | Gelatin | 1.20 |
| | AI-3 | 0.01 |
| | Anti-staining agent (HQ-1) | 0.02 |
| | Anti-staining agent (HQ-2) | 0.03 |
| | Anti-staining agent (HQ-3) | 0.06 |
| | Anti-staining agent (HQ-4) | 0.03 |
| | Anti-staining agent (HQ-5) | 0.03 |
| | DIDP | 0.04 |
| | DBP | 0.02 |
| 1st layer (Blue-sensitive layer) | Gelatin | 1.10 |
| | Blue-sensitive Emulsion (B-1a) | 0.24 |
| | Yellow coupler (Y-1) | 0.10 |
| | Yellow coupler (Y-2) | 0.30 |
| | Yellow coupler (Y-3) | 0.05 |
| | Dye image stabilizer (ST-1) | 0.05 |
| | Dye image stabilizer (ST-2) | 0.05 |
| | Dye image stabilizer (ST-5) | 0.10 |
| | Anti-staining agent (HQ-1) | 0.005 |
| | Image stabilizer A | 0.08 |
| | Image stabilizer B | 0.04 |
| | DNP | 0.05 |
| | DBP | 0.15 |
| Support | Polyethylene-laminated paper containing a small amount of colorant | |

Additives employed in the sample 1001 are detailed below.

SU-1: Sodium tri-i-propylnaphthalenesulfonate

SU-2: Di(2-ethylhexyl) sulfosuccinate sodium salt

SU-3: 2,2,3,3,4,4,5,5-Octafluoropentyl sulfosuccinate sodium salt

DBP: Dibutyl phthalate

DNP: Dinonyl phthalate

DOP: Dioctyl phthalate

DIDP: Diisodecyl phthalate

PVP: polyvinylpyrrolidone

H-1: Tetrakis(vinylsulfonylmethyl)methane
H-2: 2,4-Dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecyhydroquinone
HQ-5: 2,5-di[(1,1-dimethyl-4-hexyloxycarbonyl)butyl]-hydroquinone
Image stabilizer A: p-t-Octylphenol
Image stabilizer B: poly(t-butylacrylamide)

Y-1

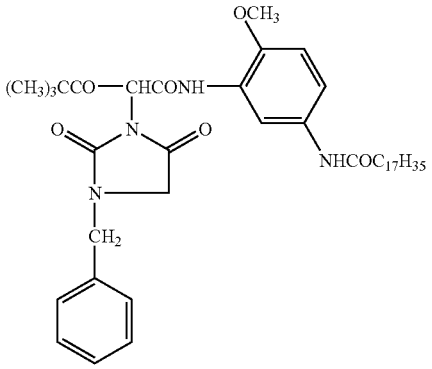

Y-2

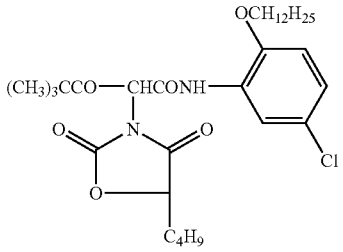

Y-3

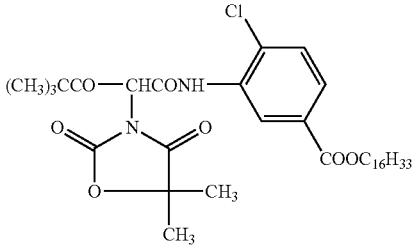

M-1

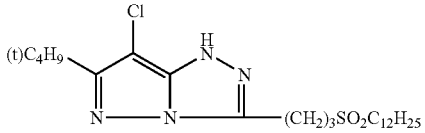

M-2

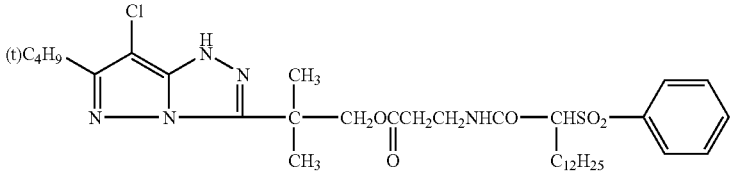

C-1

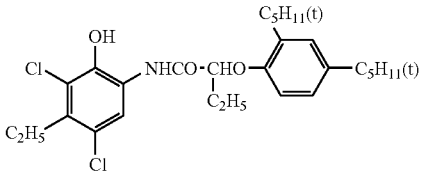

C-2

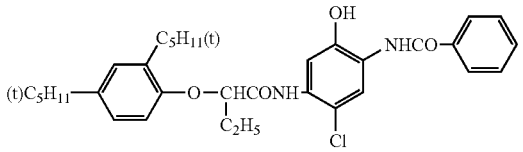

ST-1

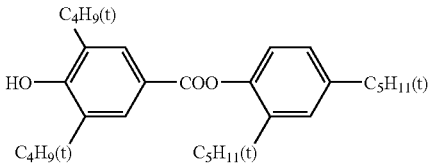

ST-2

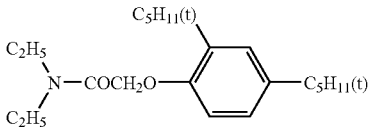

ST-3

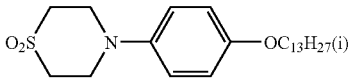

ST-4

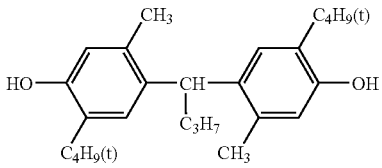

-continued

ST-5

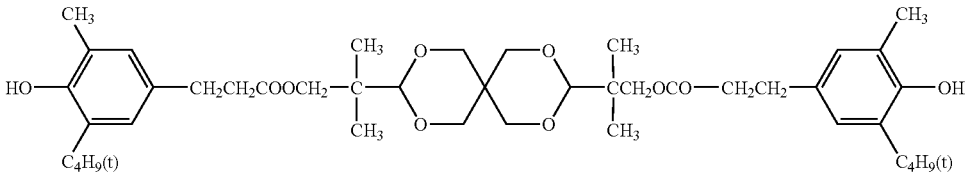

Al-1

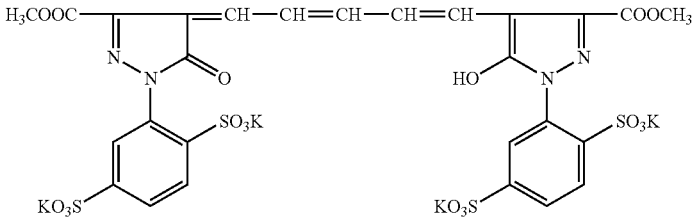

Al-2

Al-3

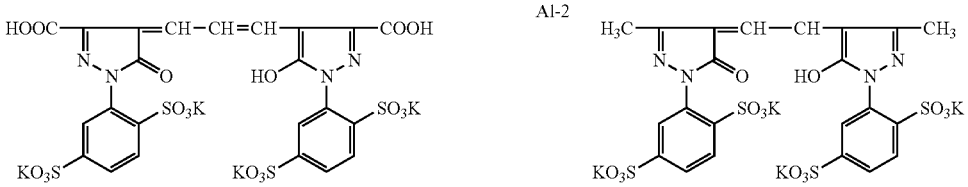

F-1

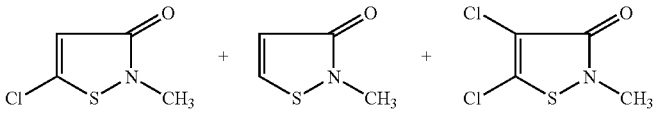

(50%) (46%) (4%) molar ratio

Compound of Molar Ratio (50:46:4)

UV-1

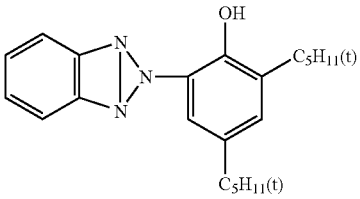

UV-2

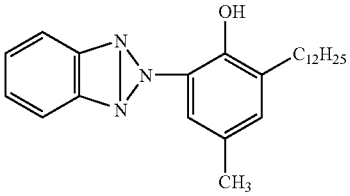

Preparation of Samples 1002 to 1017

Samples 1002 to 1017 were prepared in the similar way as Sample 1001 except that red sensitive silver halide emulsion (R-1a) was replaced by the silver halide emulsion shown in the Table below. Silver halide is abbreviated as AgX.

| Sample No. | AgX Emulsion in layer 5 | Remarks |
|---|---|---|
| 1001 | R-1a | Comparative |
| 1002 | R-1b | Comparative |

-continued

| Sample No. | AgX Emulsion in layer 5 | Remarks |
|---|---|---|
| 1003 | R-1c | Comparative |
| 1004 | R-1d | Inventive |
| 1005 | R-1e | Inventive |
| 1006 | R-2a | Inventive |
| 1007 | R-2b | Inventive |
| 1008 | R-3a | Inventive |
| 1009 | R-3b | Inventive |
| 1010 | R-4a | Inventive |
| 1011 | R-4b | Inventive |
| 1012 | R-5a | Inventive |
| 1013 | R-5b | Inventive |
| 1014 | R-6a | Inventive |
| 1015 | R-6b | Inventive |
| 1016 | R-6c | Inventive |
| 1017 | R-6d | Inventive |

Evaluation of Photographic Material

The thus prepared samples 1001 to 1017 were each evaluated with respect to sensitivity, gradation (γ), storage stability of coating composition and latent image stability in accordance with the following procedure.

Evaluation 1. Sensitivity, gradation (γ), and latent image stability in high intensity exposure Samples were each exposed through an optical wedge to a xenon flash at $10^{-6}$ sec. using a sensitometer for use in high intensity exposure (available from YAMASHITA DENSO Co., Ltd., SX-20 Type). After being allowed to stand for 5 min., exposed samples were processed according to the following color process (which was denoted as process A).

Separately samples were also exposed in the same manner as above and after 5 sec., the exposed samples were processed (which was denoted as process B).

The thus processed samples were each subjected to densitometry using an optical densitometer (PDA-65 Type, available from Konica Corp.), with respect to yellow reflection image density. Characteristic curves for yellow images, comprising an ordinate (reflection density, D) and an abscissa (exposure, LogE) were prepared and the respective characteristic values were each evaluated as follows.

Sensitivity of each sample was determined according to the following formula (1) described below. Sensitivity was represented by a relative value, based on the sensitivity of sample 1001 in process A being 100.

Contrast in process A (denoted as γa) and contrast in process B (denoted as γb) were calculated according to the following equation (2) and variation Δγ was determined according to the following equation (3). A value of Δγ closer to 100 indicates superior latent image stability.

$$\text{Sensitivity } (S)=1/(\text{exposure amount giving a density of fog plus 1.0}) \quad (1)$$

$$\text{Contrast } (\gamma)=1/[\log(\text{exposure amount giving a density of fog plus 0.8})-\text{Log}(\text{exposure amount giving a density of fog plus 1.8})] \quad (2)$$

$$\Delta\gamma=(\gamma b/\gamma a)\times 100 \quad (3)$$

Evaluation 2. Storage Stability of Coating Composition

Coating composition stability was evaluated in the following manner. In the preparation of samples 1001 to 1017, coating was conducted immediately after preparation of coating compositions (coating A) or after prepared coating composition were each allowed to stand at 40° C. for 48 hr (coating B). Sensitivity or fog of a sample obtained in coating B relative to that of coating A was determined, based on the sensitivity or fog in coating A being 100. The sensitivity or fog in coating B is closer to 100, coating composition stability is superior.

After aged at 55° C. and 40% RH for 6 days each sample was processed similarly to the evaluation 1 and fog densities of the respective samples were represented by a relative value, based on the fog density of samples 1001 which was processed by process A immediately after preparation being 100.

Color Development Process

| Processing step | Temperature | Time | Repl. Amt.* |
|---|---|---|---|
| Color developing | 38.0 ± 0.3° C. | 45 sec. | 80 ml |
| Bleach-fixing | 35.0 ± 0.5° C. | 45 sec. | 120 ml |
| Stabilizing | 30–34° C. | 60 sec. | 150 ml |
| Drying | 60–80° C. | 30 sec. | |

*Replenishing amount

Color Developer (Tank Solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |

-continued

| | Tank soln. | Replenisher |
|---|---|---|
| Potassium sulfite | 0.25 g | 0.5 g |
| N-ethyl-N(β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethylenetriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

Bleach-fixer (Tank solution, Replenisher)

| | |
|---|---|
| Ammonium ferric diethylenetriaminepentaacetate dihydrate | 65 g |
| Diethylenetriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (40% aqueous solution) | 0.65 g |
| Magnesium sulfate heptahydrate | 0.2 g |
| Polyvinyl pyrrolidine (PVP) | 1.0 g |
| Ammonia water (25% aqueous ammonium hydroxide solution) | 2.5 g |
| Trisodium nitrilotriacetate | 1.5 g |

Water is added to make 1 liter, and the pH is adjusted to 7.5 with sulfuric acid or potassium hydroxide.

The thus obtained results are shown in Table below.

TABLE 3

| Sample No. | Sensitivity | Gradation (γ) | Latent image Stability (Δγ) | Coating composition Stability Sensitivity | Coating composition Stability Fog | Remark |
|---|---|---|---|---|---|---|
| 1001 | 100 | 100 | 119 | 86 | 123 | Comp. |
| 1002 | 117 | 103 | 118 | 86 | 126 | Comp. |
| 1003 | 124 | 102 | 119 | 88 | 125 | Comp. |
| 1004 | 133 | 112 | 112 | 92 | 113 | Inv. |
| 1005 | 132 | 114 | 112 | 91 | 112 | Inv. |
| 1006 | 135 | 125 | 109 | 92 | 110 | Inv. |
| 1007 | 133 | 124 | 110 | 93 | 111 | Inv. |
| 1008 | 137 | 126 | 108 | 95 | 107 | Inv. |
| 1009 | 135 | 128 | 108 | 95 | 106 | Inv. |
| 1010 | 139 | 128 | 106 | 98 | 103 | Inv. |
| 1011 | 137 | 127 | 107 | 97 | 103 | Inv. |
| 1012 | 142 | 128 | 103 | 98 | 103 | Inv. |
| 1013 | 142 | 130 | 104 | 97 | 102 | Inv. |
| 1014 | 154 | 134 | 102 | 98 | 101 | Inv. |
| 1015 | 152 | 133 | 102 | 98 | 101 | Inv. |

TABLE 3-continued

| Sample No. | Sensitivity | Gradation (γ) | Latent image Stability (Δγ) | Coating composition Stability Sensitivity | Coating composition Stability Fog | Remark |
|---|---|---|---|---|---|---|
| 1016 | 152 | 131 | 103 | 99 | 101 | Inv. |
| 1017 | 150 | 130 | 103 | 98 | 102 | Inv. |

As is apparent from Table, it was proved that samples using silver halide emulsion relating to this invention resulted in enhanced sensitivity, superior latent image stability, and improved storage stability in high intensity exposure, and coating composition stability, as compared to comparative samples.

EXAMPLE 2

Preparation of Red Sensitive Silver Halide Emulsion (R-11a)

To the foregoing red sensitive silver halide emulsion (R-1), sensitizing dyes (RS-1) and (RS-2) were added at 60° C., of 5.0 and a pAg of 7.1, subsequently, the following sodium thiosulfate and chloroauric acid were added to perform spectral sensitization and chemical sensitization. Following the addition of chemical sensitizers and when optimally ripened, compounds (S-2-5) was successively added to stop ripening. Red-sensitive silver halide emulsion (R-11a) was thus obtained.

| | |
|---|---|
| 1: sodium thiosulfate | $1.2 \times 10^{-5}$ mol/mol AgX |
| 2: chloroauric acid | $1.5 \times 10^{-5}$ mol/mol AgX |
| 3: compound (S-2-5) | $1.5 \times 10^{-4}$ mol/mol AgX |
| 4: sensitizing dye (RS-1) | $1.0 \times 10^{-4}$ mol/mol AgX |
| 5: sensitizing dye (RS-2) | $1.0 \times 10^{-4}$ mol/mol AgX |

Preparation of Silver Halide Emulsion (R-11b)

Red-sensitive silver halide emulsion (R-11b) was prepared similarly to the foregoing red-sensitive silver halide emulsion (R-11a), except that the amount of sodium thiosulfate added was changed to $9.0\times10^{-6}$ mol/mol·AgX and after the addition of sodium thiosulfate, $3.0\times10^{-6}$ mol/mol·AgX of triphenylphosphine selenide was added and then, chloroauric acid was further added thereto.

Preparation of Silver Halide Emulsion (R-11c)

Red-sensitive silver halide emulsion (R-11c) was prepared similarly to the foregoing red-sensitive silver halide emulsion (R-11a), except that the amount of sodium thiosulfate added was changed to $9.0\times10^{-6}$ mol/mol·AgX and after the addition of sodium thiosulfate, $3.0\times10^{-6}$ mol/mol·AgX of trifurylphosphine selenide was added and then, chloroauric acid was further added thereto.

Preparation of Red-Sensitive Silver Halide Emulsion (R-11d)

Red-sensitive silver halide emulsion (R-11d) was prepared similarly to the foregoing red-sensitive silver halide emulsion (R-11c), except that exemplified compound (S-1-4) according to this invention was added in an amount of $1.0\times10^{-4}$ mol/mol·AgX before the addition of sensitizing dyes (RS-1) and (RS-2).

Preparation of Red-Sensitive Silver Halide Emulsion (R-11e)

Red-sensitive silver halide emulsion (R-11e) was prepared similarly to the foregoing red-sensitive silver halide emulsion (R-11c), except that exemplified compound (S-2-5) according to this invention was added in an amount of $1.0\times10^{-4}$ mol/mol·AgX before the addition of sensitizing dyes (RS-1) and (RS-2).

Preparation of Red-Sensitive Silver Halide Emulsions (R-12a), (R-13a), (R-14a), (R-15a) and (R-16a)

Red-sensitive silver halide emulsions (R-12a), (R-13a), (R-14a), (R-15a) and (R-16a) were each prepared similarly to the foregoing red-sensitive silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsions (R-12b), (R-13b), (R-14b), (R-15b) and (R-16b)

Red-sensitive silver halide emulsions (R-12b), (R-13b), (R-14b), (R-15b) and (R-16b) were each prepared similarly to the silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsion (R-16c)

Red-sensitive silver halide emulsion (R-16c) was prepared similarly to the foregoing red-sensitive silver halide emulsion (R-11a), except that silver halide emulsion (R-6) was employed respectively in place of silver halide emulsion (R-1), the amount of sodium thiosulfate added was changed to $9.0\times10^{-6}$ mol/mol·AgX and after the addition of sodium thiosulfate, $3.0\times10^{-6}$ mol/mol·AgX of N,N-dimethyl selenourea was added and then, chloroauric acid was further added thereto, and exemplified compound (S-2-5) according to this invention was added in an amount of $1\times10^{-4}$ mol/mol·AgX before the addition of sensitizing dyes (RS-1) and (RS-2).

Preparation of Silver Halide Emulsions (G-1) to (G4)

Monodisperse silver halide cubic grain emulsions (G-1) to (G4) having an average grain size (equivalent cubic edge length) of 0.50 μm, coefficient of variation in grain size distribution of 0.08, silver chloride content of 99.5 mol %, and silver bromide content of 0.5 mol %, was prepared similarly to the foregoing silver halide emulsions (G-1)-(G-4) prepared in Example 1, provided that the addition time of solution (A1), (B1), (A2), (B2), (A3) and (B3) was optimally varied.

Preparation of Silver Halide Emulsion (G-5)

Monodisperse silver halide cubic grain emulsions (G-5) having an average grain size (equivalent cubic edge length) of 0.50 μm, coefficient of variation in grain size distribution of 0.08, silver chloride content of 99.4 mol %, and silver bromide content of 0.6 mol %, was prepared similarly to the foregoing silver halide emulsion (R-5) prepared in Example 1, provided that the addition time of solution (A1), (B1), (A2), (B2), (A3) and (B3) was optimally varied.

Preparation of Green-Sensitive Emulsion (G-11a)

To the foregoing silver halide emulsion (G-1), sensitizing dye (GS-1) was added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, compounds (S-2-5) was successively added to stop ripening, and green-sensitive silver halide emulsion (G-11a) was thus obtained.

| | |
|---|---|
| 1: sensitizing dye (GS-1) | $4.0 \times 10^{-4}$ mol/mol AgX |
| 2: sodium thiosulfate | $4.0 \times 10^{-6}$ mol/mol AgX |
| 3: chloroauric acid | $1.5 \times 10^{-5}$ mol/mol AgX |
| 4: compound (S-2-5) | $1.5 \times 10^{-4}$ mol/mol AgX |

Preparation of Green-Sensitive Silver Halide Emulsion (G-11b)

Green-sensitive silver halide emulsion (G-11b) was prepared similarly to the foregoing green-sensitive silver halide emulsion (G-11a), except that the amount of sodium thiosulfate added was changed to $1.5\times10^{-6}$ mol/mol·AgX and after the addition of sodium thiosulfate, $2.5\times10^{-6}$ mol/mol·AgX of triphenylphosphine selenide was added and then, chloroauric acid was further added thereto.

Preparation of Green-Sensitive Silver Halide Emulsion (G-11c)

Green-sensitive silver halide emulsion (G-11c) was prepared similarly to the foregoing green-sensitive silver halide emulsion (G-11a), except that the amount of sodium thiosulfate added was changed to $1.5\times10^{6}$ mol/mol·AgX and after the addition of sodium thiosulfate, $2.5\times10^{-6}$ mol/mol·AgX of trifurylphosphine selenide was added and then, chloroauric acid was further added thereto.

Preparation of Green-Sensitive Silver Halide Emulsion (G-11d)

Green-sensitive silver halide emulsion (G-11d) was prepared similarly to the foregoing green-sensitive silver halide emulsion (G-11c), except that exemplified compound (S-1-4) was added in an amount of $1.0\times10^{-4}$ mol/mol·AgX before the addition of sensitizing dye (GS-1).

Preparation of Green-Sensitive Silver Halide Emulsion (G-11e)

Green-sensitive silver halide emulsion (G-11e) was prepared similarly to the foregoing green-sensitive silver halide emulsion (G-11c), except that exemplified compound (S-2-5) was added in an amount of $1.0\times10^{-4}$ mol/mol·AgX before the addition of sensitizing dye (GS-1).

Preparation of Green-Sensitive Silver Halide Emulsions (G-12a), (G-13a), (G-14a), (G-15a) and (G-16a)

Green-sensitive silver halide emulsions (G-12a), (G-13a), (G-14a), (G-15a) and (G-16a) were each prepared similarly to the foregoing green-sensitive silver halide emulsion (G-11d), except that silver halide emulsion (G-2), (G-3), (G-4), (G-5), (G-6) prepared in Example 1 were employed respectively in place of silver halide emulsion (G-1).

Preparation of Green-Sensitive Silver Halide Emulsions (G-12b), (G-13b), (G-14b), (G-15b) and (G-16b)

Green-sensitive silver halide emulsions (G-12b), (G-13b), (G-14b), (G-15b) and (G-16b) were each prepared similarly to the foregoing green-sensitive silver halide emulsion (G-11e), except that silver halide emulsion (G-2), (G-3), (G-4), (G-5) prepared in Example 2 and (G-6) prepared in Example 1 were employed respectively in place of silver halide emulsion (G-1).

Preparation of Green-Sensitive Silver Halide Emulsion (G-16c)

Green-sensitive silver halide emulsion (G-16c) was prepared similarly to the foregoing green-sensitive silver halide emulsion (G-11a), except that silver halide emulsion (G-6) was employed respectively in place of silver halide emulsion (G-1), the amount of sodium thiosulfate added was changed to $1.5\times10^{-6}$ mol/mol·AgX and after the addition of sodium thiosulfate, $2.5\times10^{-6}$ mol/mol·AgX of N,N-dimethyl selenourea was added and then, chloroauric acid was further added thereto, and exemplified compound (S-2-5) according to this invention was added in an amount of $1\times10^{-4}$ mol/mol·AgX before the addition of sensitizing dye (GS-1).

Preparation of Silver Halide Emulsions (B-1) to (B4)

Monodisperse silver halide cubic grain emulsions (B-1) to (B4) having an average grain size (equivalent cubic edge length) of 0.65 μm, coefficient of variation in grain size distribution of 0.08, silver chloride content of 99.5 mol %, and silver bromide content of 0.5 mol %, was prepared similarly to the foregoing silver halide emulsions (R-1)-(R-4) prepared in Example 1, provided that the addition time of solution (A1), (B1), (A2), (B2), (A3) and (B3) was optimally varied.

Preparation of Silver Halide Emulsion (B-5)

Monodisperse silver halide cubic grain emulsions (B-5) having an average grain size (equivalent cubic edge length) of 0.65 μm, coefficient of variation in grain size distribution of 0.08, silver chloride content of 99.4 mol %, and silver bromide content of 0.6 mol %, was prepared similarly to the foregoing silver halide emulsion (R-5) prepared in Example 1, provided that the addition time of solution (A1), (B1), (A2), (B2), (A3) and (B3) was optimally varied.

Preparation of Blue-Sensitive Emulsion (B-11a)

To the foregoing silver halide emulsion (B-1), sensitizing dyes (BS-1) and (BS-2) were added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, compounds (S-2-5), (S-2-2) and (S-2-3) were successively added to stop ripening, and blue-sensitive silver halide emulsion (B-11a) was thus obtained.

| | |
|---|---|
| 1: sodium thiosulfate | $5.0 \times 10^{-6}$ mol/mol AgX |
| 2: chloroauric acid | $1.5 \times 10^{-5}$ mol/mol AgX |
| 3: compound(S-2-5) | $2.0 \times 10^{-4}$ mol/mol AgX |
| 4: compound(S-2-2) | $3.0 \times 10^{-4}$ mol/mol AgX |
| 5: compound(S-2-3) | $3.0 \times 10^{-4}$ mol/mol AgX |
| 6: sensitizing dye (BS-1) | $4.0 \times 10^{-4}$ mol/mol AgX |
| 7: sensitizing dye (BS-2) | $1.0 \times 10^{-4}$ mol/mol AgX |

Preparation of Blue-Sensitive Silver Halide Emulsion (G-11b)

Blue-sensitive silver halide emulsion (B-11b) was prepared similarly to the foregoing blue-sensitive silver halide emulsion (B-11a), except that the amount of sodium thiosulfate added was changed to $3.0\times10^{-6}$ mol/mol·AgX and after the addition of sodium thiosulfate, $2.0\times10^{-6}$ mol/mol·AgX of triphenylphosphine selenide was added and then, chloroauric acid was further added thereto.

Preparation of Blue-Sensitive Silver Halide Emulsion (B-11c)

Blue-sensitive silver halide emulsion (B-11c) was prepared similarly to the foregoing blue-sensitive silver halide emulsion (B-11a), except that the amount of sodium thiosulfate added was changed to $3.0\times10^{-6}$ mol/mol·AgX and after the addition of sodium thiosulfate, $2.0\times10^{-6}$ mol/ mol·AgX of trifurylphosphine selenide was added and then, chloroauric acid was further added thereto.

Preparation of Blue-Sensitive Silver Halide Emulsion (B-11d)

Blue-sensitive silver halide emulsion (B-11d) was prepared similarly to the foregoing blue-sensitive silver halide emulsion (B-11c), except that exemplified compound (S-1-4) according to this invention was added in an amount of $1.0\times10^{-4}$ mol/mol·AgX before the addition of sensitizing dyes (BS-1) and (BS-2).

Preparation of Blue-Sensitive Silver Halide Emulsion (B-11e)

Blue-sensitive silver halide emulsion (B-11e) was prepared similarly to the foregoing blue-sensitive silver halide emulsion (B-11c), except that exemplified compound (S-2-5) according to this invention was added in an amount of $1.0\times10^{-4}$ mol/mol·AgX before the addition of sensitizing dyes (BS-1) and (BS-2).

Preparation of Blue-Sensitive Silver Halide Emulsions (B-12a), (B-13a), (B-14a), (B-15a) and (B-16a)

Blue-sensitive silver halide emulsions (B-12a), (B-13a), (B-14a), (B-15a) and (B-16a) were each prepared similarly to the foregoing blue-sensitive silver halide emulsion (B-11d), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsions (B-12b), (B-13b), (B-14b), (B-15b) and (B-16b)

Blue-sensitive silver halide emulsions ((B-12b), (B-13b), (B-14b), (B-15b) and (B-16b) were each prepared similarly to the foregoing blue-sensitive silver halide emulsion (B-11e), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsion (B-16c)

Blue-sensitive silver halide emulsion (B-16c) was prepared similarly to the foregoing blue-sensitive silver halide emulsion (B-11a), except that silver halide emulsion (B-6) was employed respectively in place of silver halide emulsion (B-1), the amount of sodium thiosulfate added was changed to $3.0\times10^{-6}$ mol/mol·AgX and after the addition of sodium thiosulfate, $2.0\times10^{-6}$ mol/mol·AgX of N,N-dimethyl selenourea was added and then, chloroauric acid was further added thereto, and exemplified compound (S-2-5) according to this invention was added in an amount of $1.0\times10^{-4}$ mol/mol·AgX before the addition of sensitizing dyes (BS-1) and (BS-2).

Samples 1101 to 1116 were prepared in the similar way as Sample 1001 in Example 1 except that silver halide emulsion (B-6a) in the 1st layer, silver halide emulsion (G-6a) in the 3rd layer and silver halide emulsion (R-1a) in the 5th layer were each replaced by the silver halide emulsion shown in the Table below, and they were evaluated in the same way as Example 1.

| Sample | AgX Emulsion | | | |
|---|---|---|---|---|
| No. | 1st layer | 3rd layer | 5th layer | Remarks |
| 1101 | B-11a | G-11a | R-11a | Comparative |
| 1102 | B-11b | G-11b | R-11b | Comparative |
| 1103 | B-11c | G-11c | R-11c | Comparative |
| 1104 | B-11d | G-11d | R-11d | Inventive |
| 1105 | B-11e | G-11e | R-11e | Inventive |
| 1106 | B-12a | G-12a | R-12a | Inventive |
| 1107 | B-12b | G-12b | R-12b | Inventive |
| 1108 | B-13a | G-13a | R-13a | Inventive |
| 1109 | B-13b | G-13b | R-13b | Inventive |
| 1110 | B-14a | G-14a | R-14a | Inventive |
| 1111 | B-14b | G-14b | R-14b | Inventive |
| 1112 | B-15a | G-15a | R-15a | Inventive |
| 1113 | B-15b | G-15b | R-15b | Inventive |
| 1114 | B-16a | G-16a | R-16a | Inventive |
| 1115 | B-16b | G-16b | R-16b | Inventive |
| 1116 | B-16c | G-16c | R-16c | Inventive |

Result is shown in the following Table.

| Sample | | | Latent image stability | Coating composition storage stability | | |
|---|---|---|---|---|---|---|
| No. | *(S) | *(γ) | (Δγ) | *(S) | Fog | Remarks |
| 1101 | 100 | 100 | 120 | 82 | 123 | Comp. |
| 1102 | 116 | 102 | 122 | 81 | 125 | Comp. |
| 1103 | 119 | 101 | 122 | 83 | 122 | Comp. |
| 1104 | 125 | 107 | 115 | 91 | 112 | Inv. |
| 1105 | 127 | 110 | 113 | 92 | 110 | Inv. |
| 1106 | 130 | 114 | 109 | 92 | 110 | Inv. |
| 1107 | 133 | 117 | 108 | 92 | 109 | Inv. |
| 1108 | 135 | 116 | 106 | 94 | 106 | Inv. |
| 1109 | 137 | 118 | 105 | 94 | 106 | Inv. |
| 1110 | 138 | 117 | 105 | 95 | 105 | Inv. |
| 1111 | 140 | 120 | 105 | 97 | 104 | Inv. |
| 1112 | 145 | 123 | 105 | 97 | 104 | Inv. |
| 1113 | 147 | 125 | 104 | 98 | 104 | Inv. |
| 1114 | 154 | 127 | 104 | 98 | 102 | Inv. |
| 1115 | 158 | 132 | 102 | 99 | 101 | Inv. |
| 1116 | 155 | 130 | 103 | 98 | 101 | Inv. |

*(S): Sensitivity
*(γ): Gradation(γ)

It is apparent from the result shown in the table that each sample employing silver halide emulsion according to this invention demonstrates good result of high γ, good latent image stability for high sensitivity and coating composition storage stability in comparison with comparative samples. Sensitivity, gradation (γ), latent image stability and coating composition storage stability was evaluated by preparing characteristic curves of a magenta image and a yellow image as in Example 1, samples employing silver halide emulsion according to this invention demonstrate excellent results as well as a cyan image.

EXAMPLE 3

Using photographic materials prepared in Example 1, 127 mm wide roll form samples were prepared and evaluated with respect to suitability for digital exposure.

Thus, negative images of processed negative film (Konica Color New CENTURIA 400) were digitized using a film scanner, Q scan 1202JW (available from Konica Corp.) so as to be treatable using computer software, Photoshop (Ver. 5.5, available from Adobe Co.). Further to the thus treated images, letters of various sizes and fine lines were added to form image data and operated so as to perform exposure using the following digital scanning exposure apparatus.

As light sources were used a 473 nm laser which was obtained by subjecting YAG solid laser (oscillation wavelength: 946 nm) using semiconductor laser GaAlAs (oscillation wavelength: 808.5 nm) as an exciting light to wavelength conversion by a SHG crystal of $KNbO_3$; a 532 nm laser which was obtained by subjecting $YVO_4$ solid laser (oscillation wavelength: 1064 nm) using semiconductor laser GaAlAs (oscillation wavelength: 808.7 nm) as an exciting light to wavelength conversion by a SHG crystal of KTP; and AlGaInP laser (oscillation wavelength: 670 nm). There was prepared an apparatus, in which three color laser lights were each moved in the direction vertical to the scanning direction, using a polygon mirror so that scanning exposure was successively performed onto color print paper. The exposure amount was controlled by electrical adjustment of the light quantity of the semiconductor lasers. Scanning exposure was conducted at 400 dpi (dpi represents the number of dots per inch or 2.54 cm) and the exposure time per picture element (or pixel) was $5\times10^{-8}$ sec.

The exposure amount was adjusted so that the best print images were obtained in the respective samples. After performing scanning exposure, cabinet-size print images were obtained in accordance with the following process.

Color Development Process

| Processing step | Temperature | Time | Repl. Amt.* |
|---|---|---|---|
| Color developing | 38.0 ± 0.3° C. | 22 sec. | 81 ml |
| Bleach-fixing | 35.0 ± 0.5° C. | 22 sec. | 54 ml |
| Stabilizing | 30–34° C. | 25 sec. | 150 ml |
| Drying | 60–80° C. | 30 sec. | |

*Replenishing amount

Color Developer (Tank Solution, Replenisher)

| | Tank soln. | Replenisher |
|---|---|---|
| Water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.5 g |
| N,N-diethylhydroxyamine | 3.5 g | 6.0 g |
| N,N-bis(2-sulfoethyl)hydroxylamine | 3.5 g | 6.0 g |
| Triethanolamine | 10.0 g | 10.0 g |
| Sodium diethylenetriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.1 and 10.6 with sulfuric acid or potassium hydroxide.

Bleach-Fixer (Tank Solution, Replenisher)

| | Tank soln. | Replenisher |
|---|---|---|
| Ammonium ferric diethylenetriaminepentaacetate dihydrate | 100 g | 50 g |
| diethylenetriaminepentaacetic acid | 3 g | 3 g |
| Ammonium thiosulfate (70% aqueous solution) | 200 ml | 100 ml |
| 2-Amino-5-mercapto-1,3,4-thiadiazole | 2.0 g | 1.0 g |
| Ammonium sulfite (40% aqueous solution) | 50 ml | 25 ml |

Water is added to make 1 liter, and the pH is adjusted to 7.0 with potassium carbonate or glacial acetic acid.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| PVP | 1.0 g |
| Ammonia water (25% aqueous ammonium hydroxide solution) | 2.5 g |
| Ethylenediaminetetraacetic acid | 1.0 g |
| Ammonium sulfite (40% aqueous solution) | 10 ml |

Water is added to make 1 liter, and the pH is adjusted to 7.5 with sulfuric acid or potassium hydroxide.

The thus obtained print images were visually evaluated by 20 observers with respect to clearness of fine lines and letters, human skin tone reproduction and color reproduction of green foliage. Further, 100 sheets were exposed for each sample and successively processed. The first and 100th prints were evaluated with respect to print reproducibility, based on the following criteria.

(1) Clearness of Fine Line and Letter
- A: neutral fine lines and letters were clearly distinguishable
- B: neutral fine lines and letters were clearly distinguishable but outlines becoming slightly blurred
- C: neutral fine lines and letters were clearly distinguishable but blurred
- D: neutral fine lines and letters were blurred and undistinguishable.

(2) Human Skin Tone Reproduction
- A: bright, and natural reproduction;
- B: natural reproduction;
- C: being slightly muted;
- D: being muted.

(3) Color Reproduction of Green Foliage
- A: bright and clear reproduction
- B: clear reproduction
- C: slightly muted reproduction;
- D: definitely muted reproduction (4) Print Reproducibility
- A: no difference in prints ere noticed;
- B: slight difference in prints were noticed but treated as the same;
- C: some differences in prints were noticed and weighed;
- D: clear differences in prints were noticed and unacceptable in practice Evaluation results are shown in Table 4. As is apparent from Table 4, it was proved that samples relating to this invention exhibited superior performance with respect to clearness of fine lines and letters, human skin tone reproduction, color reproduction of green foliage and print reproducibility.

TABLE 4

| Sample No. | Clearness of Fine Line and Letter | Skin Tone Reproduction | Reproduction of Leaves Green | Print Reproducibility | Remark |
|---|---|---|---|---|---|
| 1001 | D | D | D | D | Comp. |
| 1002 | D | D | C | D | Comp. |
| 1003 | C | D | C | C | Comp. |
| 1004 | B | C | B | B | Inv. |
| 1005 | B | C | B | B | Inv. |
| 1006 | B | B | A | A | Inv. |
| 1007 | B | B | A | A | Inv. |
| 1008 | A | B | A | A | Inv. |
| 1009 | A | B | A | A | Inv. |
| 1010 | A | B | A | A | Inv. |
| 1011 | A | B | A | A | Inv. |
| 1012 | A | B | A | A | Inv. |
| 1013 | A | B | A | A | Inv. |
| 1014 | A | B | A | A | Inv. |
| 1015 | A | B | A | A | Inv. |
| 1016 | A | B | A | A | Inv. |

EXAMPLE 4

From negative images of processed negative film (Konica Color New CENTURIA 400), positive images of processed reversal film (Konica Chrome SINBI 1200 High Quality) and photographing image data taken by a digital camera Digital Revio KD-200Z (available from Konica Corp.), print images were obtained in accordance with the following procedure.

There were prepared roll form samples of 127 mm width, using photographic materials prepared in Example 2. The samples were exposed and processed in Konica digital minilab system QD-21 SUPER (in which print processor QDP-1500 SUPER and processing chemicals ECOJET-HQA-P were employed and processing is conducted in accordance with process CPK-HQA-P). The obtained print samples were evaluated similarly to Example 3. Results thereof are shown in Table shown below. Similarly to Example 3, it was proved that samples relating to this invention achieved superior effects.

TABLE 5

| Sample No. | Clearness of Fine Line and Letter | Skin Tone Reproduction | Reproduction of Leaves Green | Print Reproducibility | Remark |
|---|---|---|---|---|---|
| 1101 | D | D | D | D | Comp. |
| 1102 | C | D | D | D | Comp. |
| 1103 | C | D | C | C | Comp. |
| 1104 | B | C | B | B | Inv. |
| 1105 | B | C | B | B | Inv. |
| 1106 | A | B | B | A | Inv. |
| 1107 | A | B | B | A | Inv. |
| 1108 | A | B | A | A | Inv. |
| 1109 | A | B | A | A | Inv. |
| 1110 | A | B | A | A | Inv. |
| 1111 | A | B | A | A | Inv. |
| 1112 | A | B | A | A | Inv. |
| 1113 | A | B | A | A | Inv. |
| 1114 | A | B | A | A | Inv. |
| 1115 | A | B | A | A | Inv. |
| 1116 | A | B | A | A | Inv. |

EXAMPLE 5

Preparation of Red Sensitive Silver Halide Emulsion (R-21a)

To the foregoing silver halide emulsion (R-1), sensitizing dyes (RS-1) and (RS-2) were added at 60° C., a pH of 5.0 and a pAg of 7.1, subsequently, the following sodium thiosulfate and chloroauric acid were added to perform spectral sensitization and chemical sensitization. Following the addition of chemical sensitizers and when optimally ripened, compounds (S-2-5) was successively added to stop ripened. Red-sensitive silver halide emulsion (R-21a) was thus obtained.

| | |
|---|---|
| 1: sodium thiosulfate | $1.2 \times 10^{-5}$ mol/mol AgX |
| 2: chloroauric acid | $1.3 \times 10^{-5}$ mol/mol AgX |
| 3: compound(S-2-5) | $1.8 \times 10^{-4}$ mol/mol AgX |
| 4: sensitizing dye (RS-1) | $1.0 \times 10^{-4}$ mol/mol AgX |
| 5: sensitizing dye (RS-2) | $1.0 \times 10^{-4}$ mol/mol AgX |

Preparation of Silver Halide Emulsion (R-21b)

Red-sensitive silver halide emulsion (R-21b) was prepared similarly to the foregoing red-sensitive silver halide emulsion (R-21a), except that the amount of sodium thiosulfate added was changed to $9.0\times10^{-6}$ mol/mol·AgX and after the addition of sodium thiosulfate, $3.0\times10^{-6}$ mol/mol·AgX of triphenylphosphine selenide was added and then, chloroauric acid was further added thereto.

Preparation of Red-Sensitive Silver Halide Emulsion (R-11c)

Red-sensitive silver halide emulsion (R-21c) was prepared similarly to the foregoing red-sensitive silver halide emulsion (R-21a), except that the amount of sodium thiosulfate added was changed to $9.0\times10^{-6}$ mol/mol·AgX and after the addition of sodium thiosulfate, $3.0\times10^{-6}$ mol/mol·AgX of trifurylphosphine selenide was added and then, chloroauric acid was further added thereto.

Preparation of Red-Sensitive Silver Halide Emulsion (R-21d)

Red-sensitive silver halide emulsion (R-21d) was prepared similarly to the foregoing red-sensitive silver halide emulsion (R-21c), except that exemplified compound (S-1-21) according to this invention was added in an amount of $1.0\times10^{-4}$ mol/mol·AgX before the addition of sensitizing dyes (RS-1) and (RS-2).

Preparation of Red-Sensitive Silver Halide Emulsion (R-21e)

Red-sensitive silver halide emulsion (R-21e) was prepared similarly to the foregoing red-sensitive silver halide emulsion (R-21c), except that exemplified compound (S-2-1) according to this invention was added in an amount of $1.0\times10^{-4}$ mol/mol·AgX before the addition of sensitizing dyes (RS-1) and (RS-2).

Preparation of Red-Sensitive Silver Halide Emulsions (R-22a), (R-23a), (R-24a), (R-25a) and (R-26a)

Red-sensitive silver halide emulsions (R-22a), (R-23a), (R-24a), (R-25a) and (R-26a) were each prepared similarly to the silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsions (R-22b), (R-23b), (R-24b), (R-25b) and (R-26b)

Red-sensitive silver halide emulsions R-22b), (R-23b), (R-24b), (R-25b) and (R-26b) were each prepared similarly to the silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsion (R-26c)

Red-sensitive silver halide emulsion (R-26c) was prepared similarly to the foregoing red-sensitive silver halide emulsion (R-21a), except that silver halide emulsion (R-6) was employed respectively in place of silver halide emulsion (R-1), the amount of sodium thiosulfate added was changed to $9.0\times10^{-6}$ mol/mol·AgX and after the addition of sodium thiosulfate, $3.0\times10^{-6}$ mol/mol·AgX of N,N-dimethyl selenourea was added and then, chloroauric acid was further added thereto, and exemplified compound (S-1-2) was added in an amount of $1\times10^{-4}$ mol/mol·AgX before the addition of sensitizing dyes (RS-1) and (RS-2).

Preparation of Red Sensitive Silver Halide Emulsion (R-26d)

Red sensitive silver halide emulsion (R-26d) was prepared similarly to the foregoing red-sensitive silver halide emulsion. (R-26a), except that exemplified compound (S-1-2) was further added in an amount of $1.3\times10^{-4}$ mol/mol·AgX at a time of 90% completion of chemical ripening between addition of sodium thiosulfate and addition of exemplified compound (S-2-5).

Preparation of Red Sensitive Silver Halide Emulsion (R-26e)

Red sensitive silver halide emulsion (R-26e) was prepared similarly to the foregoing red-sensitive silver halide emulsion (R-26b), except that exemplified compound (S-1-2) was further added in an amount of $1.3\times10^{-4}$ mol/mol·AgX at a time of 90% completion of chemical ripening between addition of sodium thiosulfate and addition of exemplified compound (S-2-5).

Preparation of Green Sensitive Silver Halide Emulsion (G-21a)

To the foregoing silver halide emulsion (G-1) prepared in Example 2, sensitizing dye (GS-1) was added at 60° C., a pH of 5.8 and a pAg of 7.5 and subsequently, the following sodium thiosulfate and chloroauric acid were successively added to perform spectral sensitization and chemical sensitization. Following addition of the chemical sensitizers and when optimally ripened, compounds (S-2-5) was added to stop ripening. Green-sensitive silver halide emulsion (G-21a) was thus obtained.

| | |
|---|---|
| 1. Sensitizing dye GS-1 | $4.0\times10^{-4}$ mol/mol AgX |
| 2. Sodium thiosulfate | $4.0\times10^{-6}$ mol/mol AgX |
| 3. Chloroauric acid | $1.2\times10^{-5}$ mol/mol AgX |
| 4. Compound S-2-5 | $1.5\times10^{-4}$ mol/mol AgX |

Preparation of green Sensitive Silver Halide Emulsion (G-21b)

Green-sensitive silver halide emulsion (G-21b) was prepared similarly to the foregoing green-sensitive silver halide emulsion (G-21a), except that the amount of sodium thiosulfate added was changed to $1.5\times10^{-6}$ mol/mol·AgX and after the addition of sodium thiosulfate, $2.5\times10^{-6}$ mol/mol·AgX of triphenylphosphine selenide was added and then, chloroauric acid was further added thereto.

Preparation of Green-Sensitive Silver Halide Emulsion (G-21b).

Green-sensitive silver halide emulsion (G-21c) was prepared similarly to the foregoing green-sensitive silver halide emulsion (G-21a), except that the amount of sodium thiosulfate added was changed to $1.5\times10^{-6}$ mol/mol·AgX and after the addition of sodium thiosulfate, $2.5\times10^{-6}$ mol/mol·AgX of trifurylphosphine selenide was added and then, chloroauric acid was further added thereto.

Preparation of Green-Sensitive Silver Halide Emulsion (G-21d)

Green-sensitive silver halide emulsion (G-21d) was prepared similarly to the foregoing green-sensitive silver halide emulsion (G-21c), except that exemplified compound (S-1-21) was added in an amount of $1.2\times10^{-4}$ mol/mol·AgX before the addition of sensitizing dye (GS-1).

Preparation of Green-Sensitive Silver Halide Emulsion (G-21e)

Green-sensitive silver halide emulsion (G-21e) was prepared similarly to the foregoing green-sensitive silver halide emulsion (G-21c), except that exemplified compound (S-1-2) was added in an amount of $1.2\times10^{-4}$ mol/mol·AgX before the addition of sensitizing dye (GS-1).

Preparation of Green-Sensitive Silver Halide Emulsions (G-22a), (G-23a), (G-24a), (G-25a) and (G-26a)

Green-sensitive silver halide emulsions (G-22a), (G-23a), (G-24a), (G-25a) and (G-26a) were each prepared similarly to the foregoing green-sensitive silver halide emulsion (G-21d), except that silver halide emulsion (G-2), (G-3), (G-4), (G-5) prepared in Example 2 and (G-6) prepared in Example 1 were employed respectively in place of silver halide emulsion (G-1).

Preparation of Green-Sensitive Silver Halide Emulsions (G-22b), (G-23b), (G-24b), (G-25b) and (G-26b)

Green-sensitive silver halide emulsions (G-22b), (G-23b), (G-24b), (G-25b) and (G-26b) were each prepared similarly to the foregoing green-sensitive silver halide emulsion (G-21e), except that silver halide emulsion (G-2), (G-3), (G-4), (G-5) prepared in Example 2 and (G-6) prepared in Example 1 were employed respectively in place of silver halide emulsion (G-1).

Preparation of Green-Sensitive Silver Halide Emulsion (G-26c)

Green-sensitive silver halide emulsion (G-26c) was prepared similarly to the foregoing green-sensitive silver halide emulsion (G-21a), except that silver halide emulsion (G-6) was employed respectively in place of silver halide emulsion (G-1), the amount of sodium thiosulfate added was changed to $1.5\times10^{-6}$ mol/mol·AgX and after the addition of sodium thiosulfate, $2.5\times10^{-6}$ mol/mol·AgX of N,N-dimethyl selenourea was added and then, chloroauric acid was further added thereto, and exemplified compound (S-1-2) according to this invention was added in an amount of $1.0\times10^{-4}$ mol/mol·AgX before the addition of sensitizing dye (GS-1).

Preparation of Green Sensitive Silver Halide Emulsion (G-26d)

Green sensitive silver halide emulsion (G-26d) was prepared similarly to the foregoing green-sensitive silver halide emulsion (G-26a), except that exemplified compound (S-1-2) was further added in an amount of $1.0\times10^{-4}$ mol/mol·AgX at a time of 90% completion of chemical ripening between addition of sodium thiosulfate and addition of exemplified compound (S-2-5).

Preparation of Green Sensitive Silver Halide Emulsion (G-26e)

Green sensitive silver halide emulsion (G-26e) was prepared similarly to the foregoing green-sensitive silver halide emulsion (G-26b), except that a compound according to this invention (S-1-2) was further added in an amount of $1.0\times10^{-4}$ mol/mol·AgX at a time of 90% completion of chemical ripening between addition of sodium thiosulfate and addition of exemplified compound (S-2-5).

Preparation of Blue-Sensitive Emulsion (B-21a)

To the foregoing silver halide emulsion (B-1) prepared in example 2, sensitizing dyes (BS-1) and (BS-2) were added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, exemplified compounds (S-2-5), (S-2-2) and (S-2-3) were successively added to stop ripening, and blue-sensitive silver halide emulsion (B-21a) was thus obtained.

| | |
|---|---|
| 1: sodium thiosulfate | $5.0\times10^{-6}$ mol/mol AgX |
| 2: chloroauric acid | $1.5\times10^{-5}$ mol/mol AgX |
| 3: compound(S-2-5) | $2.0\times10^{-4}$ mol/mol AgX |
| 4: compound(S-2-2) | $2.0\times10^{-4}$ mol/mol AgX |
| 5: compound(S-2-3) | $3.0\times10^{-4}$ mol/mol AgX |
| 6: sensitizing dye (BS-1) | $4.0\times10^{-4}$ mol/mol AgX |
| 7: sensitizing dye (BS-2) | $1.0\times10^{-4}$ mol/mol AgX |

Preparation of Blue-Sensitive Silver Halide Emulsion (B-21b)

Blue-sensitive silver halide emulsion (B-21b) was prepared similarly to the foregoing blue-sensitive silver halide emulsion (B-21a), except that the amount of sodium thiosulfate added was changed to $3.0\times10^{-6}$ mol/mol·AgX and after the addition of sodium thiosulfate, $2.0\times10^{-6}$ mol/mol·AgX of triphenylphosphine selenide was added and then, chloroauric acid was further added thereto.

Preparation of Blue-Sensitive Silver Halide Emulsion (B-21c)

Blue-sensitive silver halide emulsion (B-21c) was prepared similarly to the foregoing blue-sensitive silver halide emulsion (B-21a), except that the amount of sodium thiosulfate added was changed to $3.0\times10^{-6}$ mol/mol·AgX and after the addition of sodium thiosulfate, $2.0\times10^{-6}$ mol/mol·AgX of trifurylphosphine selenide was added and then, chloroauric acid was further added thereto.

Preparation of Blue-Sensitive Silver Halide Emulsion (B-21d)

Blue-sensitive silver halide emulsion (B-21d) was prepared similarly to the foregoing blue-sensitive silver halide emulsion (B-21c), except that exemplified compound (S-1-21) was added in an amount of $1.0\times10^{-4}$ mol/mol·AgX before the addition of sensitizing dyes (BS-1) and (BS-2).

Preparation of Blue-Sensitive Silver Halide Emulsion (B-21e)

Blue-sensitive silver halide emulsion (B-21e) was prepared similarly to the foregoing blue-sensitive silver halide emulsion (B-21c), except that exemplified compound (S-1-2) was added in an amount of $1.0\times10^{-4}$ mol/mol·AgX before the addition of sensitizing dyes (BS-1) and (BS-2).

Preparation of Blue-Sensitive Silver Halide Emulsions (B-22a), (B-23a), (B-24a), (B-25a) and (B-26a)

Blue-sensitive silver halide emulsions (B-22a), (B-23a), (B-24a), (B-25a) and (B-26a) were each prepared similarly to the foregoing blue-sensitive silver halide emulsion (B-21d), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsions (B-22b), (B-23b), (B-24b), (B-25b) and (B-26b)

Blue-sensitive silver halide emulsions (B-22b), (B-23b), (B-24b), (B-25b) and (B-26b) were each prepared similarly to the foregoing blue-sensitive silver halide emulsion (B-21e), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsion (B-26c)

Blue-sensitive silver halide emulsion (B-26c) was prepared similarly to the foregoing blue-sensitive silver halide emulsion (B-21a), except that silver halide emulsion (B-6) was employed respectively in place of silver halide emulsion (B-1), the amount of sodium thiosulfate added was changed to $3.0\times10^{-6}$ mol/mol·AgX and after the addition of sodium thiosulfate, $2.0\times10^{-6}$ mol/mol·AgX of N,N-dimethyl selenourea was added and then, chloroauric acid was further added thereto, and exemplified compound (S-1-2) according to this invention was added in an amount of $1.0\times10^{-4}$ mol/mol·AgX before the addition of sensitizing dyes (BS-1) and (BS-2).

Preparation of Blue Sensitive Silver Halide Emulsion (B-26d)

Blue sensitive silver halide emulsion (B-26d) was prepared similarly to the foregoing blue-sensitive silver halide emulsion (B-26a), except that exemplified compound (S-1-2) was further added in an amount of $1.0\times10^{-4}$ mol/mol·AgX at a time of 90% completion of chemical ripening between addition of sodium thiosulfate and addition of exemplified compound (S-2-5).

Preparation of Blue Sensitive Silver Halide Emulsion (B-26e)

Blue sensitive silver halide emulsion (B-26e) was prepared similarly to the foregoing blue-sensitive silver halide emulsion (B-26b), except that exemplified compound (S-1-2) was further added in an amount of $1.0\times10^{-4}$ mol/mol·AgX at a time of 90% completion of chemical ripening between addition of sodium thiosulfate and addition of exemplified compound (S-2-5).

Samples 1201 to 1216 were prepared in the similar way as Sample 1001 in Example 1 except that silver halide emulsion (B-6a) in the 1st layer, silver halide emulsion (G-6a) in the 3rd layer and silver halide emulsion (R-1a) in the 5th layer were each replaced by the silver halide emulsion shown in the Table below, and they were evaluated in the same way as Example 1.

| Sample No. | AgX Emulsion 1st layer | 3rd layer | 5th layer | Remarks |
|---|---|---|---|---|
| 1201 | B-21a | G-21a | R-21a | Comparative |
| 1202 | B-21b | G-21b | R-21b | Comparative |
| 1203 | B-21c | G-21c | R-21c | Comparative |
| 1204 | B-21d | G-21d | R-21d | Inventive |
| 1205 | B-21e | G-21e | R-21e | Inventive |
| 1206 | B-22a | G-22a | R-22a | Inventive |
| 1207 | B-22b | G-22b | R-22b | Inventive |
| 1208 | B-23a | G-23a | R-23a | Inventive |
| 1209 | B-23b | G-23b | R-23b | Inventive |
| 1210 | B-24a | G-24a | R-24a | Inventive |
| 1211 | B-24b | G-24b | R-24b | Inventive |
| 1212 | B-25a | G-25a | R-25a | Inventive |
| 1213 | B-25b | G-25b | R-25b | Inventive |
| 1214 | B-26a | G-26a | R-26a | Inventive |
| 1215 | B-26b | G-26b | R-26b | Inventive |
| 1216 | B-26c | G-26c | R-26c | Inventive |
| 1217 | B-26d | G-26d | R-26d | Inventive |
| 1218 | B-26e | G-26e | R-26e | Inventive |

Result is shown in the following Table.

| Sample No. | *(S) | **(γ) | ***(Δγ) | Coating composition storage stability *(S) | Fog | Remarks |
|---|---|---|---|---|---|---|
| 1201 | 100 | 100 | 127 | 79 | 120 | Comp. |
| 1202 | 114 | 100 | 129 | 79 | 122 | Comp. |
| 1203 | 118 | 102 | 129 | 81 | 119 | Comp. |
| 1204 | 131 | 116 | 112 | 90 | 108 | Inv. |
| 1205 | 130 | 114 | 114 | 90 | 109 | Inv. |
| 1206 | 134 | 117 | 109 | 92 | 108 | Inv. |
| 1207 | 134 | 117 | 110 | 92 | 107 | Inv. |
| 1208 | 136 | 120 | 107 | 93 | 106 | Inv. |
| 1209 | 137 | 119 | 107 | 92 | 106 | Inv. |
| 1210 | 142 | 122 | 105 | 95 | 106 | Inv. |
| 1211 | 142 | 122 | 104 | 95 | 105 | Inv. |
| 1212 | 148 | 124 | 102 | 97 | 104 | Inv. |
| 1213 | 147 | 123 | 103 | 96 | 105 | Inv. |
| 1214 | 153 | 127 | 101 | 98 | 103 | Inv. |
| 1215 | 156 | 128 | 101 | 98 | 103 | Inv. |
| 1216 | 151 | 125 | 103 | 97 | 103 | Inv. |
| 1217 | 162 | 132 | 101 | 99 | 101 | Inv. |
| 1218 | 163 | 133 | 101 | 99 | 101 | Inv. |

*(S): Sensitivity
**(γ): Gradation(γ)
***(Δγ): Latent image stability

It is apparent from the result shown in the table that each sample employing silver halide emulsion according to this invention demonstrates good result of high γ, good latent image stability for high sensitivity and coating composition storage stability in comparison with comparative samples. Sensitivity, gradation (γ), latent image stability and coating composition storage stability was evaluated by preparing characteristic curves of a magenta image and a yellow image as in Example 1, samples employing silver halide emulsion according to this invention demonstrate excellent results as well as a cyan image.

EXAMPLE 6

The same evaluation was performed as Example 3 employing samples 1201-1218 prepared in Example 5. The result is shown in the following Table. Samples according to this invention show excellent advantage in comparison to comparative samples.

| Sample No. | Clearness of Fine Line and Letter | Skin Tone Reproduction | Reproduction of Leaves Green | Print Reproducibility | Remark |
|---|---|---|---|---|---|
| 1201 | D | D | D | D | Comp. |
| 1202 | D | D | C | C | Comp. |
| 1203 | C | D | C | C | Comp. |
| 1204 | B | C | B | B | Inv. |
| 1205 | B | C | B | B | Inv. |
| 1206 | B | B | A | A | Inv. |
| 1207 | B | B | A | A | Inv. |
| 1208 | A | B | A | A | Inv. |
| 1209 | A | B | A | A | Inv. |
| 1210 | A | B | A | A | Inv. |
| 1211 | A | B | A | A | Inv. |
| 1212 | A | B | A | A | Inv. |
| 1213 | A | B | A | A | Inv. |
| 1214 | A | B | A | A | Inv. |
| 1215 | A | B | A | A | Inv. |
| 1216 | A | B | A | A | Inv. |
| 1217 | A | B | A | A | Inv. |
| 1218 | A | B | A | A | Inv. |

EXAMPLE 7

The same evaluation was performed as Example 4 employing samples 1201-1218 prepared in Example 5. The result is shown in the following Table. Samples according to this invention shows excellent advantage in comparison to comparative samples.

| Sample No. | Clearness of Fine Line and Letter | Skin Tone Reproduction | Reproduction of Leaves Green | Print Reproducibility | Remark |
|---|---|---|---|---|---|
| 1201 | D | D | D | D | Comp. |
| 1202 | C | D | C | D | Comp. |
| 1203 | C | D | C | C | Comp. |
| 1204 | B | C | B | B | Inv. |
| 1205 | B | C | B | B | Inv. |
| 1206 | A | B | A | B | Inv. |
| 1207 | A | B | A | B | Inv. |
| 1208 | A | B | A | A | Inv. |
| 1209 | A | B | A | A | Inv. |
| 1210 | A | B | A | A | Inv. |
| 1211 | A | B | A | A | Inv. |
| 1212 | A | B | A | A | Inv. |
| 1213 | A | B | A | A | Inv. |
| 1214 | A | B | A | A | Inv. |
| 1215 | A | B | A | A | Inv. |
| 1216 | A | B | A | A | Inv. |
| 1217 | A | B | A | A | Inv. |
| 1218 | A | B | A | A | Inv. |

EXAMPLE 8

Preparation of Red Sensitive Silver Halide Emulsion (R-31a)

To the foregoing silver halide emulsion (R-1), sensitizing dyes (RS-1) and (RS-2) were added at 60° C., a pH of 5.0 and a pAg of 7.1, subsequently, the following sodium thiosulfate and chloroauric acid were added to perform spectral sensitization and chemical sensitization. Following the addition of chemical sensitizers and when optimally ripened, compounds (S-2-5) was successively added to stop ripening. Red-sensitive silver halide emulsion (R-31a) was thus obtained.

| | |
|---|---|
| 1: sodium thiosulfate | $1.2 \times 10^{-5}$ mol/mol AgX |
| 2: chloroauric acid | $1.3 \times 10^{-5}$ mol/mol AgX |
| 3: compound (S-2-5) | $1.2 \times 10^{-4}$ mol/mol AgX |
| 4: sensitizing dye (RS-1) | $1.0 \times 10^{-4}$ mol/mol AgX |
| 5: sensitizing dye (RS-2) | $1.0 \times 10^{-4}$ mol/mol AgX |

Preparation of Red Sensitive Silver Halide Emulsion (R-31b)

Red-sensitive silver halide emulsion (R-31b) was prepared similarly to the foregoing red-sensitive silver halide emulsion (R-31a), except that the amount of sodium thiosulfate added was changed to $9.0\times10^{-6}$ mol/mol·AgX and after the addition of sodium thiosulfate, $3.0\times10^{-6}$ mol/mol·AgX of triphenylphosphine selenide was added and then, chloroauric acid was further added thereto.

Preparation of Silver Halide Emulsion (R-31c)

Red-sensitive silver halide emulsion (R-31c) was prepared similarly to the foregoing red-sensitive silver halide emulsion (R-31a), except that the amount of sodium thiosulfate added was changed to $9.0\times10^{-6}$ mol/mol·AgX and after the addition of sodium thiosulfate, $3.0\times10^{-6}$ mol/mol·AgX of trifurylphosphine selenide was added and then, chloroauric acid was further added thereto.

Preparation of Red-Sensitive Silver Halide Emulsion (R-31d)

Red-sensitive silver halide emulsion (R-31d) was prepared similarly to the foregoing red-sensitive silver halide emulsion (R-31c), except that exemplified compound (S-4-6) according to this invention was added in an amount of $1.0\times10^{-3}$ mol/mol·AgX before the addition of sensitizing dyes (RS-1) and (RS-2).

Preparation of Red-Sensitive Silver Halide Emulsion (R-31e)

Red-sensitive silver halide emulsion (R-31e) was prepared similarly to the foregoing red-sensitive silver halide emulsion (R-31c), except that exemplified compound (S-4-0) according to this invention was added in an amount of $1.0\times10^{-6}$ mol/mol·AgX before the addition of sensitizing dyes (RS-1) and (RS-2).

Preparation of Red-Sensitive Silver Halide Emulsions (R-32a), (R-33a), (R-34a), (R-35a) and (R-36a)

Red-sensitive silver halide emulsions (R-32a), (R-33a), (R-34a), (R-35a) and (R-36a) were each prepared similarly to the silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsions (R-32b), (R-33b), (R-34b), (R-35b) and (R-36b)

Red-sensitive silver halide emulsions (R-32b), (R-33b), (R-34b), (R-35b) and (R-36b) were each prepared similarly to the silver halide emulsion (R-1), except that silver halide emulsion (R-2), (R-3), (R-4), (R-5), (R-6) prepared in Example 1 were employed respectively in place of silver halide emulsion (R-1).

Preparation of Red-Sensitive Silver Halide Emulsion (R-36c)

Red-sensitive silver halide emulsion (R-36c) was prepared similarly to the foregoing red-sensitive silver halide emulsion (R-31a), except that silver halide emulsion (R-6) was employed respectively in place of silver halide emulsion (R-1), the amount of sodium thiosulfate added was changed to $9.0\times10^{-6}$ mol/mol·AgX and after the addition of sodium thiosulfate, $3.0\times10^{-6}$ mol/mol·AgX of N,N-dimethyl selenourea was added and then, chloroauric acid was further added thereto, and a compound according to this invention (S-4-0) according to this invention was added in an amount of $1.0\times10^{-4}$ mol/mol·AgX before the addition of sensitizing dyes (RS-1) and (RS-2).

Preparation of Red Sensitive Silver Halide Emulsion (R-36d)

Red sensitive silver halide emulsion (R-36d) was prepared similarly to the foregoing red-sensitive silver halide emulsion (R-36a), except that exemplified compound (S-4-0) was further added in an amount of $1.0\times10^{-5}$ mol/mol·AgX at a time of 90% completion of chemical ripening between addition of sodium thiosulfate and addition of exemplified compound (S-2-5).

Preparation of Red Sensitive Silver Halide Emulsion (R-36e)

Red sensitive silver halide emulsion (R-36e) was prepared similarly to the foregoing red-sensitive silver halide emulsion (R-36b), except that exemplified compound (S-4-0) was further added in an amount of $1.3\times10^{-4}$ mol/mol·AgX at a time of 90% completion of chemical ripening between addition of sodium thiosulfate and addition of exemplified compound (S-2-5).

Preparation of Green Sensitive Silver Halide Emulsion (G-31a)

To the foregoing silver halide emulsion (G-1) prepared in Example 2, sensitizing dye (GS-1) was added at 60° C., a pH of 5.8 and a pAg of 7.5 and subsequently, the following sodium thiosulfate and chloroauric acid were successively added to perform spectral sensitization and chemical sensitization. Following addition of the chemical sensitizers and when optimally ripened, compound (S-2-5) were added to stop ripening. Green-sensitive silver halide emulsion (G-31a) was thus obtained.

| | |
|---|---|
| 1. Sensitizing dye GS-1 | $4.0 \times 10^{-4}$ mol/mol AgX |
| 2. Sodium thiosulfate | $4.0 \times 10^{-6}$ mol/mol AgX |
| 3. Chloroauric acid | $1.2 \times 10^{-5}$ mol/mol AgX |
| 4. Compound S-2-5 | $1.7 \times 10^{-4}$ mol/mol AgX |

Preparation of Green Sensitive Silver Halide Emulsion (G-31b)

Green-sensitive silver halide emulsion (G-31b) was prepared similarly to the foregoing green-sensitive silver halide emulsion (G-31a), except that the amount of sodium thiosulfate added was changed to $1.5\times10^{-6}$ mol/mol·AgX and after the addition of sodium thiosulfate, $2.5\times10^{-6}$ mol/mol·AgX of triphenylphosphine selenide was added and then, chloroauric acid was further added thereto.

Preparation of Green-Sensitive Silver Halide Emulsion (G-31c).

Green-sensitive silver halide emulsion (G-31c) was prepared similarly to the foregoing green-sensitive silver halide emulsion (G-31a), except that the amount of sodium thiosulfate added was changed to $1.5\times10^{-6}$ mol/mol·AgX and after the addition of sodium thiosulfate, $2.5\times10^{-6}$ mol/mol·AgX of trifurylphosphine selenide was added and then, chloroauric acid was further added thereto.

Preparation of Green-Sensitive Silver Halide Emulsion (G-31d)

Green-sensitive silver halide emulsion (G-31d) was prepared similarly to the foregoing green-sensitive silver halide emulsion (G-31c), except that exemplified compound (S-4-6) according to this invention was added in an amount of $1.2\times10^{-5}$ mol/mol·AgX before the addition of sensitizing dye (GS-1).

Preparation of Green-Sensitive Silver Halide Emulsion (G-31e)

Green-sensitive silver halide emulsion (G-31e) was prepared similarly to the foregoing green-sensitive silver halide emulsion (G-31c), except that exemplified compound (S-4-0) was added in an amount of $1.5\times10^{-6}$ mol/mol·AgX before the addition of sensitizing dye (GS-1).

Preparation of Green-Sensitive Silver Halide Emulsions (G-32a), (G-33a), (G-34a), (G-35a) and (G-36a)

Green-sensitive silver halide emulsions (G-32a), (G-33a), (G-34a), (G-35a) and (G-36a) were each prepared similarly to the foregoing green-sensitive silver halide emulsion (G-31d), except that silver halide emulsion (G-2), (G-3), (G-4), (G-5) prepared in Example 2 and (G-6) prepared in Example 1 were employed respectively in place of silver halide emulsion (G-1).

Preparation of Green-Sensitive Silver Halide Emulsions (G-32b), (G-33b), (G-34b), (G-35b) and (G-36b)

Green-sensitive silver halide emulsions (G-32b), (G-33b), (G-34b), (G-35b) and (G-36b) were each prepared similarly to the foregoing green-sensitive silver halide emulsion (G-31e), except that silver halide emulsion (G-2), (G-3), (G-4), (G-5) prepared in Example 2 and (G-6) prepared in Example 1 were employed respectively in place of silver halide emulsion (G-1).

Preparation of Green-Sensitive Silver Halide Emulsion (G-36c)

Green-sensitive silver halide emulsion (G-36c) was prepared similarly to the foregoing green-sensitive silver halide emulsion (G-31a), except that silver halide emulsion (G-6) was employed respectively in place of silver halide emulsion (G-1), the amount of sodium thiosulfate added was changed to $1.5\times10^{-6}$ mol/mol·AgX and after the addition of sodium thiosulfate, $2.5\times10^{-6}$ mol/mol·AgX of N,N-dimethyl selenourea was added and then, chloroauric acid was further added thereto, and exemplified compound (S-4-0) according to this invention was added in an amount of $1.0\times10^{-6}$ mol/mol·AgX before the addition of sensitizing dye (GS-1).

Preparation of Green Sensitive Silver Halide Emulsion (G-36d)

Green sensitive silver halide emulsion (G-36d) was prepared similarly to the foregoing green-sensitive silver halide emulsion (G-36a), except that exemplified compound (S-4-0) was further added in an amount of $7.0\times10^{-6}$ mol/mol·AgX at a time of 90% completion of chemical ripening between addition of sodium thiosulfate and addition of exemplified compound (S-2-5).

Preparation of Green Sensitive Silver Halide Emulsion (G-36e)

Green sensitive silver halide emulsion (G-36e) was prepared similarly to the foregoing green-sensitive silver halide emulsion (G-26b), except that exemplified compound (S-4-0) was further added in an amount of $7.0\times10^{-6}$ mol/mol·AgX at a time of 90% completion of chemical ripening between addition of sodium thiosulfate and addition of exemplified compound (S-2-5).

Preparation of Blue-Sensitive Emulsion (B-31a)

To the foregoing silver halide emulsion (B-1) prepared in example 2, sensitizing dyes (BS-1) and (BS-2) were added at 60° C., a pH of 5.8 and a pAg of 7.5, subsequently, the following sodium thiosulfate and chloroauric acid were added to perform spectral sensitization and chemical sensitization. Following the addition of chemical sensitizers and when optimally ripened, exemplified compounds (S-2-5), (S-2-2) and (S-2-3) were successively added to stop ripening, and blue-sensitive silver halide emulsion (B-31a) was thus obtained.

| | |
|---|---|
| 1: sodium thiosulfate | $5.0\times10^{-6}$ mol/mol AgX |
| 2: chloroauric acid | $1.9\times10^{-5}$ mol/mol AgX |
| 3: compound(S-2-5) | $2.0\times10^{-4}$ mol/mol AgX |
| 4: compound(S-2-2) | $2.0\times10^{-4}$ mol/mol AgX |
| 5: compound(S-2-3) | $2.0\times10^{-4}$ mol/mol AgX |
| 6: sensitizing dye (BS-1) | $4.0\times10^{-4}$ mol/mol AgX |
| 7: sensitizing dye (BS-2) | $1.0\times10^{-4}$ mol/mol AgX |

Preparation of Blue-Sensitive Silver Halide Emulsion (B-31b)

Blue-sensitive silver halide emulsion (B-31b) was prepared similarly to the foregoing blue-sensitive silver halide emulsion (B-31a), except that the amount of sodium thiosulfate added was changed to $3.0\times10^{-6}$ mol/mol·AgX and after the addition of sodium thiosulfate, $2.0\times10^{-6}$ mol/mol·AgX of triphenylphosphine selenide was added and then, chloroauric acid was further added thereto.

Preparation of Blue-Sensitive Silver Halide Emulsion (B-31c)

Blue-sensitive silver halide emulsion (B-31c) was prepared similarly to the foregoing blue-sensitive silver halide emulsion (B-31a), except that the amount of sodium thiosulfate added was changed to $3.0\times10^{-6}$ mol/mol·AgX and after the addition of sodium thiosulfate, $2.0\times10^{-6}$ mol/mol·AgX of trifurylphosphine selenide was added and then, chloroauric acid was further added thereto.

Preparation of Blue-Sensitive Silver Halide Emulsion (B-31d)

Blue-sensitive silver halide emulsion (B-31d) was prepared similarly to the foregoing blue-sensitive silver halide emulsion (B-31c), except that exemplified compound (S-4-6) was added in an amount of $8.0\times10^{-6}$ mol/mol·AgX before the addition of sensitizing dyes (BS-1) and (BS-2).

Preparation of Blue-Sensitive Silver Halide Emulsion (B-31e)

Blue-sensitive silver halide emulsion (B-31e) was prepared similarly to the foregoing blue-sensitive silver halide emulsion (B-31c), except that exemplified compound (S-4-0) was added in an amount of $7.0\times10^{-6}$ mol/mol·AgX before the addition of sensitizing dyes (BS-1) and (BS-2).

Preparation of Blue-Sensitive Silver Halide Emulsion (B-31e)

Blue-sensitive silver halide emulsion (B-31e) was prepared similarly to the foregoing blue-sensitive silver halide emulsion (B-31c), except that exemplified compound (S-4-

0) was added in an amount of $7.0\times10^{-6}$ mol/mol·AgX before the addition of sensitizing dyes (BS-1) and (BS-2).

Preparation of Blue-Sensitive Silver Halide emulsions (B-32a), (B-33a), (B-34a), (B-35a) and (B-36a)

Blue-sensitive silver halide emulsions (B-32a), (B-33a), (B-34a), (B-35a) and (B-36a) were each prepared similarly to the foregoing blue-sensitive silver halide emulsion (B-31d), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsions (B-32b), (B-33b), (B-34b), (B-35b) and (B-36b)

Blue-sensitive silver halide emulsions (B-32b), (B-33b), (B-34b), (B-35b) and (B-36b) were each prepared similarly to the foregoing blue-sensitive silver halide emulsion (B-21e), except that silver halide emulsion (B-2), (B-3), (B-4) and (B-5) prepared in Example 2 and (B-6) prepared in Example 1 were employed respectively in place of silver halide emulsion (B-1).

Preparation of Blue-Sensitive Silver Halide Emulsion (B-36c)

Blue-sensitive silver halide emulsion (B-36c) was prepared similarly to the foregoing blue-sensitive silver halide emulsion (B-31a), except that silver halide emulsion (B-6) was employed respectively in place of silver halide emulsion (B-1), the amount of sodium thiosulfate added was changed to $3.0\times10^{-6}$ mol/mol·AgX and after the addition of sodium thiosulfate, $2.0\times10^{-6}$ mol/mol·AgX of N,N-dimethyl selenourea was added and then, chloroauric acid was further added thereto, and exemplified compound (S-4-0) according to this invention was added in an amount of $7.0\times10^{-6}$ mol/mol·AgX before the addition of sensitizing dyes (BS-1) and (BS-2).

Preparation of Blue Sensitive Silver Halide Emulsion (B-36d)

Blue sensitive silver halide emulsion (B-36d) was prepared similarly to the foregoing blue-sensitive silver halide emulsion (B-36a), except that exemplified compound (S-4-0) was further added in an amount of $1.0\times10^{-6}$ mol/mol·AgX at a time of 90% completion of chemical ripening between addition of sodium thiosulfate and addition of exemplified compound (S-2-5).

Preparation of Blue Sensitive Silver Halide Emulsion (B-36e)

Blue sensitive silver halide emulsion (B-36e) was prepared similarly to the foregoing blue-sensitive silver halide emulsion (B-36b), except that exemplified compound (S-4-0) was further added in an amount of $1.0\times10^{-6}$ mol/mol·AgX at a time of 90% completion of chemical ripening between addition of sodium thiosulfate and addition of exemplified compound (S-2-5).

Samples 1301 to 1318 were prepared in the similar way as Sample 1001 in Example 1 except that silver halide emulsion (B-6a) in the 1st layer, silver halide emulsion (G-6a) in the 3rd layer and silver halide emulsion (R-1a) in the 5th layer were each replaced by the silver halide emulsion shown in the Table below, and they were evaluated in the same way as Example 1.

| Sample | AgX Emulsion | | | |
|---|---|---|---|---|
| No. | 1st layer | 3rd layer | 5th layer | Remarks |
| 1301 | B-31a | G-31a | R-31a | Comparative |
| 1302 | B-31b | G-31b | R-31b | Comparative |
| 1303 | B-31c | G-31c | R-31c | Comparative |
| 1304 | B-31d | G-31d | R-31d | Inventive |
| 1305 | B-31e | G-31e | R-31e | Inventive |
| 1306 | B-32a | G-32a | R-32a | Inventive |
| 1307 | B-32b | G-32b | R-32b | Inventive |
| 1308 | B-33a | G-33a | R-33a | Inventive |
| 1309 | B-33b | G-33b | R-33b | Inventive |
| 1310 | B-34a | G-34a | R-34a | Inventive |
| 1311 | B-34b | G-34b | R-34b | Inventive |
| 1312 | B-35a | G-35a | R-35a | Inventive |
| 1313 | B-35b | G-35b | R-35b | Inventive |
| 1314 | B-36a | G-36a | R-36a | Inventive |
| 1315 | B-36b | G-36b | R-36b | Inventive |
| 1316 | B-36c | G-36c | R-36c | Inventive |
| 1317 | B-36d | G-36d | R-36d | Inventive |
| 1318 | B-36e | G-36e | R-36e | Inventive |

Result is shown in the following Table.

| Sample | | | | Coating composition storage stability | | |
|---|---|---|---|---|---|---|
| No. | *(S) | **(γ) | ***(Δγ) | *(S) | Fog | Remarks |
| 1301 | 100 | 100 | 125 | 77 | 122 | Comparative |
| 1302 | 116 | 101 | 127 | 77 | 125 | Comparative |
| 1303 | 120 | 101 | 127 | 78 | 122 | Comparative |
| 1304 | 131 | 116 | 113 | 87 | 108 | Inventive |
| 1305 | 132 | 115 | 113 | 89 | 108 | Inventive |
| 1306 | 135 | 122 | 112 | 88 | 107 | Inventive |
| 1307 | 135 | 121 | 111 | 88 | 107 | Inventive |
| 1308 | 139 | 122 | 108 | 92 | 106 | Inventive |
| 1309 | 140 | 123 | 108 | 90 | 105 | Inventive |
| 1310 | 143 | 123 | 108 | 96 | 104 | Inventive |
| 1311 | 143 | 123 | 107 | 97 | 104 | Inventive |
| 1312 | 148 | 125 | 104 | 97 | 104 | Inventive |
| 1313 | 149 | 126 | 105 | 96 | 103 | Inventive |
| 1314 | 157 | 131 | 102 | 99 | 102 | Inventive |
| 1315 | 157 | 130 | 102 | 99 | 102 | Inventive |
| 1316 | 153 | 127 | 103 | 98 | 102 | Inventive |
| 1317 | 165 | 132 | 101 | 99 | 101 | Inventive |
| 1318 | 164 | 132 | 101 | 99 | 101 | Inventive |

It is apparent from the result shown in the table that each sample employing silver halide emulsion according to this invention demonstrates good result of high γ, good latent image stability for high sensitivity and coating composition storage stability in comparison with comparative samples. Sensitivity, gradation (γ), latent image stability and coating composition storage stability was evaluated by preparing characteristic curves of a magenta image and a yellow image as in Example 1, samples employing silver halide emulsion according to this invention demonstrate excellent results as well as a cyan image.

EXAMPLE 9

The same evaluation was performed as Example 3 employing samples 1301-1318 prepared in Example 8. The result is shown in the following Table. Samples according to this invention show excellent advantage in comparison to comparative samples.

| Sample No. | Clearness of Fine Line and Letter | Skin Tone Reproduction | Reproduction of Leaves Green | Print Reproducibility | Remark |
|---|---|---|---|---|---|
| 1301 | D | D | D | D | Comp. |
| 1302 | C | D | C | D | Comp. |
| 1303 | C | D | C | C | Comp. |
| 1304 | B | C | B | B | Inv. |
| 1305 | B | C | B | B | Inv. |
| 1306 | A | B | A | B | Inv. |
| 1307 | A | B | A | B | Inv. |
| 1308 | A | B | A | A | Inv. |
| 1309 | A | B | A | A | Inv. |
| 1310 | A | B | A | A | Inv. |
| 1311 | A | B | A | A | Inv. |
| 1312 | A | B | A | A | Inv. |
| 1313 | A | B | A | A | Inv. |
| 1314 | A | B | A | A | Inv. |
| 1315 | A | B | A | A | Inv. |
| 1316 | A | B | A | A | Inv. |
| 1317 | A | B | A | A | Inv. |
| 1318 | A | B | A | A | Inv. |

EXAMPLE 10

The same evaluation was performed as Example 4 employing samples 1301-1318 prepared in Example 5. The result is shown in the following Table. Samples according to this invention shows excellent advantage in comparison to comparative samples.

| Sample No. | Clearness of Fine Line and Letter | Skin Tone Reproduction | Reproduction of Leaves Green | Print Reproducibility | Remark |
|---|---|---|---|---|---|
| 1301 | D | D | D | D | Comp. |
| 1302 | D | C | C | D | Comp. |
| 1303 | C | C | C | C | Comp. |
| 1304 | B | B | B | B | Inv. |
| 1305 | B | B | B | B | Inv. |
| 1306 | B | B | A | A | Inv. |
| 1307 | B | B | A | A | Inv. |
| 1308 | A | B | A | A | Inv. |
| 1309 | A | B | A | A | Inv. |
| 1310 | A | B | A | A | Inv. |
| 1311 | A | B | A | A | Inv. |
| 1312 | A | B | A | A | Inv. |
| 1313 | A | B | A | A | Inv. |
| 1314 | A | B | A | A | Inv. |
| 1315 | A | B | A | A | Inv. |
| 1316 | A | B | A | A | Inv. |
| 1317 | A | B | A | A | Inv. |
| 1318 | A | B | A | A | Inv. |

INDUSTRIAL APPLICABILITY

This invention can provide a silver halide emulsion, silver halide photographic light sensitive material and image forming method, which is excellent in high sensitivity, good gradation regardless exposure method, coating composition storage stability, and latent image stability and gives high quality print constantly, and is particularly excellent latent image stability in digital exposure with high intensity short period exposure.

The invention claimed is:

1. A silver halide emulsion containing silver halide grains having silver chloride content of at least 90 mol %, silver iodide content of 0-2.0 mol %, and silver bromide content of 0.02-5.0 mol %, and containing at least two Group 8 metal compounds, including at least one iridium compound, inside of the silver halide grains, wherein the silver halide grains are subjected to selenium sensitization in presence of a compound represented by formula (S)

Formula (S)

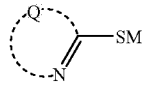

wherein Q is an atomic group necessary to form a 5- or 6-membered nitrogen-containing ring; $M^1$ is a hydrogen atom, an alkali metal or a cation group.

2. The silver halide emulsion containing silver halide grains having silver chloride content of at least 90 mol %, silver iodide content of 0-2.0 mol %, and silver bromide content of 0.02-5.0 mol %, and containing at least two Group 8 metal compounds, including at least one iridium compound, inside of the silver halide grains, wherein the silver halide grains contains at least one compound represented by formula (1) to (3), and the silver halide grains are subjected to selenium sensitization, $$R—SO_2S\text{-}M \qquad \text{Formula (1)}$$

$$R_1—SO_2S—R_2 \qquad \text{Formula (2)}$$

$$R_3—SO_2S\text{-}L_m\text{-}SSO_2—R_4 \qquad \text{Formula (3)}$$

wherein R, $R_1$, $R_2$, $R_3$, and $R_4$ are each an aliphatic group, an aromatic group or a heterocyclic group; M is a cation; L is a divalent linkage group; and m is 0 or 1.

3. The silver halide emulsion containing silver halide grains having silver chloride content of at least 90 mol %, silver iodide content of 0-2.0 mol %, and silver bromide content of 0.02-5.0 mol %, and containing at least two Group 8 metal compounds, including at least one iridium compound, inside of the silver halide grains, wherein the silver halide grains contain a compound represented by formula (4), and the silver halide grains are subjected to selenium sensitization, $$R_1—(S)_m—R_2 \qquad \text{Formula (4)}$$

wherein $R_1$ and $R_2$ are each an aliphatic group, an aromatic group or a heterocyclic group, or an atomic group forming a ring by bonding; $R_1$ and $R_2$ may be same or different; $R_1$ and $R_2$ combine with each other to form a ring when they are aliphatic groups; m1 is an integer of 2 to 6.

4. The silver halide emulsion containing silver halide grains having silver chloride content of at least 90 mol %, silver iodide content of 0-2.0 mol %, and silver bromide content of 0.02-5.0 mol %, and containing at least two Group 8 metal compounds, including at least one iridium compound, inside of the silver halide grains, wherein the silver halide grains contain a crown ether compound condensed by at least one aromatic ring, and the silver halide grains are subjected to selenium sensitization.

5. The silver halide emulsion described in claim 1, wherein at least one of the iridium compound is an iridium complex containing at least one aquo or organic ligand.

6. The silver halide emulsion described in claim 1, wherein the silver halide grains contain silver bromide-localized phase at least one portion of outermost shell.

7. The silver halide emulsion described in claim 1, wherein the silver halide grains contain silver iodide-localized phase inside of the silver halide grains.

8. The silver halide emulsion described in claim 1, wherein the silver halide grains contain the compound represented by formula (S) inside of the silver halide grains.

9. The silver halide emulsion described in claim 1, wherein the compound represented by formula (S) is a compound represented by formula (S-2), Formula (S-2)

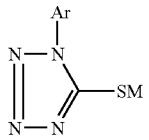

wherein Ar is a group represented by the following formula:

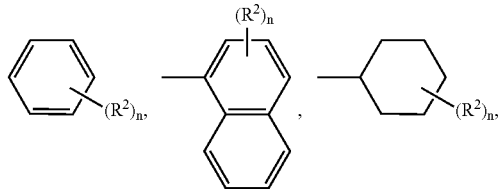

wherein $R^2$ is an alkyl group, an alkoxy group, a carboxy group or its salt, a sulfo group or its salt, a hydroxy group, an amino group, an acylamino group, a carbamoyl group or a sulfonamido group; n is an integer of 0 to 2; $M^1$ is the same as defined in The formula (S).

10. A silver halide photographic light sensitive material having at least one of an image forming layer provided on a support, wherein at least one of the image forming layer comprises the silver halide emulsion described in claim 1.

11. An image forming method comprising color developing after scanning exposing a silver halide photographic light sensitive material of claim 10.

12. The silver halide emulsion of claim 1 containing at least two Group 8 metal compounds which comprises at least two iridium compounds inside of the silver halide grains.

13. The silver halide emulsion of claim 1 containing a metal compound of at least one metal selected from iron, rhodium, osmium, ruthenium, cobalt and platinum, and at least one iridium compound, inside of the silver halide grains.

* * * * *